US007469117B2

(12) United States Patent
Takahata et al.

(10) Patent No.: US 7,469,117 B2
(45) Date of Patent: Dec. 23, 2008

(54) IMAGE FORMING APPARATUS, DEVELOPING UNIT, AND COMPUTER SYSTEM

(75) Inventors: Toshiya Takahata, Nagano-ken (JP); Ken Yoshizuka, Nagano-ken (JP); Yoichiro Irie, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 142 days.

(21) Appl. No.: 10/514,790

(22) PCT Filed: May 16, 2003

(86) PCT No.: PCT/JP03/06152

§ 371 (c)(1),
(2), (4) Date: Jul. 29, 2005

(87) PCT Pub. No.: WO03/098355

PCT Pub. Date: Nov. 27, 2003

(65) Prior Publication Data

US 2006/0051128 A1 Mar. 9, 2006

(30) Foreign Application Priority Data

May 21, 2002 (JP) ..... 2002-146889
May 21, 2002 (JP) ..... 2002-146890

(51) Int. Cl.
*G03G 15/01* (2006.01)
*G03G 15/10* (2006.01)

(52) U.S. Cl. ..... 399/227; 399/58

(58) Field of Classification Search ..... 399/227, 399/58, 61, 119, 225
See application file for complete search history.

(56) References Cited

U.S. PATENT DOCUMENTS

| | | | | |
|---|---|---|---|---|
| 2001/0019667 | A1* | 9/2001 | Yamashita | 399/27 |
| 2001/0043259 | A1* | 11/2001 | Ogata | 347/140 |
| 2002/0021909 | A1* | 2/2002 | Harumoto | 399/27 |
| 2003/0133719 | A1* | 7/2003 | Tsuruya et al. | 399/12 |

FOREIGN PATENT DOCUMENTS

| | | | |
|---|---|---|---|
| EP | 1 182 520 | A2 | 2/2002 |
| JP | 2001-22230 | A | 1/2001 |
| JP | 2001-209280 | A | 8/2001 |
| JP | 2001-344575 | A | 12/2001 |
| JP | 2001-353842 | A | 12/2001 |
| JP | 2002-014579 | | 1/2002 |
| JP | 2002-14579 | A | 1/2002 |
| JP | 2002-62784 | A | 2/2002 |
| JP | 2002-72825 | A | 3/2002 |
| JP | 2002-333756 | A | 11/2002 |
| KR | 2002-0016572 | A | 3/2002 |

* cited by examiner

*Primary Examiner*—David M. Gray
*Assistant Examiner*—Joseph S. Wong
(74) *Attorney, Agent, or Firm*—Sughrue Mion, PLLC

(57) ABSTRACT

An image forming apparatus and a computer system having an efficient communication system are achieved. The image forming apparatus etc. is provided with an antenna that is capable of wirelessly communicating both with the developing-unit element of the developing unit attached to the developing unit attach/detach section and with the photoconductor-unit element of the photoconductor unit attached to the photoconductor unit attach/detach section. Further, when R is an outermost diameter of a path traced by the developing units and r is an outermost diameter of a path traced by the elements when the rotating member is rotated with the developing units attached to the attach/detach sections, then a relationship R>r is satisfied.

3 Claims, 28 Drawing Sheets

| address | information content (8 bit) |
|---|---|
| 00H | ID information |
| 01H | manufacturing date |
| 02H | destination |
| 03H | manufacturing line |
| 04H | compatible models |
| 05H | toner remaining amount |
| ⋮ | ⋮ |

FIG. 7

| address | information content (8 bit) |
|---|---|
| 00H | ID information |
| 01H | manufacturing date |
| 02H | destination |
| 03H | manufacturing line |
| 04H | compatible models |
| 05H | number of sheets printed by main unit when usage starts |
| 06H | number of sheets printed by main unit when usage ends |
| 07H | number of color printed sheets |
| 08H | number of monochrome printed sheets |
| 09H | number of yellow printed sheets |
| 0AH | number of magenta printed sheets |
| 0BH | number of cyan printed sheets |
| 0CH | number of black printed sheets |
| 0DH<br>⋮ | ⋮ |

FIG. 8

(opposition position)
developing position (detach position)
attach/detach position home position

| address | information content (8 bit) |
|---|---|
| 00H | ID information |
| 01H | manufacturing date |
| 02H | destination |
| 03H | manufacturing line |
| 04H | compatible models |
| 05H | toner remaining amount |
| ⋮ | ⋮ |

FIG. 22

| address | information content (8 bit) |
|---|---|
| 00H | ID information |
| 01H | manufacturing date |
| 02H | destination |
| 03H | manufacturing line |
| 04H | compatible models |
| 05H | number of sheets printed by main unit when usage starts |
| 06H | number of sheets printed by main unit when usage ends |
| 07H | number of color printed sheets |
| 08H | number of monochrome printed sheets |
| 09H | number of yellow printed sheets |
| 0AH | number of magenta printed sheets |
| 0BH | number of cyan printed sheets |
| 0CH | number of black printed sheets |
| 0DH ⋮ | ⋮ |

FIG. 23

(opposition position)
developing position (detach position)
attach/detach position home position

IMAGE FORMING APPARATUS, DEVELOPING UNIT, AND COMPUTER SYSTEM

TECHNICAL FIELD

The present invention relates to image forming apparatuses, developing units, and computer systems.

BACKGROUND ART

Among image forming apparatuses such as laser beam printers, there are those to and from which a developing unit having an element (memory) can be attached and detached, and in which a latent image formed on a photoconductor provided in a photoconductor unit is printed in full color by rotating the attached developing unit using a rotating device such as a rotary.

To read and write various types of information to and from the element (memory) of the developing unit and the element (memory) of the photoconductor unit, communication is carried out wirelessly between these elements (memories) and the main image forming apparatus.

It is necessary to provide an antenna on the main image forming apparatus side in order to perform wireless communication with the elements. At this time, it is inefficient to provide separate antennas for wirelessly communicating with the element (memory) of the developing unit and for wirelessly communicating with the element (memory) of the photoconductor unit.

Also, it is preferable that communication between the elements (memories) of developing units and the main image forming apparatus is possible at a plurality of rotation angles of the rotating device. However, when an antenna capable of this is provided on the main image forming apparatus side, there is the problem that the antenna must be large.

It is an object of the present invention to achieve image forming apparatuses and computer systems that have efficient communication systems.

It is a further object of the present invention to achieve image forming apparatuses, developing units, and computer systems that allow the size of the antenna for wirelessly communicating with an element of a developing unit to be made small.

DISCLOSURE OF INVENTION

A main aspect of the present invention is an image forming apparatus comprising: a developing unit attach/detach section to and from which a developing unit having a developing-unit element that is capable of performing communication can be attached and detached; a photoconductor unit attach/detach section to and from which a photoconductor unit having a photoconductor-unit element that is capable of performing communication can be attached and detached; and an antenna that is capable of wirelessly communicating both with the developing-unit element of the developing unit attached to the developing unit attach/detach section and with the photoconductor-unit element of the photoconductor unit attached to the photoconductor unit attach/detach section.

Another main aspect of the present invention is an image forming apparatus comprising: a rotating member provided with a plurality of attach/detach sections, to and from each of which a developing unit having an element that is capable of performing communication can be attached and detached; and an antenna for wirelessly communicating, at a plurality of rotation angles of the rotating member, with the elements of the developing units attached respectively to the attach/detach sections; wherein, when R is an outermost diameter of a path traced by the developing units and r is an outermost diameter of a path traced by the elements when the rotating member is rotated with the developing units attached to the attach/detach sections, then a relationship R>r is satisfied.

Features and objects of the present invention other than the above will become clear through the present specification and the description in the accompanying drawings.

BRIEF DESCRIPTION OF DRAWINGS

FIG. 7 is a diagram for describing the information stored in the memory cell 54*h* of the element 54*a*.

FIG. 8 is a diagram for describing the information stored in the memory cell of the element 54*a* of the photoconductor unit 75.

FIG. 22 is a diagram for describing the information stored in the memory cell 2054*h* of the element 2054*a*.

FIG. 23 is a diagram for describing the information stored in the memory cell of the element 2054*a* of the photoconductor unit 2075.

Figure 1:
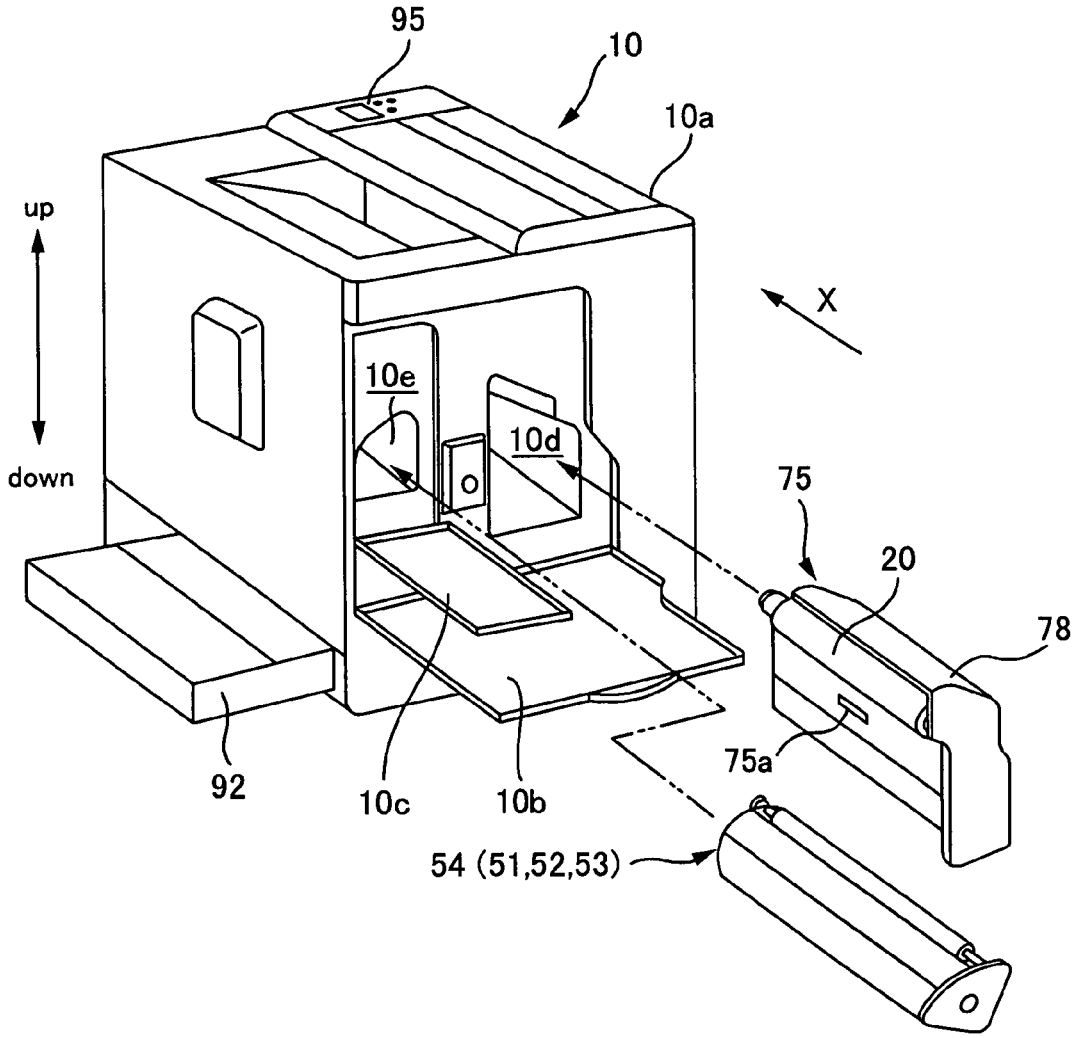
FIG. 1 is a diagram for describing how the developing unit 54 (51, 52, 53) and the photoconductor unit 75 are attached to and detached from the main printer unit 10*a*.

A legend of the main reference numerals used in the drawings is described below.

10 printer
10*a* main printer unit
10*b* first opening cover
10*c* second opening cover
10*d* photoconductor unit attach/detach opening
10*e* developing unit attach/detach opening
20 photoconductor
30 charging unit
40 exposing unit
50 YMCK developing device
51 cyan developing unit
52 magenta developing unit
53 black developing unit
54 yellow developing unit
51*a*, 52*a*, 53*a*, 54*a* elements
54*b* noncontact IC chip
54*c* capacitor for resonation
54*d* element-side antenna
54*e* rectifier
54*f* signal analysis section RF
54*g* controller
54*h* memory cell
55 rotary
55*a* central shaft
55*b*, 55*c*, 55*d*, 55*e* attach/detach sections
60 first transferring unit
70 intermediate transferring member
75 photoconductor unit
75*a* element
76 cleaning blade
76*a* waste toner containing section
80 second transferring unit
90 fusing unit
92 paper supply tray
94 paper supply roller
95 display unit
96 resisting roller
100 control unit
101 main controller
102 unit controller
112 interface
113 image memory
120 CPU
121 serial interface
122 main-unit-side memory (memory element)
123 send/receive circuit
124 main-unit-side antenna
125 YMCK developing device drive control circuit
126*a* AC voltage supply section
126*b* DC voltage supply section
127 exposing unit drive control circuit
127*a* pixel counter
510 developing roller (developer bearing roller)
520 seal member
524 seal urging member
522 seal-supporting metal plate
530 first toner containing section
535 second toner containing section
540 housing
541 opening
545 restriction wall
550 toner supply roller (toner supply member)
560 restriction blade
560*a* rubber section
560*b* rubber-supporting section
562 blade-supporting metal plate
570 blade-backing member
1000 computer system
1102 main computer unit
1104 display device
1106 printer
1108 input device
1108A keyboard
1108B mouse
1110 reading device
1110A flexible disk drive device
1110B CR-ROM drive device
1202 internal memory
1204 hard disk drive unit
T toner
RS read sensor for synchronization
2010 printer
2010*a* main printer unit
2010*b* first opening cover
2010*c* second opening cover
2010*d* photoconductor unit attach/detach opening
2010*e* developing unit attach/detach opening
2020 photoconductor
2030 charging unit
2040 exposing unit
2050 YMCK developing device

2051 cyan developing unit
2052 magenta developing unit
2053 black developing unit
2054 yellow developing unit
2051*a*, 2052*a*, 2053*a*, 2054*a* elements
2054*b* noncontact IC chip
2054*c* capacitor for resonation
2054*d* antenna
2054*e* rectifier
2054*f* signal analysis section RF
2054*g* controller
2054*h* memory cell
2055 rotary
2055*a* central shaft
2055*b*, 2055*c*, 2055*d*, 2055*e* attach/detach sections
2060 first transferring unit
2070 intermediate transferring member
2075 photoconductor unit
2075*a* element
2076 cleaning blade
2076*a* waste toner containing section
2080 second transferring unit
2090 fusing unit
2092 paper supply tray
2094 paper supply roller
2095 display unit
2096 resisting roller
2100 control unit
2101 main controller
2102 unit controller
2112 interface
2113 image memory
2120 CPU
2121 serial interface
2122 main-unit-side memory (memory element)
2123 send/receive circuit
2124*a* main-unit-side antenna (for communicating with photoconductor-unit element)
2124*b* main-unit-side antenna (for communicating with developing-unit elements)
2125 YMCK developing device drive control circuit
2126*a* AC voltage supply section
2126*b* DC voltage supply section
2127 exposing unit drive control circuit
2127*a* pixel counter
2510 developing roller (developer bearing roller)
2520 seal member
2524 seal urging member
2522 seal-supporting metal plate
2530 first toner containing section
2535 second toner containing section
2540 housing
2541 opening
2545 restriction wall
2550 toner supply roller (toner supply member)
2560 restriction blade
2560*a* rubber section
2560*b* rubber-supporting section
2562 blade-supporting metal plate
2570 blade-backing member
3000 computer system
3102 main computer unit
3104 display device
3106 printer
3108 input device
3108A keyboard
3108B mouse
3110 reading device
3110A flexible disk drive device
3110B CR-ROM drive device
3202 internal memory
3204 hard disk drive unit

BEST MODE FOR CARRYING OUT THE INVENTION

At least the following matters will be made clear by the present specification and the description of the accompanying drawings.

An image forming apparatus comprises: a developing unit attach/detach section to and from which a developing unit having a developing-unit element that is capable of performing communication can be attached and detached; a photoconductor unit attach/detach section to and from which a photoconductor unit having a photoconductor-unit element that is capable of performing communication can be attached and detached; and an antenna that is capable of wirelessly communicating both with the developing-unit element of the developing unit attached to the developing unit attach/detach section and with the photoconductor-unit element of the photoconductor unit attached to the photoconductor unit attach/detach section.

With the foregoing image forming apparatus, an antenna is provided that is capable of wirelessly communicating both with the developing-unit element of a developing unit mounted to the developing unit attach/detach section and the photoconductor-unit element of a photoconductor unit mounted to the photoconductor unit attach/detach section, and thus it is possible to achieve an image forming apparatus having an efficient communication system.

Further, the antenna may be provided at a position located between the developing-unit element of the developing unit attached to the developing unit attach/detach section and the photoconductor-unit element of the photoconductor unit attached to the photoconductor unit attach/detach section.

This makes it possible to achieve an arrangement of the antenna and the elements that allows communication performance to be increased.

Further, the photoconductor-unit element may be provided with a photoconductor-unit antenna, and, when the photoconductor unit is attached to the photoconductor unit attach/detach section, the antenna may be in opposition to the photoconductor-unit antenna of the photoconductor-unit element of the photoconductor unit.

This makes it possible to further improve communication performance between the photoconductor-unit element and the antenna.

Further, when the photoconductor unit is attached to the photoconductor unit attach/detach section, a longitudinal direction of the antenna may be in a longitudinal direction of the photoconductor-unit antenna of the photoconductor-unit element of the photoconductor unit.

This makes it possible to further improve communication performance between the photoconductor-unit element and the antenna.

Further, a length of the antenna in the longitudinal direction of the photoconductor-unit antenna of the photoconductor-unit element of the photoconductor unit when the photoconductor unit is attached to the photoconductor unit attach/detach section may be longer than a length in the longitudinal direction of the photoconductor-unit antenna.

This makes it possible to keep a constant communication quality even in a situation where the element has deviated from its intended position, for example.

Further, the image forming apparatus may further comprise a moving member having a plurality of the developing unit attach/detach sections, the developing-unit element may be provided with a developing-unit antenna, and, when the developing unit is attached to the developing unit attach/detach section and the moving member has moved to a predetermined position, the antenna may be in opposition to the developing-unit antenna of the developing-unit element of the developing unit.

In this case, since the antenna is in opposition to the developing-unit antenna provided in the developing-unit element of the developing unit when the developing unit is mounted to the developing unit attach/detach section and the moving member has moved to a predetermined position, a further improvement in communication performance between the developing-unit element and the antenna can be achieved.

Further, the moving member may move rotatively.

In this case, since the antenna is in opposition to the developing-unit antenna provided in the developing-unit element of the developing unit when the developing unit is mounted to the developing unit attach/detach section and the moving member has rotatively moved to a predetermined position, a further improvement in communication performance between the developing-unit element and the antenna can be achieved.

Further, when the developing unit is attached to the developing unit attach/detach section and the moving member has moved to the predetermined position, a longitudinal direction of the antenna may be in a longitudinal direction of the developing-unit antenna of the developing-unit element of the developing unit.

This allows for a further improvement in communication performance between the developing-unit element and the antenna to be achieved.

Further, a length of the antenna in the longitudinal direction of the developing-unit antenna of the developing-unit element of the developing unit when the developing unit is attached to the developing unit attach/detach section and the moving member has moved to the predetermined position may be longer than a length in the longitudinal direction of the developing-unit antenna.

This makes it possible to keep a constant communication quality even in a situation where the element has deviated from its intended position, for example.

Further, the antenna may be capable of communicating with the photoconductor-unit element in a non-contacting state.

This makes it easier to achieve an image forming apparatus provided with an antenna that is capable of wirelessly communicating both with the developing-unit elements and the photoconductor-unit element, compared to a case where the antenna is capable of communicating with the photoconductor-unit element in a state of contact therewith, for example.

Further, the antenna may be capable of communicating with the developing-unit element in a non-contacting state.

This makes it easier to achieve an image forming apparatus provided with an antenna that is capable of wirelessly communicating both with the developing-unit elements and the photoconductor-unit element, compared to a case where the antenna is capable of communicating with the developing-unit element in a state of contact therewith, for example.

It is also possible to achieve an image forming apparatus comprising: a developing unit attach/detach section to and from which a developing unit having a developing-unit element that is capable of performing communication can be attached and detached; a photoconductor unit attach/detach section to and from which a photoconductor unit having a photoconductor-unit element that is capable of performing communication can be attached and detached; and an antenna that is capable of wirelessly communicating both with the developing-unit element of the developing unit attached to the developing unit attach/detach section and with the photoconductor-unit element of the photoconductor unit attached to the photoconductor unit attach/detach section; wherein the antenna is provided at a position located between the developing-unit element of the developing unit attached to the developing unit attach/detach section and the photoconductor-unit element of the photoconductor unit attached to the photoconductor unit attach/detach section, wherein the photoconductor-unit element is provided with a photoconductor-unit antenna, wherein, when the photoconductor unit is attached to the photoconductor unit attach/detach section, the antenna is in opposition to the photoconductor-unit antenna of the photoconductor-unit element of the photoconductor unit, wherein, when the photoconductor unit is attached to the photoconductor unit attach/detach section, a longitudinal direction of the antenna is in a longitudinal direction of the photoconductor-unit antenna of the photoconductor-unit element of the photoconductor unit, wherein a length of the antenna in the longitudinal direction of the photoconductor-unit antenna of the photoconductor-unit element of the photoconductor unit when the photoconductor unit is attached to the photoconductor unit attach/detach section is longer than a length in the longitudinal direction of the photoconductor-unit antenna, wherein the image forming apparatus further comprises a moving member having a plurality of the developing unit attach/detach sections, wherein the developing-unit element is provided with a developing-unit antenna, wherein, when the developing unit is attached to the developing unit attach/detach section and the moving member has moved to a predetermined position, the antenna is in opposition to the developing-unit antenna of the developing-unit element of the developing unit, wherein the moving member moves rotatively, wherein, when the developing unit is attached to the developing unit attach/detach section and the moving member has moved to the predetermined position, a longitudinal direction of the antenna is in a longitudinal direction of the developing-unit antenna of the developing-unit element of the developing unit, wherein a length of the antenna in the longitudinal direction of the developing-unit antenna of the developing-unit element of the developing unit when the developing unit is attached to the developing unit attach/detach section and the moving member has moved to the predetermined position is longer than a length in the longitudinal direction of the developing-unit antenna, wherein the antenna is capable of communicating with the photoconductor-unit element in a non-contacting state, and wherein the antenna is capable of communicating with the developing-unit element in a non-contacting state.

It is also possible to achieve a computer system comprising: a main computer unit; and an image forming apparatus that is connectable to the main computer unit and that includes: a developing unit attach/detach section to and from which a developing unit having a developing-unit element that is capable of performing communication can be attached and detached; a photoconductor unit attach/detach section to and from which a photoconductor unit having a photoconductor-unit element that is capable of performing communication can be attached and detached; and an antenna that is capable of wirelessly communicating both with the developing-unit element of the developing unit attached to the developing unit attach/detach section and with the photoconductor-unit element of the photoconductor unit attached to the photoconductor unit attach/detach section.

An image forming apparatus comprises: a rotating member provided with a plurality of attach/detach sections, to and from each of which a developing unit having an element that is capable of performing communication can be attached and detached; and an antenna for wirelessly communicating, at a plurality of rotation angles of the rotating member, with the elements of the developing units attached respectively to the attach/detach sections; wherein, when R is an outermost diameter of a path traced by the developing units and r is an outermost diameter of a path traced by the elements when the rotating member is rotated with the developing units attached to the attach/detach sections, then a relationship R>r is satisfied.

According to the foregoing image forming apparatus, when R is an outermost diameter of a path traced by the developing units and r is an outermost diameter of a path traced by the elements when the rotating member is rotated with the developing units mounted to the attach/detach sections, then a relationship R>r is satisfied, and thus the antenna for wirelessly communicating with the elements of the developing units can be reduced in size.

Further, when L is a distance from a center of the rotating member to a position of the outermost side of the antenna in a radial direction of rotation of the rotating member, then a relationship R>L may be satisfied.

This allows a small antenna to be employed for wirelessly communicating with the elements.

Further, when R is an outermost diameter of a path traced by the developing units and r is an outermost diameter of a path traced by the elements when the rotating member is rotated with the developing units attached to the attach/detach sections, then a relationship R/2>r may be satisfied.

This allows the antenna for wirelessly communicating with the elements of the developing units to be further reduced in size.

Further, when L is a distance from a center of the rotating member to a position of the outermost side of the antenna in a radial direction of rotation of the rotating member, then a relationship R/2>L may be satisfied.

This allows an even smaller antenna to be employed for wirelessly communicating with the elements.

Further, each of the elements maybe provided on a lateral surface of the developing unit, the lateral surface intersecting with an axial direction of rotation of the rotating member when the developing unit is attached to the attach/detach section.

This allows the elements to be provided at a position on the developing units where they can be easily attached.

Further, the lateral surface may be a lateral surface that is on a leading side when a developing unit is being attached.

This allows the possibility of damage to that element due to, for example, the user touching the element when replacing developing unit to be reduced.

Further, when the developing unit is attached to the attach/detach section, the antenna may be positioned more outward than the element in the axial direction of rotation of the rotating member.

This allows the antenna to be provided at a position where it can be easily attached to the image forming apparatus.

Further, the elements of some or all of the developing units attached to the attach/detach sections may be in opposition to the antenna at a predetermined rotation angle of the rotating member.

This allows an improvement in communication performance between the elements and the antenna to be achieved.

Further, when a plurality of the developing units are attached to the attach/detach sections, all of the elements of the plurality of developing units may simultaneously oppose the antenna at a predetermined rotation angle of the rotating member.

This allows communication performance to be improved when a plurality of elements are simultaneously communicating with the antenna at a predetermined rotation angle of the rotating member, for example.

Further, the elements of some or all of the developing units attached to the attach/detach sections may be in opposition to the antenna at all rotation angles of the rotating member.

This allows communication performance between the elements and the antenna to be improved at all rotation angles of the rotating member, for example.

Further, when a plurality of the developing units are attached to the attach/detach sections, all of the elements of the plurality of developing units may simultaneously be capable of communicating with the antenna at a predetermined rotation angle of the rotating member.

In this case, since a plurality of elements can simultaneously communicate with the antenna at a predetermined rotation angle of the rotating member, the restrictions regarding the timing at which communication is performed between the elements and the antenna can be reduced.

Further, the elements of some or all of the developing units attached to the attach/detach sections may be capable of performing communication with the antenna at all rotation angles of the rotating member.

This allows the restrictions regarding the timing at which communication is carried out between the elements and the antenna to be reduced.

Further, the elements of the developing units that are rotating may be capable of communicating with the antenna.

This allows the timing during which the developing units are rotating to be utilized so that communication is carried out efficiently.

Further, the elements may be capable of communicating with the antenna in a non-contacting state.

This allows the antenna for wirelessly communicating with the elements of the developing units in a non-contacting state to be made smaller is size.

Further, the image forming apparatus may further comprise an alternating current voltage supply section for supplying an alternating current voltage, and, during a period from start to finish of an image formation process, the antenna may be used to write information to the element of the developing unit attached to the attach/detach section when the alternating current voltage supply section is not supplying an alternating current voltage.

In this case, since the antenna is used to write information to the elements of developing units mounted to the attach/detach sections when the alternating current voltage supply section is not supplying an alternating current voltage during a period from start to finish of an image formation process, information can be written accurately without being affected by, for example, noise caused by the supply of AC voltage to the charging member.

Further, the image forming apparatus may further comprise an attach/detach opening through which the developing unit can be attached to and detached from the attach/detach section, and a photoconductor on which a latent image can be formed, the latent image may be developed by developer contained in the developing unit when that developing unit has been positioned at an opposition position that is in opposition to the photoconductor due to rotation of the rotating member, detachment of the developing unit from the attach/detach section via the attach/detach opening may be made possible when that developing unit has been positioned at a detach position that is different from the opposition position due to rotation of the rotating member, and the antenna may be used to write information to the element of the developing unit during a period from when that developing unit arrives at the opposition position until when that developing unit arrives at the detach position due to rotation of the rotating member.

When an attach/detach opening through which the developing unit can be attached to and detached from an attach/detach section is provided, there is a possibility that a developing unit mounted to an attach/detach section will be carelessly detached via the attach/detach opening. In particular, the amount of developer in a developing unit decreases when developing is carried out with that developing unit positioned at the opposition position, and thus when that developing unit is detached before information on the amount of developer that has decreased is written to its element, there is a possibility that the amount of developer contained in that developing unit, for example, cannot be ascertained.

The foregoing configuration allows this problem to be circumvented.

It is also possible to achieve an image forming apparatus comprising: a rotating member provided with a plurality of attach/detach sections, to and from each of which a developing unit having an element that is capable of performing communication can be attached and detached; and an antenna for wirelessly communicating, at a plurality of rotation angles of the rotating member, with the elements of the developing units attached respectively to the attach/detach sections; wherein, when R is an outermost diameter of a path traced by the developing units and r is an outermost diameter of a path traced by the elements when the rotating member is rotated with the developing units attached to the attach/detach sections, then a relationship R/2>r is satisfied, wherein, when L is a distance from a center of the rotating member to a position of the outermost side of the antenna in a radial direction of rotation of the rotating member, then a relationship R/2>L is satisfied, wherein each of the elements is provided on a lateral surface of the developing unit, the lateral surface intersecting with an axial direction of rotation of the rotating member when the developing unit is attached to the attach/detach section, wherein the lateral surface is a lateral surface that is on a leading side when a developing unit is being attached, wherein, when the developing unit is attached to the attach/detach section, the antenna is positioned more outward than the element in the axial direction of rotation of the rotating member, wherein the elements of some or all of the developing units attached to the attach/detach sections are in opposition to the antenna at all rotation angles of the rotating member, wherein the elements of some or all of the developing units attached to the attach/detach sections are capable of performing communication with the antenna at all rotation angles of the rotating member, wherein the elements of the developing units that are rotating are capable of communicating with the antenna, wherein the elements are capable of communicating with the antenna in a non-contacting state, wherein the image forming apparatus further comprises an alternating current voltage supply section for supplying an alternating current voltage, wherein, during a period from start to finish of an image formation process, the antenna is used to write information to the element of the developing unit attached to the attach/detach section when the alternating current voltage supply section is not supplying an alternating current voltage, wherein the image forming apparatus further comprises an attach/detach opening through which the developing unit can be attached to and detached from the attach/detach section, and a photoconductor on which a latent image can be formed, wherein the latent image can be developed by developer contained in the developing unit when that developing unit has been positioned at an opposition position that is in opposition to the photoconductor due to rotation of the rotating member, wherein detachment of the developing unit from the attach/detach section via the attach/detach opening is possible when that developing unit has been positioned at a detach position that is different from the opposition position due to rotation of the rotating member, and wherein the antenna is used to write information to the element of the developing unit during a period from when that developing unit arrives at the opposition position until when that developing unit arrives at the detach position due to rotation of the rotating member.

Next, a developing unit comprises: an element that is capable of performing communication, wherein the developing unit is attachable to and detachable from one of a plurality of attach/detach sections of a main image forming apparatus unit, the main image forming apparatus unit including: a rotating member provided with the plurality of attach/detach sections, to and from each of which the developing unit can be attached and detached; and an antenna for wirelessly communicating, at a plurality of rotation angles of the rotating member, with the element of the developing unit attached to the attach/detach section, and wherein, when R is an outermost diameter of a path traced by the developing unit and r is an outermost diameter of a path traced by the element when the rotating member is rotated with the developing unit attached to the attach/detach section, then a relationship R>r is satisfied.

According to the foregoing developing unit, when R is an outermost diameter of a path traced by the developing unit and r is an outermost diameter of a path traced by the element when the rotating member is rotated with the developing unit mounted to an attach/detach section, then a relationship R>r is satisfied, and thus the antenna for wirelessly communicating with the element of the developing unit can be reduced in size.

Further, when L is a distance from a center of the rotating member to a position of the outermost side of the antenna in a radial direction of rotation of the rotating member, then a relationship R>L may be satisfied.

This allows a small antenna to be employed for wirelessly communicating with the element.

Further, when R is an outermost diameter of a path traced by the developing unit and r is an outermost diameter of a path traced by the element when the rotating member is rotated with the developing unit attached to the attach/detach section, then a relationship R/2>r may be satisfied.

This allows the antenna for wirelessly communicating with the element of the developing unit to be further reduced in size.

Further, when L is a distance from a center of the rotating member to a position of the outermost side of the antenna in a radial direction of rotation of the rotating member, then a relationship R/2>L may be satisfied.

This allows an even smaller antenna to be employed for wirelessly communicating with the elements.

It is also possible to achieve a computer system comprising: a main computer unit, a display device that can be connected to the main computer unit, and an image forming apparatus that is connectable to the main computer unit and that includes: a rotating member provided with a plurality of attach/detach sections, to and from each of which a developing unit having an element that is capable of performing communication can be attached and detached; and an antenna for wirelessly communicating, at a plurality of rotation angles of the rotating member, with the elements of the developing units attached respectively to the attach/detach sections; wherein, when R is an outermost diameter of a path traced by the developing units and r is an outermost diameter of a path traced by the elements when the rotating member is rotated with the developing units attached to the attach/detach sections, then a relationship R>r is satisfied.

First Embodiment

===Overview of Image Forming Apparatus (Laser Beam Printer)===

Figure 2:
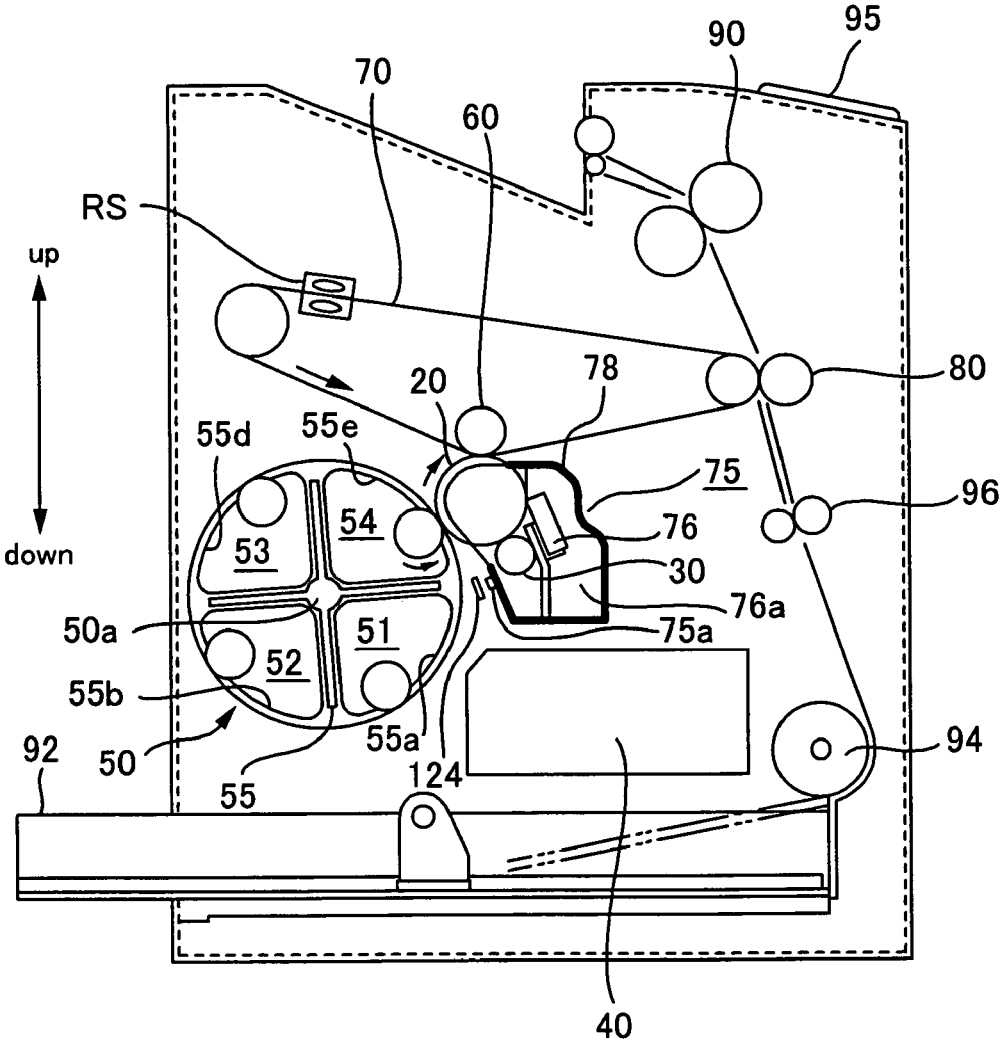
FIG. 2 is a diagram showing the main structural components constituting the printer 10.

Next, using FIG. 1 and FIG. 2, an overview of a laser beam printer (hereinafter, also referred to as "printer") 10 serving as an example of an image forming apparatus is described. FIG. 1 is a diagram for describing how a developing unit 54 (51, 52, 53) and a photoconductor unit 75 are attached to and detached from a main printer unit 10*a*. FIG. 2 is a diagram showing the main structural components making up the printer 10. It should be noted that FIG. 2 is a diagram of a cross section taken perpendicular to the X direction in FIG. 1. Also, the vertical direction is shown by an arrow in FIG. 1 and FIG. 2, and for example, a paper supply tray 92 is arranged at a lower section of the printer 10 and a fusing unit 90 is arranged at an upper section of the printer 10.

<Attach/Detach Configuration>

The developing unit 54 (51, 52, 53) and the photoconductor unit 75 can be attached to and detached from the main printer unit 10*a*. The printer 10 is constituted by mounting the developing unit 54 (51, 52, 53) and the photoconductor unit 75 to the main printer unit 10*a*.

The main printer unit 10*a* has a first opening cover 10*b* that can be opened and closed, a second opening cover 10*c* that can be opened and closed and that is provided more inward than the first opening cover 10*b*, a photoconductor unit attach/detach opening 10*d* through which the photoconductor unit 75 is attached and detached, and a developing unit attach/detach opening 10*e* through which the developing unit 54 (51, 52, 53) is attached and detached.

Here, by the user opening the first opening cover 10*b*, the photoconductor unit 75 can be attached to and detached from a photoconductor unit attach/detach section of the main printer unit 10*a* via the photoconductor unit attach/detach opening 10*d*. Further, by the user opening the second opening cover 10*c*, the developing unit 54 (51, 52, 53) can be attached to and detached from a developing unit attach/detach section of the main printer unit 10*a* via the developing unit attach/detach opening 10*e*.

<Overview of the Printer 10>

An overview of the printer 10 in which the developing unit 54 (51, 52, 53) and the photoconductor unit 75 have been mounted to the main printer unit 10*a* is described.

As shown in FIG. 2, the printer 10 of this embodiment has a charging unit 30, an exposing unit 40, a YMCK developing device 50, a first transferring unit 60, an intermediate transferring member 70, and a cleaning blade 76, all of which being arranged in the direction of rotation of a photoconductor 20, which is a latent image bearing member for bearing a latent image. It further includes a second transferring unit 80, the fusing unit 90, a display unit 95 such as a liquid crystal panel for constituting means for notifying the user, and a control unit 100 (FIG. 3) for controlling these units, for example, so as to control the operation of the printer 10.

The photoconductor 20 has a cylindrical conductive base and a photoconductive layer formed on the outer peripheral surface of the base, and can rotate about a central axis, and in this embodiment, it rotates in the clockwise direction as shown by the arrow in FIG. 2.

The charging unit 30 is a device for charging the photoconductor 20, and the exposing unit 40 is a device for forming a latent image on the charged photoconductor 20 by irradiating a laser. The exposing unit 40 has a semiconductor laser, a polygon mirror, and a F-θ lens, for example, and irradiates a modulated laser onto the charged photoconductor 20 based on an image signal input from a host computer that is not shown, such as a personal computer or a word processor.

The YMCK developing device 50 has a rotary 55 that serves as a moving member, and four developing units mounted to the rotary 55. The rotary 55 is capable of rotating, and is provided with four attach/detach sections 55*b*, 55*c*, 55*d*, and 55*e* as developing unit attach/detach sections to and from which the four developing units 51, 52, 53, and 54, respectively, can be attached and detached via the developing unit attach/detach opening 10*e*. The cyan developing unit 51, which contains cyan (C) toner, can be attached to and detached from the attach/detach section 55*b*, the magenta developing unit 52, which contains magenta (M) toner, can be attached to and detached from the attach/detach section 55*c*, the black developing unit 53, which contains black (K) toner, can be attached to and detached from the attach/detach section 55*d*, and the yellow developing unit 54, which contains yellow (Y) toner, can be attached to and detached from the attach/detach section 55*e*.

The rotary 55, by rotating, moves the four developing units 51, 52, 53, and 54 mentioned above that are mounted to the attach/detach sections 55*b*, 55*c*, 55*d*, and 55*e*, respectively. That is, the rotary 55 rotates the four mounted developing units 51, 52, 53, and 54 about a central shaft 55*a* while maintaining their positions relative to one another. Then, the developing units 51, 52, 53, and 54 are selectively brought into opposition with the latent image formed on the photoconductor 20 and the latent image on the photoconductor 20 is developed using the toner contained in the developing units 51, 52, 53, and 54. It should be noted that the developing units are described in detail later.

The first transferring unit 60 is a device for transferring a single color toner image formed on the photoconductor 20 to the intermediate transferring member 70. When the four toner colors are successively transferred superimposed over one another, a full color toner image is formed on the intermediate transferring member 70.

The intermediate transferring member 70 is an endless belt that is rotatively driven at substantially the same circumferential velocity as the photoconductor 20. A read sensor for synchronization RS is provided near the intermediate transferring member 70. The read sensor for synchronization RS is a sensor for detecting the reference position of the intermediate transferring member 70, and obtains a synchronization signal Vsync in the sub-scanning direction, which is perpendicular to the main-scanning direction. The read sensor for synchronization RS has a light-emitting section for emitting light and a light-receiving section for receiving light. Light that is emitted from the light-emitting section passes through a hole formed at a predetermined position in the intermediate transferring member 70, and when light is received by the light-receiving section, the read sensor for synchronization RS generates a pulse signal. One pulse signal is generated per each revolution of the intermediate transferring member 70.

The second transferring unit 80 is a device for transferring a single color toner image or a full color toner image formed on the intermediate transferring member 70 to a recording medium such as paper, film, or cloth.

The fusing unit 90 is a device for fusing the single color toner image or the full color toner image, which has been transferred to the recording medium, onto the recording medium such as paper, making it a permanent image.

The cleaning blade 76 is made of rubber and abuts against the surface of the photoconductor 20. The cleaning blade 76 scrapes of f and removes toner remaining on the photoconductor 20 after the toner image has been transferred to the intermediate transferring member 70 by the first transferring unit 60.

The photoconductor unit 75 is provided between the first transferring unit 60 and the exposing unit 40, and includes the photoconductor 20, an element 75*a* serving as the photoconductor-unit element to which information can be written, the charging unit 30, the cleaning blade 76, and a waste toner containing section 76*a* for containing toner that has been scraped off by the cleaning blade 76. It should be noted that the element 75*a* has a configuration that allows various types of written information to be recorded.

Figure 3:
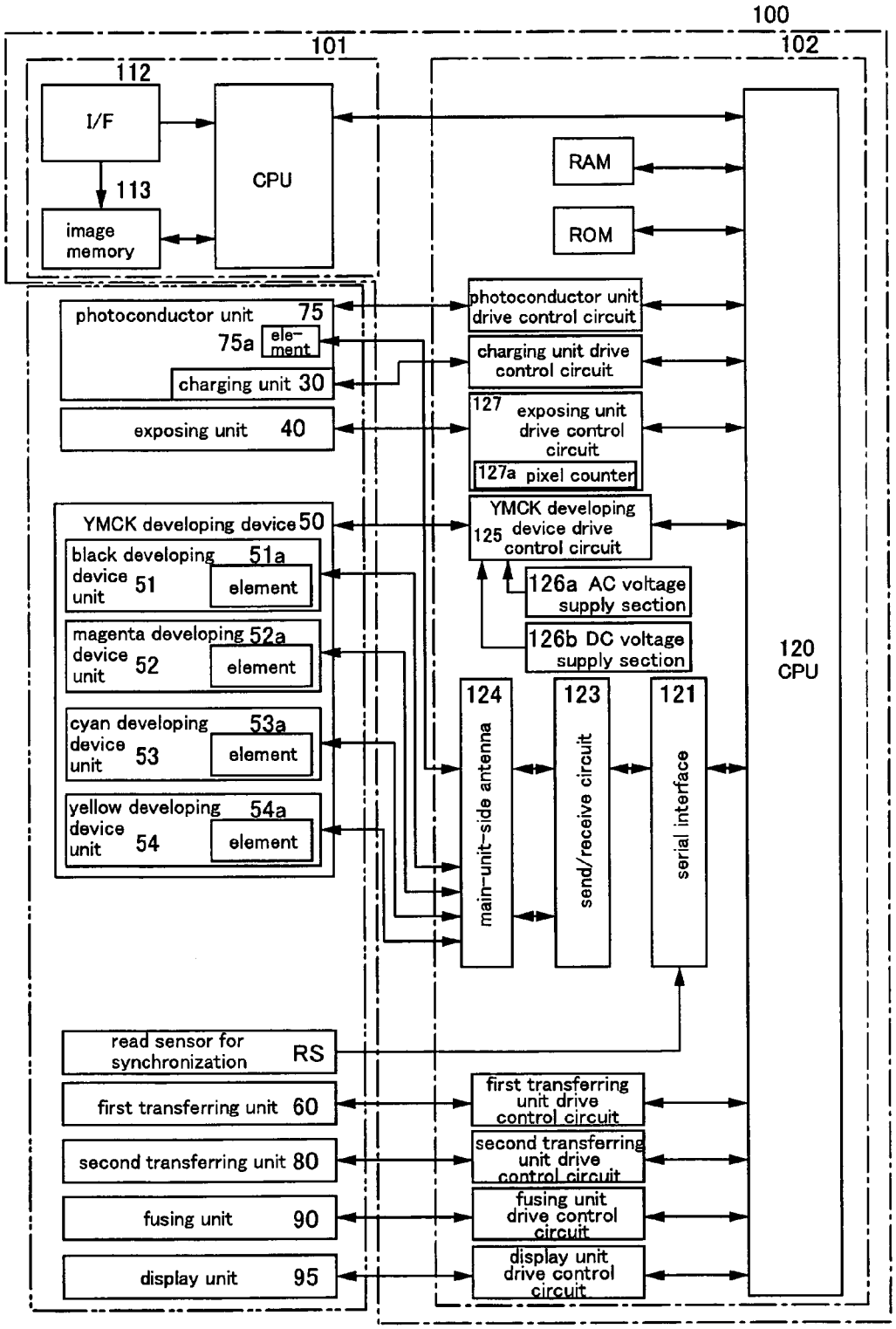
FIG. 3 is a block diagram showing the control unit 100 provided in the printer 10.

The control unit 100 is made of a main controller 101 and a unit controller 102, as shown in FIG. 3. An image signal is input to the main controller 101, and in accordance with a command based on this image signal, the unit controller 102 controls the various units, for example, to form an image.

===Operation of the Printer 10===

The operation of the printer 10 configured as above is described below, referring to other structural components thereof as well.

First, an image signal from a host computer that is not shown is input to the main controller 101 of the printer 10 via an interface (I/F) 112, and then the photoconductor 20 and the intermediate transferring member 70 are rotated due to control by the unit controller 102 based on a command from the main controller 101. Then, the reference position of the intermediate transferring member 70 is detected by the read sensor for synchronization RS, and a pulse signal is output. This pulse signal is sent to the unit controller 102 via a serial interface 121. The unit controller 102 controls the following operation, using the received pulse signal as a reference.

The photoconductor 20 is successively charged by the charging unit 30 at a charging position while rotating. The region of the photoconductor 20 that is charged is brought to an exposure position through rotation of the photoconductor 20, and a latent image corresponding to image information of the first color, for example, yellow Y, is formed in that region by the exposing unit 40.

The latent image formed on the photoconductor 20 is brought to a developing position due to rotation of the photoconductor 20, and is developed with yellow toner by the yellow developing unit 54. A yellow toner image is thus formed on the photoconductor 20.

The yellow toner image that is formed on the photoconductor 20 is brought to the first transferring position due to rotation of the photoconductor 20 and is transferred to the intermediate transferring member 70 by the first transferring unit 60. At this time, a first transferring voltage of a polarity that is opposite to the toner charge polarity is applied to the first transferring unit 60. It should be noted that throughout this operation the second transferring unit 80 is kept separated from the intermediate transferring member 70.

The above process is repeated for the second color, the third color, and the fourth color, thereby transferring different color toner images, which correspond to respective image signals, superimposed over one another onto the intermediate transferring member 70. Thus, a full color toner image is formed on the intermediate transferring member 70.

The full color toner image that is formed on the intermediate transferring member 70 is brought to the second transferring position due to rotation of the intermediate transferring member 70 and is transferred to a recording medium by the second transferring unit 80. It should be noted that the recording medium is carried from the paper supply tray 92 to the second transferring unit 80 via a paper supply roller 94 and a resisting roller 96. Also, when performing the transferring operation, the second transferring unit 80 is pressed against the intermediate transferring member 70 and at the same time a second transferring voltage is applied thereto.

The fusing unit 90 heats and applies pressure to the full color toner image that is transferred to the recording medium, fusing it to the recording medium.

On the other hand, after the photoconductor 20 passes the first transferring position, the toner adhering to its surface is scraped off by the cleaning blade 76 and photoconductor 20 is prepared for charging for forming the next latent image. The toner that is scraped off is collected into the waste toner containing section 76*a*.

===Overview of the Control Unit===

The configuration of the control unit 100 is described next with reference to FIG. 3. FIG. 3 is a block diagram showing the control unit 100 provided in the printer 10.

The main controller 101 of the control unit 100 is connected to a host computer via the interface 112, and is provided with an image memory 113 for storing image signals that are received from the host computer.

The unit controller 102 of the control unit 100 is electrically connected to the various units (the charging unit 30, the exposing unit 40, the first transferring unit 60, the photoconductor unit 75, the second transferring unit 80, the fusing unit 90, and the display unit 95) and the YMCK developing device 50, and by receiving signals from the sensors provided in these components, it controls these units and the YMCK developing device 50 based on signals input from the main controller 101 while detecting the state of these units and the YMCK developing device 50. As the structural components for driving these units and the YMCK developing device 50, FIG. 3 shows a photoconductor unit drive control circuit, a charging unit drive control circuit, an exposing unit drive control circuit 127, a YMCK developing device drive control circuit 125, a first transferring unit drive control circuit, a second transferring unit drive control circuit, a fusing unit drive control circuit, and a display unit drive control circuit.

The exposing unit drive control circuit 127 connected to the exposing unit 40 has a pixel counter 127*a* that serves as consumption amount detection means for detecting the amount of developer that is consumed. The pixel counter 127*a* counts the number of pixels that are input to the exposing unit 40. It should be noted that it is also possible to provide the pixel counter 127*a* in the exposing unit 40 or in the main controller 101. It should be noted that the number of pixels is the number of pixels in terms of the basic resolution of the printer 10, that is, the number of pixels of the image that is actually printed. The amount of toner T that is consumed (the amount that is used) is proportional to the number of pixels, and thus by counting the number of pixels it is possible to detect the amount of toner T that is consumed.

To the YMCK developing device drive control circuit 125, an AC voltage is supplied from an AC voltage supply section 126*a* and a DC voltage is supplied from a DC voltage supply section 126*b*. The YMCK developing device drive control circuit 125 superimposes the AC voltage and the DC voltage, and applies the superimposed voltage to the developing roller at a suitable timing, forming an alternating electric field between the developing roller and the photoconductor.

Also, the CPU 120 provided in the unit controller 102 is connected to a nonvolatile storage element (hereinafter, also referred to as "main-unit-side memory") 122 such as a serial EEPROM via the serial interface (I/F) 121.

Also, the CPU 120 is capable of wirelessly communicating with elements 51*a*, 52*a*, 53*a*, and 54*a* serving as developing-unit elements, which are respectively provided in/on the developing units 51, 52, 53, and 54, via the serial interface 121, a send/receive circuit 123, and a main-unit-side antenna 124 serving as an example of the antenna. The CPU 120 also is capable of wirelessly communicating with the element 75*a* of the photoconductor unit 75 via the serial interface 121, the send/receive circuit 123, and the main-unit-side antenna 124.

That is, the printer 10 is provided with a main-unit-side antenna 124 that is capable of wirelessly communicating both with the developing-unit elements of the developing units mounted to the developing unit attach/detach sections and the photoconductor-unit element 75*a* of the photoconductor unit 75 that is mounted to the photoconductor unit attach/detach section.

At the time of wireless communication, the main-unit-side antenna 124 writes information to the elements 51*a*, 52*a*, 53*a*, and 54*a* of the respective developing units 51, 52, 53, and 54. The main-unit-side antenna 124 is also capable of reading information from the elements 51*a*, 52*a*, 53*a*, and 54*a* of the respective developing units 51, 52, 53, and 54. At the time of wireless communication, the main-unit-side antenna 124 writes information to the element 75*a* of the photoconductor unit 75. The main-unit-side antenna 124 can also read information from the element 75*a* of the photoconductor unit 75.

As described above, the printer 10 is provided with a main-unit-side antenna 124 that is capable of wirelessly communicating both with the developing-unit elements of the developing units mounted to the developing unit attach/detach sections and the photoconductor-unit element 75*a* of the photoconductor unit 75 that is mounted to the photoconductor unit attach/detach section, and therefore it is possible to achieve an image forming apparatus that has an efficient communication system.

In other words, as discussed in the section on the problems to be solved by the present invention, it is inefficient to provide separate antennas for wirelessly communicating with the developing-unit elements of the developing units and for wirelessly communicating with the photoconductor-unit element 75*a* of the photoconductor unit. Accordingly, as discussed above, by providing a main-unit-side antenna 124 that is capable of wirelessly communicating both with the developing-unit elements of the developing units mounted to the developing unit attach/detach sections and the photoconductor-unit element 75*a* of the photoconductor unit 75 that is mounted to the photoconductor unit attach/detach section, this problem is solved.

===Overview of the Developing Units===

Figure 4:
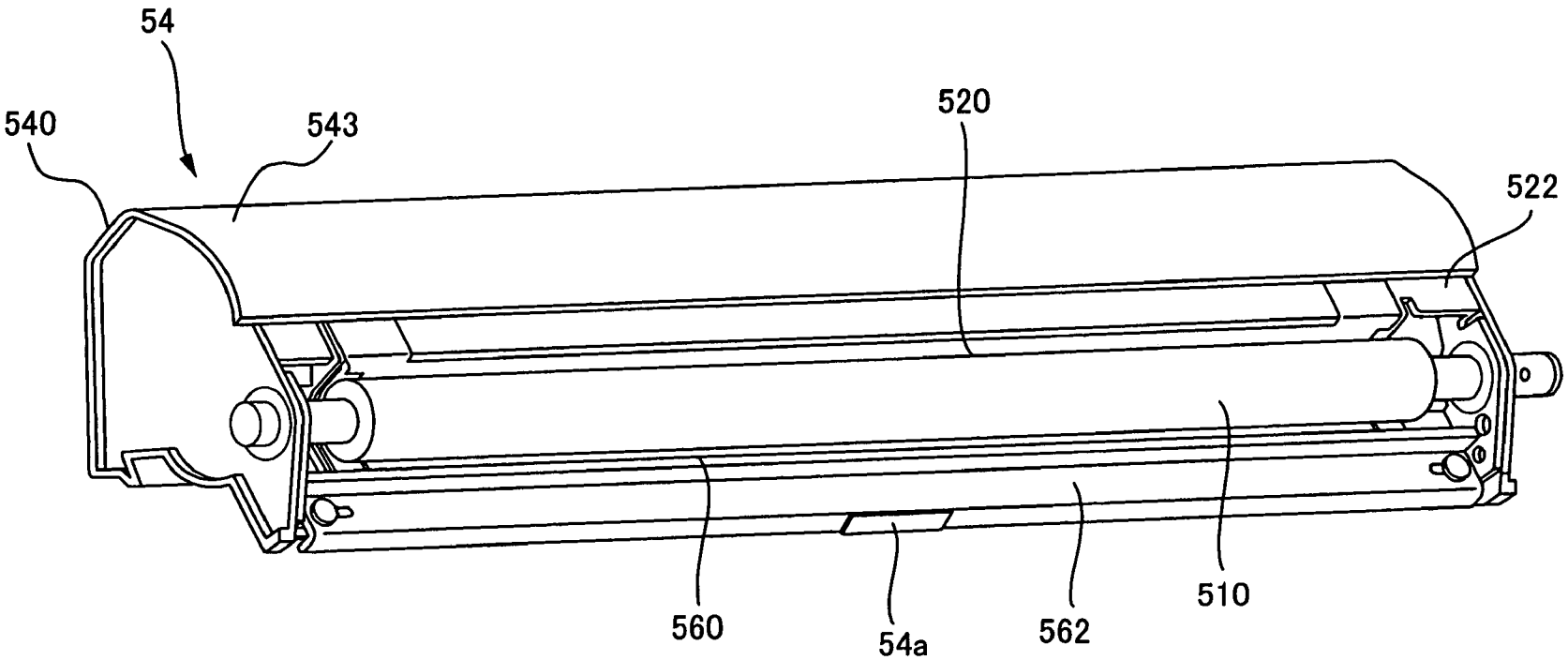
FIG. 4 is a perspective view of the yellow developing unit 54 seen from the perspective of the developing roller 510.
Figure 5:
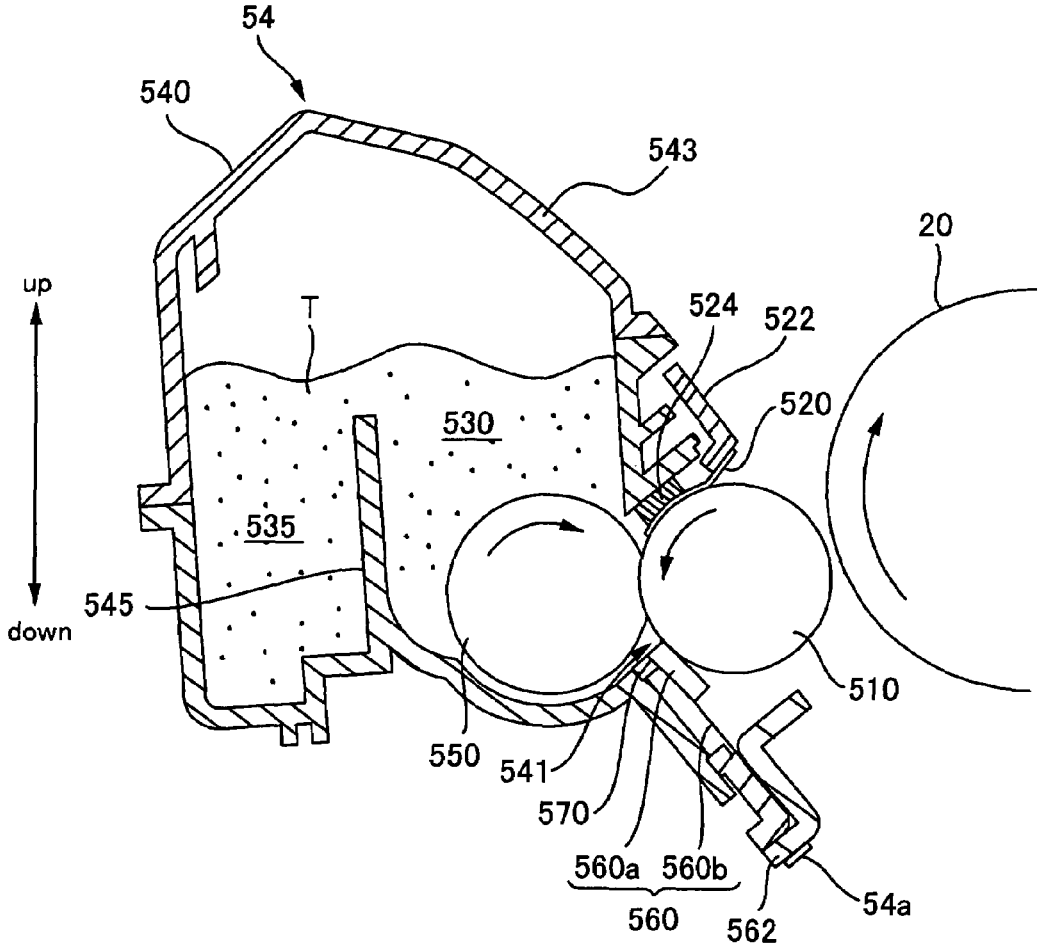
FIG. 5 is a cross-sectional view showing the main structural components of the yellow developing unit 54.

An overview of the developing units is provided next using FIG. 4 and FIG. 5. FIG. 4 is a perspective view of the yellow developing unit 54 seen from the developing roller 510 side. FIG. 5 is a cross-sectional view showing the main structural components of the yellow developing unit 54. It should be noted that in FIG. 5 as well, the vertical direction is shown by an arrow, and for example, the central axis of the developing roller 510 is lower than the central axis of the photoconductor 20. Also, in FIG. 5, the yellow developing unit 54 is shown positioned at a developing position that is in opposition to the photoconductor 20.

The YMCK developing device 50 is provided with the cyan developing unit 51, which contains cyan (C) toner, the magenta developing unit 52, which contains magenta (M) toner, the black developing unit 53, which contains black (K) toner, and the yellow developing unit 54, which contains yellow (Y) toner, and since the configuration of these developing units is the same, the yellow developing unit 54 is described below.

The yellow developing unit 54 is provided with a developer containing section for containing yellow toner T, which serves as the developer, that is, a first containing section 530 and a second containing section 535, the element 54*a*, a housing 540, the developing roller 510, which serves as the developer bearing member, a toner supply roller 550 for supplying toner T to the developing roller 510, and a restriction blade 560 for regulating the thickness of the layer of toner T that is borne by the developing roller 510, for example.

The housing 540 is manufactured by joining an upper housing and a lower housing to form a single unit, and the inside of the housing is divided into the first containing section 530 and the second containing section 535 by a restriction wall 545 that extends upward from the lower section (the vertical direction of FIG. 5). The first containing section 530 and the second containing section 535 form a developer containing section (530, 535) for containing toner T as a developer. The upper sections of the first containing section 530 and the second containing section 535 are in communication, and the movement of the toner T is regulated by the restriction wall 545. It should be noted that it is also possible to provide a stirring member for stirring the toner T contained in the first containing section 530 and the second containing section 535, but in the present embodiment, the developing units (the cyan developing unit 51, the magenta developing unit 52, the black developing unit 53, and the yellow developing unit 54) rotate in conjunction with rotation of the rotary 55, so that the toner T in the developing units is stirred, and thus a stirring member is not provided in the first containing section 530 or the second containing section 535.

An opening 541 that is in communication with the outside of the housing 540 is provided in the lower section of the first containing section 530. The toner supply roller 550 is provided in the first containing section 530 with its circumferential surface facing the opening 541, and is rotatably supported on the housing 540. Also, the developing roller 510 is provided with its circumferential surface facing the opening 541 from outside the housing 540, and the developing roller 510 abuts against the toner supply roller 550.

The developing roller 510 bears toner T and carries the toner to a developing position in opposition to the photoconductor 20. The developing roller 510 is made of aluminum, stainless steel or iron, for example, and if necessary, it can be subjected to nickel plating or chrome plating, and the toner bearing region can be subjected to sandblasting or the like. The developing roller 510 is provided in such a manner that its longitudinal direction is in the longitudinal direction of the yellow developing unit 54. Also, the developing roller 510 can rotate about a central axis, and as shown in FIG. 5, it rotates in the direction (in FIG. 5, the counterclockwise direction) opposite from the direction in which the photoconductor 20 rotates (in FIG. 5, the clockwise direction). Its central axis is lower than the central axis of the photoconductor 20., Also, as shown in FIG. 5, in a state where the yellow developing unit 54 is in opposition to the photoconductor 20, a gap exists between the developing roller 510 and the photoconductor 20. That is, the yellow developing unit 54 develops the latent image formed on the photoconductor 20 without being in contact with the photoconductor 20. It should be noted that when developing the latent image formed on the photoconductor 20, an alternating electric field is formed between the developing roller 510 and the photoconductor 20.

The toner supply roller 550 supplies the toner T contained in the first containing section 530 and the second containing section 535 to the developing roller 510. The toner supply roller 550 is made of polyurethane foam, for example, and abuts against the developing roller 510 in a state of elastic deformation. The toner supply roller 550 is arranged at a lower section of the first containing section 530, and the toner T contained in the first containing section 530 and the second containing section is supplied to the developing roller 510 by the toner supply roller 550 at a lower section of the first containing section 530. The toner supply roller 550 can rotate about a central axis, and its central axis is lower than the central rotation axis of the developing roller 510. Also, the toner supply roller 550 rotates in a direction (in FIG. 5, the clockwise direction) that is opposite from the direction of rotation of the developing roller 510 (in FIG. 5, the counter-clockwise direction). It should be noted that the toner supply roller 550 has the function of supplying the toner T that is contained in the first containing section 530 and the second containing section 535 to the developing roller 510 as well as the function of stripping off, from the developing roller 510, toner T remaining on the developing roller 510 after developing.

The restriction blade 560 regulates the thickness of the toner T layer borne by the developing roller 510, and adds charge to the toner T borne by the developing roller 510. The restriction blade 560 has a rubber section 560*a* and a rubber-supporting section 560*b*. The rubber section 560*a* is made of silicone rubber or urethane rubber, for example, and the rubber-supporting section 560*b* is a thin plate of phosphor bronze or stainless steel, for example, and has spring properties. The rubber section 560*a* is supported by the rubber-supporting section 560*b*, and one end of the rubber-supporting section 560*b* is fixed to a blade-supporting metal plate 562. The blade-supporting metal plate 562 is fastened to a seal frame 526, which is described later, and is attached to the housing 540 together with the restriction blade 560, forming a portion of a seal unit 520, which is described later. In this state, the rubber section 560*a* is pressed against the developing roller 510 by the elastic force created by the bending of the rubber-supporting section 560*b*.

The element 54*a*, to which information can be written, is provided on the outer surface of the blade-supporting metal plate 562. It should be noted that the element 54*a* has a configuration that allows the storage of various types of written information.

Also, a blade-backing member 570 made of Moltoprene or the like is provided on the side of the restriction blade 560 that is opposite from the developing roller 510 side. The blade-backing member 570 prevents the toner T from entering in between the rubber-supporting section 560*b* and the housing 540, thereby stabilizing the elasticity obtained by the bending of the rubber-supporting section 560*b*, and, by applying force to the rubber section 560*a* toward the developing roller 510 from directly behind the rubber section 560*a*, the blade-backing member presses the rubber section 560*a* against the developing roller 510. Consequently, the blade-backing member 570 increases the contact uniformity and the sealing properties of the rubber section 560*a* with respect to the developing roller 510.

The end of the restriction blade 560 on the side opposite from the side supported by the blade-supporting metal plate 562, that is, its tip, is not in contact with the developing roller 510, and a portion thereof away from its tip by a predetermined distance is in contact with the developing roller 510 with some breadth. That is, the restriction blade 560 does not abut against the developing roller 510 at its edge but rather at its mid section. Also, the restriction blade 560 is arranged such that its tip is facing upstream in the direction in which the developing roller 510 rotates, making so-called counter-abutment with respect to the developing roller 510. It should be noted that the abutting position where the restriction blade 560 abuts against the developing roller 510 is lower than the central axis of the developing roller 510 and is lower than the central axis of the toner supply roller 550.

The seal member 520 prevents the toner T in the yellow developing unit 54 from leaking outside the unit, and also collects toner T on the developing roller 510, after the developing roller 510 has passed the developing position, into the developing unit without scraping it off. The seal member 520 is a seal made of polyethylene film or the like. The seal member 520 is supported by a seal-supporting metal plate 522, and is attached to the frame 540 via the seal-supporting metal plate 522. A seal urging member 524 made of Moltoprene or the like is provided on the side of the seal member 520 that is opposite from the developing roller 510 side, and due to the elasticity of the seal urging member 524, the seal member 520 is pressed against the developing roller 510. It should be noted that the abutting position where the seal member 520 abuts against the developing roller 510 is above the central axis of the developing roller 510.

In the yellow developing unit 54 configured in this manner, the toner supply roller 550 supplies the toner T that is contained in the first containing section 530 and the second containing section 535, which function as developer containing sections, to the developing roller 510. The toner T that is supplied to the developing roller 510 is carried to the abutting position of the restriction blade 560 in conjunction with rotation of the developing roller 510, and when it passes the abutting position, the thickness of the toner T layer is regulated and charge is applied. The toner T on the developing roller 510, whose layer thickness has been regulated, is brought to the developing position in opposition to the photoconductor 20 due to further rotation of the developing roller 510, and is supplied for developing the latent image formed on the photoconductor 20 in an alternating electric field at the developing position. The toner T on the developing roller 510 that has passed the developing position due to further rotation of the developing roller 510 passes the seal member 520 and is collected into the developing unit without being scraped off by the seal member 520.

===Configuration of the Elements===

Figure 6A:
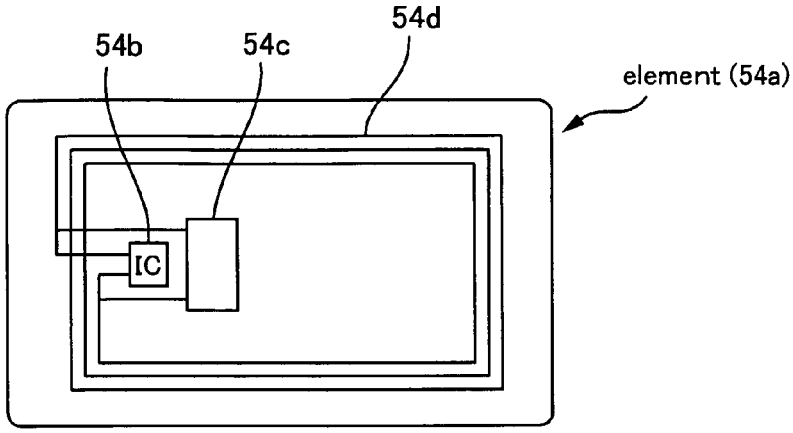
FIG. 6A is a plan transparent view showing the structure of an element.
Figure 6B:
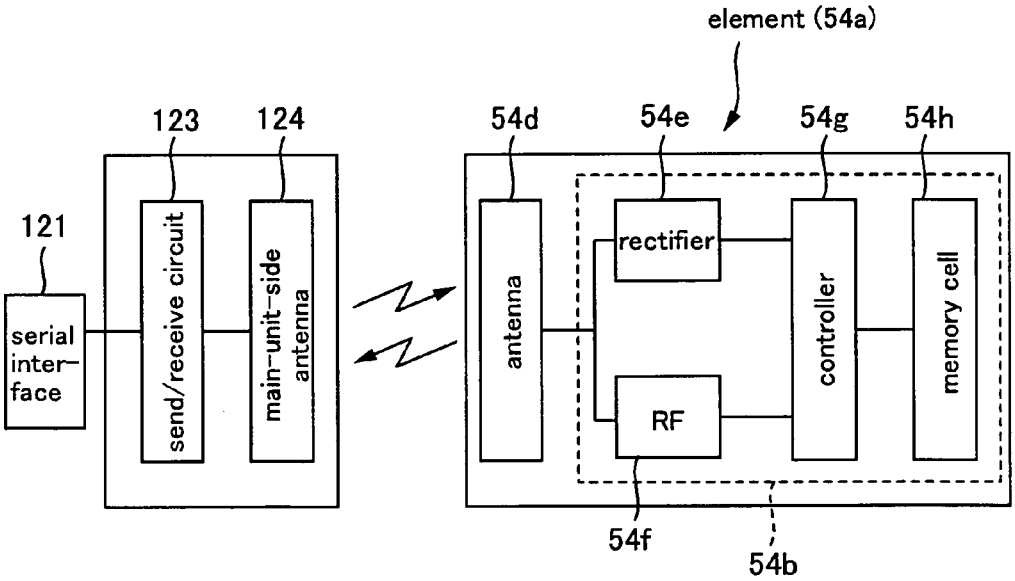
FIG. 6B is a block diagram for describing the internal configuration of an element and a send/receive section.

The configuration of the elements of the developing units and the element of the photoconductor unit, including the configuration for sending and receiving data, is described next with reference to FIG. 6A, FIG. 6B, FIG. 7, and FIG. 8. FIG. 6A is a transparent plan view showing the configuration of an element. FIG. 6B is a block diagram for describing the internal configuration of an element and the send/receive section. FIG. 7 is a diagram for describing the information stored in a memory cell 54*h* of the element 54*a*. FIG. 8 is a diagram for describing the information stored in the memory cell of the element 54*a* of the photoconductor unit 75.

Since the elements of the developing units other than the yellow developing unit 54 are also of the same configuration, the element 54*a* of the yellow developing unit 54 is taken as an example and described below.

If the element 54*a* and the main-unit-side antenna 124 are in a predetermined positional relationship, for example, if they are within a distance of 10 mm of one another, information can be sent and received between the two in a non-contacting state. The element 54*a* is overall very compact and thin, and one of its sides can be made adhesive and attached to an object as a label. It is called a memory tag, for example, and is sold commercially in various forms.

The element 54*a* has a non-contact IC chip 54*b*, a capacitor for resonation 54*c* that is formed by etching a metal film, and a flat coil serving as the element-side antenna 54*d*. These are mounted onto a plastic film and covered by a transparent coversheet.

The main printer unit 10*a* has the main-unit-side antenna 124, the send/receive circuit 123, and the serial interface 121, which is connected to the controller (CPU) 120 of the main printer unit 10*a*.

The non-contact IC chip 54*b* has a rectifier 54*e*, a signal analysis section RF (Radio Frequency) 54*f*, a controller 54*g*, and the memory cell 54*h*. The memory cell 54*h* is a nonvolatile memory that can be electrically read and written, such as an NAND flash ROM, and is capable of storing information that has been written and reading stored information from the outside.

The element-side antenna 54*d* of the element 54*a* and the main-unit-side antenna 124 wirelessly communicate with one another to read information stored on the memory cell 54*h* and write information to the memory cell 54*h*. Also, the high frequency signals that are generated by the send/receive circuit 123 of the main printer unit 10*a* are induced as a high frequency magnetic field via the main-unit-side antenna 124. This high frequency magnetic field is absorbed via the element-side antenna 54*d* of the element 54*a* and rectified by the rectifier 54*e*, thereby providing a direct current power source for driving the circuits in the IC chip 54*b*.

The memory cell 54*h* of the element 54*a* stores various types of information, as shown in FIG. 7. The address 00H stores unique ID information for each element, such as the serial number of the element, the address 01H stores the date that the developing unit was manufactured, the address 02H stores information for specifying the destination of the developing unit, the address 03H stores information for specifying the manufacturing line on which the developing unit was manufactured, the address 04H stores information for specifying models with which the developing unit is compatible, the address 05H stores toner remaining amount information as information indicating the amount of toner that is contained in the developing unit, and the address 06H and subsequent regions store appropriate information.

It should be noted that the element 75*a* of the photoconductor unit 75 has the same configuration. The memory cell of the element of the photoconductor unit 75 stores various types of information, as shown in FIG. 8.

The address 00H stores unique ID information for each element, such as the serial number of the element, the address 01H stores the date that the photoconductor unit was manufactured, the address 02H stores information for specifying the destination of the photoconductor unit, the address 03H stores information for specifying the manufacturing line on which the photoconductor unit was manufactured, the address 04H stores information for specifying models with which the photoconductor unit is compatible, the address 05H stores information indicating the total number of printed sheets of the main printer unit 10*a* when the photoconductor unit is mounted to the main printer unit 10*a*, the address 06H stores information indicating the total number of printed sheets of the main printer unit 10*a* when the photoconductor unit has reached its service life and is detached from the main printer unit 10*a*, the address 07H stores the number of sheets for which color printing has been performed using that photoconductor unit, the address 08H stores the number sheets for which monochrome printing has been performed using that photoconductor unit, the address 09H stores the number of sheets developed by the yellow developing unit 54, that is, the number of sheets printed using yellow toner, the address 0AH stores the number of sheets developed by the magenta developing unit 52, that is, the number of sheets printed using magenta toner, the address 0BH stores the number of sheets developed by the cyan developing unit 51, that is, the number of sheets printed using cyan toner, the address 0CH stores the number of sheets developed by the black developing unit 53, that is, the number of sheets printed using black toner, and the address 0DH and subsequent regions store appropriate information.

The ID information that is stored on the above memory cell 54*h* of the elements 51*a*, 52*a*, 53*a*, 54*a*, and 75*a* can be written at the time that the storage elements are manufactured in the factory. The main unit of the printer 10 can read this ID information to identify the individual elements 51*a*, 52*a*, 53*a*, 54*a*, and 75*a*.

===Relationship Between the Element and the Main-unit-side Antenna===

Figure 9A:
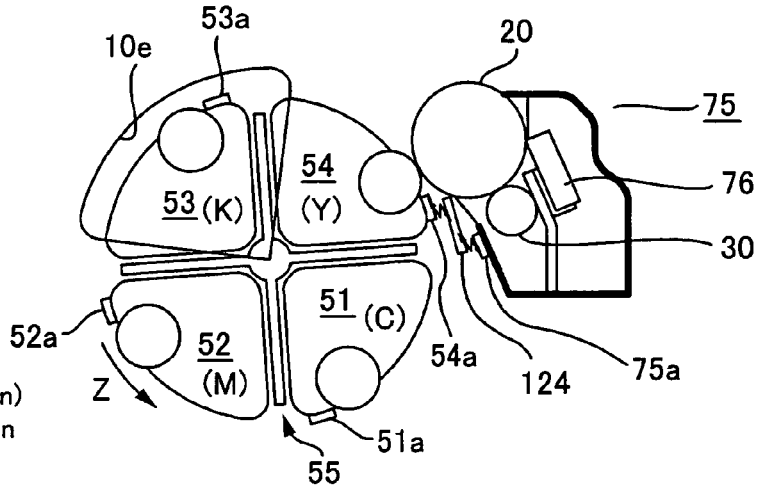
FIG. 9A is a diagram for describing the relationship between the elements and the main-unit-side antenna at the developing position.
Figure 9B:
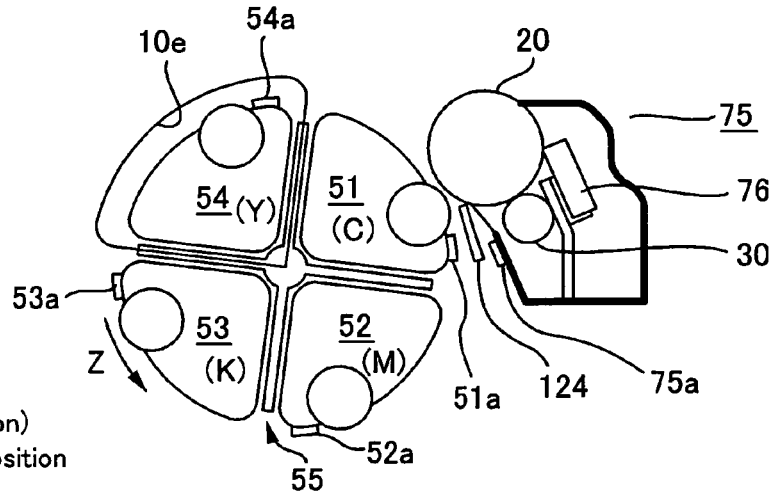
FIG. 9B is a diagram for describing the relationship between the elements and the main-unit-side antenna at the attach/detach position.
Figure 9C:
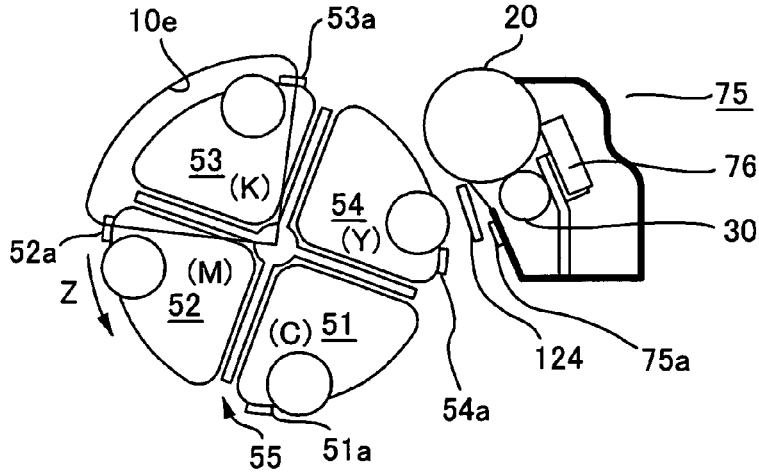
FIG. 9C is a diagram for describing the relationship between the elements and the main-unit-side antenna at the home position.
Figure 10:
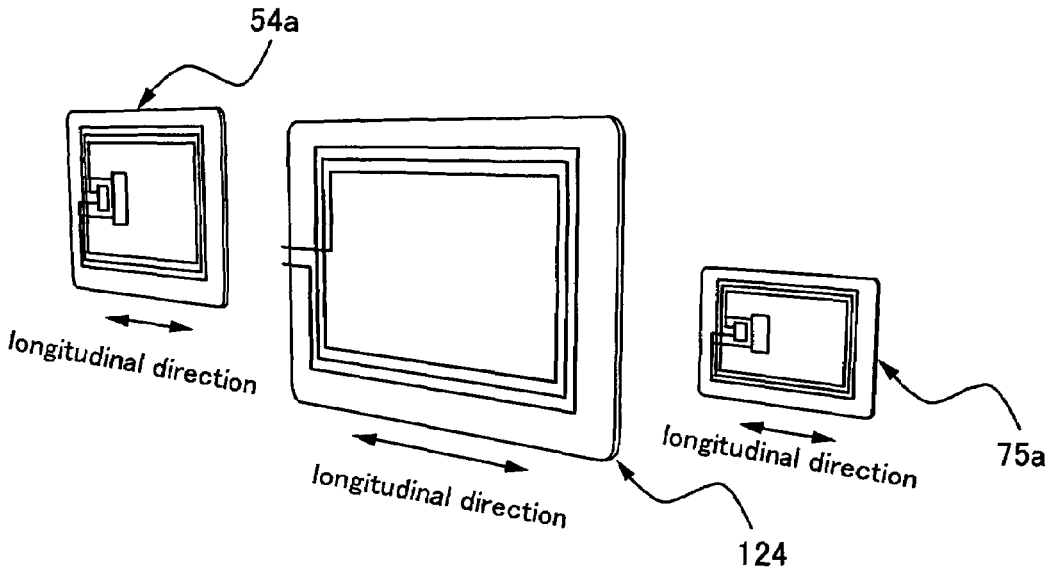
FIG. 10 is a perspective view showing the positional relationship between the elements 54*a* and 75*a* and the main-unit-side antenna 124 in FIG. 9A.

The relationship between the elements of the developing units, the element 75*a* of the photoconductor unit 75, and the main-unit-side antenna 124 is described with reference to FIG. 9A to FIG. 9C and FIG. 10. FIG. 9A is a diagram for describing the relationship between the element and the main-unit-side antenna at the developing position. FIG. 9B is a diagram for describing the relationship between the element and the main-unit-side antenna at the attach/detach position. FIG. 9C is a diagram for describing the relationship between the element and the main-unit-side antenna at the home position. FIG. 10 is a perspective view showing the positional relationship between the element 54*a* and 75*a* and the main-unit-side antenna 124 in FIG. 9A.

In FIG. 9A, the yellow developing unit 54 is positioned at the developing position (opposition position). The main-unit-side antenna 124 is provided at a position located between the element 54*a* of the yellow developing unit 54 mounted to the developing unit attach/detach section and the element 75*a* of the photoconductor unit 75 mounted to the photoconductor unit attach/detach section. Also, the main-unit-side antenna 124 is in opposition to the element-side antenna serving as the photoconductor-unit antenna that is provided in the element 75*a*, and moreover, the main side antenna 124 is in opposition to the element-side antenna 54*d* serving as the developing-unit antenna that is provided in the element 54*a*.

Also, in this embodiment, as shown in FIG. 6A, the longitudinal direction of the element 54*a* is along the longitudinal direction of the element-side antenna 54*d*, and as shown in FIG. 10, the longitudinal direction of the main-unit-side antenna 124 (in FIG. 9A, the direction that pierces the paper plane) is in the longitudinal direction of the element-side antenna 54*d* (in FIG. 9A, the direction that pierces the paper plane).

Also, the relationship regarding the longitudinal directions of these two antennas also applies with regard to the relationship between the element-side antennas provided in the elements 51*a*, 52*a*, and 53*a* of the other developing units 51, 52, and 53, respectively, and the main-unit-side antenna 124 when the rotary 55 has rotatively moved to a predetermined position. It should be noted that it is clearly shown in FIG. 9A that the foregoing predetermined position in this embodiment is the developing position for each of the developing units, but this is not a limitation. Moreover, as shown in FIG. 10, the relationship regarding the longitudinal directions of these two antennas also applies to the relationship between the element-side antenna provided in the element 75*a* of the photoconductor unit 75 and the main-unit-side antenna 124.

Also, as shown in FIG. 10, the length of the main-unit-side antenna 124 in the longitudinal direction of the element-side antenna 54*d* (in FIG. 9A, the direction that pierces the paper plane) is greater than the length in the longitudinal direction of the element-side antenna 54*d*.

Also, the relationship regarding the length of these two antennas also applies to the relationship between the element-side antennas provided in the elements 51*a*, 52*a*, and 53*a* of the other developing units 51, 52, and 53, respectively, and the main-unit-side antenna 124 when the rotary 55 has rotatively moved to a predetermined position. It should be noted that it is clearly shown in FIG. 9A that the foregoing predetermined position in this embodiment is the developing position of each of the developing units, but this is not a limitation. Moreover, as shown in FIG. 10, the relationship regarding the length of these two antennas also applies to the relationship between the element-side antenna provided in the element 75*a* of the photoconductor unit 75 and the main-unit-side antenna 124.

It should be noted that the main-unit-side antenna 124 can wirelessly communicate with the elements 51*a*, 52*a*, 53*a*, and 54*a* not only when the rotary 55 is stopped but also when the rotary 55 is moving. That is, the main-unit-side antenna 124 can communicate with the elements 51*a*, 52*a*, 53*a*, and 54*a* while they are moving.

The main-unit-side antenna 124 is capable of communicating, in a non-contacting state, with the elements 51*a*, 52*a*, 53*a*, and 54*a* of the developing units, and the element 75*a* of the photoconductor unit 75.

===Rotation of the Rotary 55 and the Attach/Detach Position of the Developing Units (Attach and Detach Position)===

The relationship between the rotation of the rotary 55 and the position where the developing units are detached is described next with reference to FIG. 9.

As described above, in the state shown in FIG. 9A the yellow developing unit 54 is positioned at the developing position. From this state, when the rotary 55 is rotated by a predetermined angle in the Z direction, the state becomes that of FIG. 9B. In the state shown in FIG. 9B, the yellow developing unit 54 is positioned at the attach/detach position. In this state, the yellow developing unit 54 can be attached and detached via the attach/detach opening 10*e*, that is, the yellow developing unit 54 can be attached to the attach/detach section 55*e* or it can be detached from the attach/detach section 55*e*. Then, when the rotary 55 is rotated in the Z direction by a predetermined angle from the state shown in FIG. 9B, the cyan developing unit 51 positioned upstream in the direction of rotation of the rotary 55 is positioned at the developing position.

It should be noted that FIG. 9C shows a state where the rotary 55 is positioned at the home position after the printer 10 has been turned ON and the initialization operation has been performed.

===Writing Information to Elements of the Developing Units===

Figure 11:
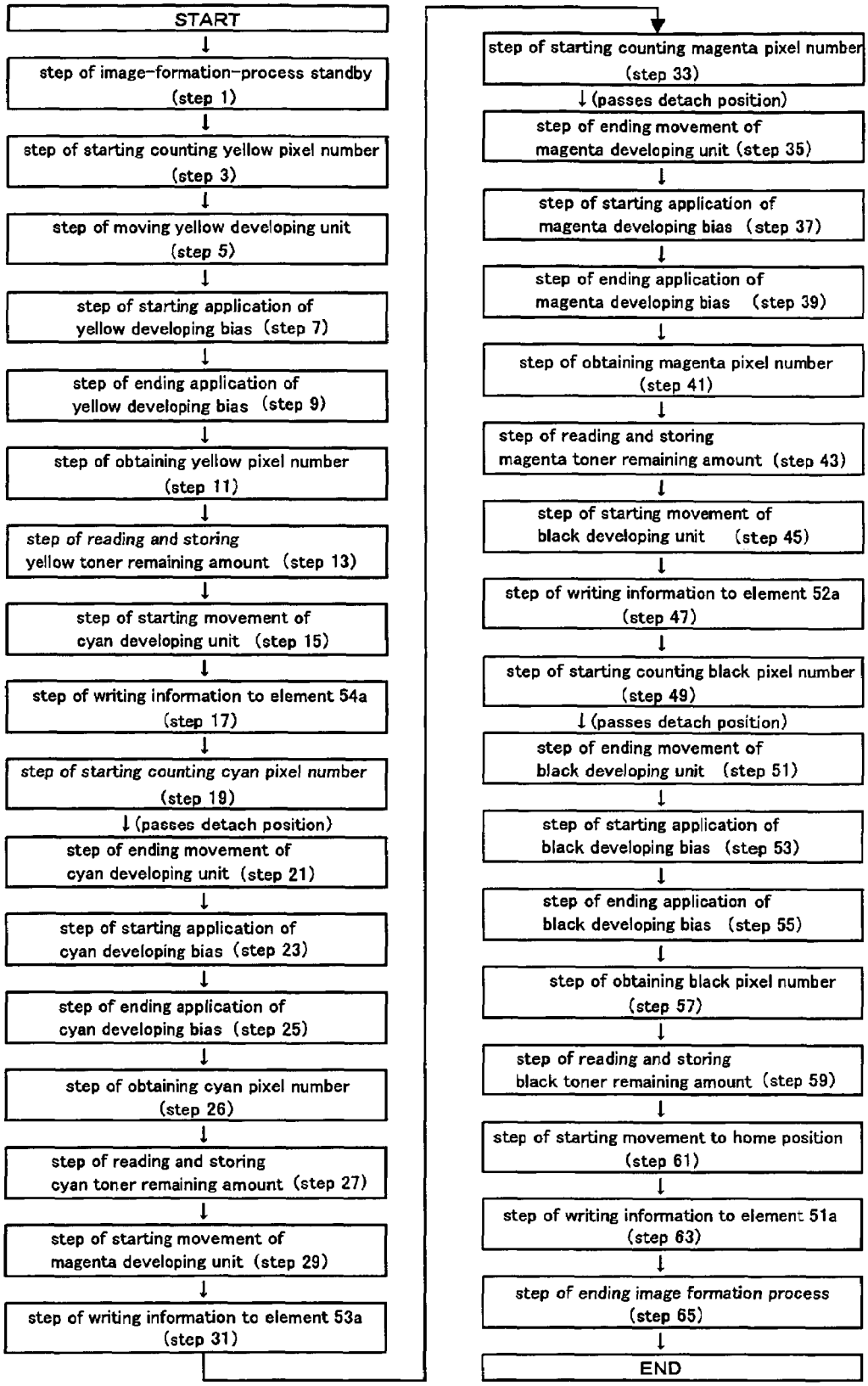
FIG. 11 is a flowchart for describing how information is written to the elements of the developing units.

An example of writing information to the elements of the developing units is described next with reference to FIG. 11. FIG. 11 is a flowchart for describing how information is written to the elements of the developing units.

<Step of Image-Formation-Process Standby (Step 1)>

When the printer 10 is turned ON, a predetermined initialization process is performed and the printer 10 enters an image-formation-process standby state. When an image signal, which serves as an image-formation-process order, is input from the host computer to the main controller 101 of the printer 10 via the interface (I/F) 112, the photoconductor 20 and the intermediate transferring member 70 are rotated. Then, the read sensor for synchronization RS detects the reference position of the intermediate transferring member 70 and outputs a pulse signal. The unit controller 102 executes the following control, using the received pulse signal as a reference.

<Step of Starting Counting Yellow Pixel Number (Step 3)>

A latent image that corresponds to the yellow image information is formed on the charged photoconductor by the exposing unit 40. At this time, the pixel counter 127*a* starts counting the number of pixels input to the exposing unit 40.

<Step of Moving Yellow Developing Unit (Step 5)>

The rotary 55 is rotated, thereby moving the yellow developing unit 54 to the developing position.

<Step of Starting Application of Yellow Developing Bias (Step 7)>

Application of a developing bias to the developing roller of the yellow developing unit 54 is started. Thus, the latent image formed on the photoconductor 20 is developed with yellow toner. The developing bias that is applied is a voltage in which AC voltage and DC voltage are superimposed, as mentioned above. It should be noted that it is possible to apply the developing bias to the developing roller before the yellow developing unit 54 arrives at the developing position, or it is instead possible to apply the developing bias to the developing roller after the yellow developing unit 54 arrives at the developing position.

<Step of Ending Application of Yellow Developing Bias (Step 9)>

At a predetermined timing, application of the developing bias to the developing roller of the yellow developing unit 54 is ended. Thus, the developing operation employing the yellow developing unit 54 is ended.

<Step of Obtaining Yellow Pixel Number (Step 11)>

The number of pixels that have been counted is obtained from the pixel counter 127*a*. The number of counted pixels is proportional to the amount of toner that is consumed, and thus the amount of yellow toner that is consumed YT can be found.

<Step of Reading and Storing Yellow Toner Remaining Amount (Step 13)>

The amount of remaining yellow toner YY that is stored in the RAM is read out from the RAM and a value YYnew obtained by subtracting the consumed amount YT from the remaining amount YY is stored in the RAM as the new remaining amount.

<Step of Starting Movement of Cyan Developing Unit (Step 15)>

The rotary 55 starts rotating so as to position the cyan developing unit 51 at the developing position.

<Step of Writing Information to Element 54*a* (Step 17)>

The value YYnew obtained by subtracting the consumed amount YT from the remaining amount YY is written to the element 54*a* of the yellow developing unit 54. This writing is carried out using the main-unit-side antenna 124, without it being in contact with the element 54*a* as the element 54*a* moves. It should be noted that when this writing is carried out, the yellow developing unit 54 has not reached the detach position (the attach/detach position) where it can be detached via the attach/detach opening 10*e*.

<Step of Starting Counting Cyan Pixel Number (Step 19)>

A latent image that corresponds to the cyan image information is formed on the charged photoconductor by the exposing unit 40. At this time, the pixel counter 127*a* starts counting the number of pixels input to the exposing unit 40.

<Step of Ending Movement of Cyan Developing Unit (Step 21)>

The rotation of the rotary 55 for positioning the cyan developing unit 51 at the developing position is ended. Thus, the cyan developing unit 51 arrives at the developing position.

<Step of Starting Application of Cyan Developing Bias (Step 23)>

Application of a developing bias to the developing roller of the cyan developing unit 51 is started. Thus, the latent image formed on the photoconductor 20 is developed with cyan toner.

<Step of Ending Application of Cyan Developing Bias (Step 25)>

At a predetermined timing, application of the developing bias to the developing roller of the cyan developing unit 51 is ended. Thus, the developing operation employing the cyan developing unit 51 is ended.

<Step of Obtaining Cyan Pixel Number (Step 26)>

The number of pixels that have been counted is obtained from the pixel counter 127*a*. The number of counted pixels is proportional to the amount of toner that is consumed; and thus the amount of cyan toner that is consumed CT can be found.

<Step of Reading and Storing Cyan Toner Remaining Amount (Step 27)>

The amount of remaining cyan toner CC that is stored in the RAM is read out from the RAM and a value CCnew obtained by subtracting the consumed amount CT from the remaining amount CC is stored in the RAM as the new remaining amount.

<Step of Starting Movement of Magenta Developing Unit (Step 29)>

The rotary 55 starts rotating so as to position the magenta developing unit 52 at the developing position.

<Step of Writing Information to Element 51*a* (Step 31)>

The value CCnew obtained by subtracting the consumed amount CT from the remaining amount CC is written to the element 51*a* of the cyan developing unit 51. This writing is carried out using the main-unit-side antenna 124, without it being in contact with the element 51*a* as the element 51*a* moves. It should be noted that when this writing is carried out, the cyan developing unit 51 has not reached the detach position (the attach/detach position) where it can be detached via the attach/detach opening 10*e*.

<Step of Starting Counting Magenta Pixel Number (Step 33)>

A latent image that corresponds to the magenta image information is formed on the charged photoconductor by the exposing unit 40. At this time, the pixel counter 127*a* starts counting the number of pixels input to the exposing unit 40.

<Step of Ending Movement of Magenta Developing Unit (Step 35)>

The rotation of the rotary 55 for positioning the magenta developing unit 52 at the developing position is ended. Thus, the magenta developing unit 52 arrives at the developing position.

<Step of Starting Application of Magenta Developing Bias (Step 37)>

Application of a developing bias to the developing roller of the magenta developing unit 52 is started. Thus, the latent image formed on the photoconductor 20 is developed with magenta toner.

<Step of Ending Application of Magenta Developing Bias (Step 39)>

At a predetermined timing, application of the developing bias to the developing roller of the magenta developing unit 52 is ended. Thus, the developing operation employing the magenta developing unit 52 is ended.

<Step of Obtaining Magenta Pixel Number (Step 41)>

The number of pixels that have been counted is obtained from the pixel counter 127*a*. The number of counted pixels is proportional to the amount of toner that is consumed, and thus the amount of magenta toner that is consumed MT can be found.

<Step of Reading and Storing Magenta Toner Remaining Amount (Step 43)>

The amount of remaining magenta toner MM that is stored in the RAM is read out from the RAM and a value MMnew obtained by subtracting the consumed amount MT from the remaining amount MM is stored in the RAM as the new remaining amount.

<Step of Starting Movement of Black Developing Unit (Step 45)>

The rotary 55 starts rotating so as to position the black developing unit 53 at the developing position.

<Step of Writing Information to Element 52*a* (Step 47)>

The value MMnew obtained by subtracting the consumed amount MT from the remaining amount MM is written to the element 52*a* of the magenta developing unit 52. This writing is carried out using the main-unit-side antenna 124, without it being in contact with the element 52*a* as the element 52*a* moves. It should be noted that when this writing is carried out, the magenta developing unit 52 has not reached the detach position (the attach/detach position) where it can be detached via the attach/detach opening 10*e*.

<Step of Starting Counting Black Pixel Number (Step 49)>

A latent image that corresponds to the black image information is formed on the charged photoconductor by the exposing unit 40. At this time, the pixel counter 127*a* starts counting the number of pixels input to the exposing unit 40.

<Step of Ending Movement of Black Developing Unit (Step 51)>

The rotation of the rotary 55 for positioning the black developing unit 53 at the developing position is ended. Thus, the black developing unit 53 arrives at the developing position.

<Step of Starting Application of Black Developing Bias (Step 53)>

Application of a developing bias to the developing roller of the black developing unit 53 is started. Thus, the latent image formed on the photoconductor 20 is developed with black toner.

<Step of Ending Application of Black Developing Bias (Step 55)>

At a predetermined timing, application of the developing bias to the developing roller of the black developing unit 53 is ended. Thus, the developing operation employing the black developing unit 53 is ended.

<Step of Obtaining Black Pixel Number (Step 57)>

The number of pixels that have been counted is obtained from the pixel counter 127*a*. The number of counted pixels is proportional to the amount of toner that is consumed, and thus the amount of black toner that is consumed BT can be found.

<Step of Reading and Storing Black Toner Remaining Amount (Step 59)>

The amount of remaining black toner BB that is stored in the RAM is read out from the RAM and a value BBnew obtained by subtracting the consumed amount BT from the remaining amount BB is stored in the RAM as the new remaining amount.

<Step of Starting Movement to Home Position (Step 61)>

Rotation of the rotary 55 is started so as to position the rotary 55 at the home position.

<Step of Writing Information to Element 53*a* (Step 63)>

The value BBnew obtained by subtracting the consumed amount BT from the remaining amount BB is written to the element 53*a* of the black developing unit 53. This writing is carried out using the main-unit-side antenna 124, without it being in contact with the element 53*a* as the element 53*a* moves. It should be noted that when this writing is carried out, the black developing unit 53 has not reached the detach position (the attach/detach position) where it can be detached via the attach/detach opening 10*e*.

<Step of Ending Printing Operation (Step 65)>

When the rotary 55 arrives at the home position the image formation process is ended, and the state of image-formation-process standby is entered.

===Writing Information to the Element of the Photoconductor Unit===

Figure 12:
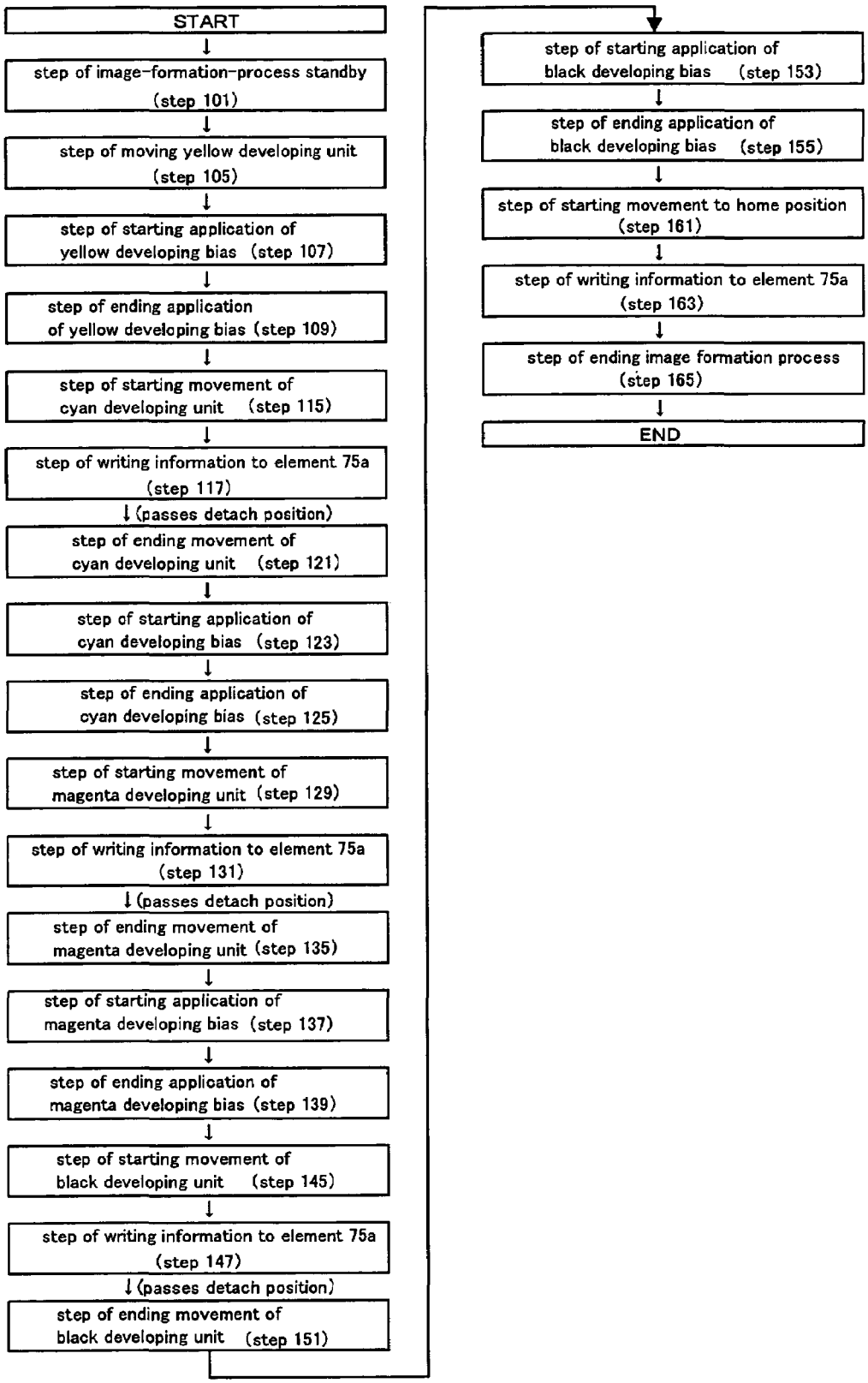
FIG. 12 is a flowchart for describing how information is written to the element 75*a* of the photoconductor unit 75.

An example of writing information to the element 75*a* of the photoconductor unit 75 is described next with reference to FIG. 12. FIG. 12 is a flowchart for describing how information is written to the element 75*a* of the photoconductor unit 75. More specifically, an example is shown in which the number of sheets printed by each developing unit, that is, the number of sheets printed by each toner color, is written to the element 75*a*.

<Step of Image-Formation-Process Standby (Step 101)>

When the printer 10 is turned ON, a predetermined initialization process is performed and the printer 10 enters an image-formation-process standby state. When an image signal, which serves as an image-formation-process order, is input from the host computer to the main controller 101 of the printer 10 via the interface (I/F) 112, the photoconductor 20 and the intermediate transferring member 70 are rotated. Then, the read sensor for synchronization RS detects the reference position of the intermediate transferring member 70 and outputs a pulse signal. The unit controller 102 executes the following control, using the received pulse signal as a reference.

<Step of Moving Yellow Developing Unit (Step 105)>

The rotary 55 starts rotating so as to position the yellow developing unit 54 at the developing position.

<Step of Starting Application of Yellow Developing Bias (Step 107)>

Application of a developing bias to the developing roller of the yellow developing unit 54 is started. Thus, the latent image formed on the photoconductor 20 is developed with yellow toner. The developing bias that is applied is a voltage in which AC voltage and DC voltage are superimposed, as mentioned above. It should be noted that it is possible to apply the developing bias to the developing roller before the yellow developing unit 54 arrives at the developing position, or it is instead possible to apply the developing bias to the developing roller after the yellow developing unit 54 has arrived at the developing position.

<Step of Ending Application of Yellow Developing Bias (Step 109)>

At a predetermined timing, application of the developing bias to the developing roller of the yellow developing unit 54 is ended. Thus, the developing operation employing the yellow developing unit 54 is ended.

<Step of Starting Movement of Cyan Developing Unit (Step 115)>

The rotary 55 starts rotating so as to position the cyan developing unit 51 at the developing position.

<Step of Writing Information to Element 75*a* (Step 117)>

Information indicating that the number of sheets printed by the yellow developing unit 54 has increased by one sheet is written to the element 75*a* of the photoconductor unit 75 as the "Number of Yellow Printed Sheets" (see FIG. 8). This writing is carried out using the main-unit-side antenna 124, without it being in contact with the element 75*a*. It should be noted that when this writing is carried out, the yellow developing unit 54 has not reached the detach position (the attach/detach position) where it can be detached via the attach/detach opening 10*e*. Also, as the method for writing information indicating that the number of sheets printed by the yellow developing unit 54 has increased by one sheet, it is possible to adopt a method of storing data indicating the total number of sheets printed by the yellow developing unit 54 on a RAM provided in the main printer unit 10*a* and then adding 1 to this number and writing the resulting number to the element 75*a* of the photoconductor unit 75, for example.

<Step of Ending Movement of Cyan Developing Unit (Step 121)>

The rotation of the rotary 55 for positioning the cyan developing unit 51 at the developing position is ended. Thus, the cyan developing unit 51 arrives at the developing position.

<Step of Starting Application of Cyan Developing Bias (Step 123)>

Application of a developing bias to the developing roller of the cyan developing unit 51 is started. Thus, the latent image formed on the photoconductor 20 is developed with cyan toner.

<Step of Ending Application of Cyan Developing Bias (Step 125)>

At a predetermined timing, application of the developing bias to the developing roller of the cyan developing unit 51 is ended. Thus, the developing operation employing the cyan developing unit 51 is ended.

<Step of Starting Movement of Magenta Developing Unit (Step 129)>

The rotary 55 starts rotating so as to position the magenta developing unit 52 at the developing position.

<Step of Writing Information to Element 75*a* (Step 131)>

Information indicating that the number of sheets printed by the cyan developing unit 51 has increased by one sheet is written to the element 75*a* of the photoconductor unit 75 as the "Number of Cyan Printed Sheets" (see FIG. 8). This writing is carried out using the main-unit-side antenna 124, without it being in contact with the element 75*a*. It should be noted that when this writing is carried out, the cyan developing unit 51 has not reached the detach position (the attach/detach position) where it can be detached via the attach/detach opening 10*e*.

<Step of Ending Movement of Magenta Developing Unit (Step 135)>

The rotation of the rotary 55 for positioning the magenta developing unit 52 at the developing position is ended. Thus, the magenta developing unit 52 arrives at the developing position.

<Step of Starting Application of Magenta Developing Bias (Step 137)>

Application of a developing bias to the developing roller of the magenta developing unit 52 is started. Thus, the latent image formed on the photoconductor 20 is developed with magenta toner.

<Step of Ending Application of Magenta Developing Bias (Step 139)>

At a predetermined timing, application of the developing bias to the developing roller of the magenta developing unit 52 is ended. Thus, the developing operation employing the magenta developing unit 52 is ended.

<Step of Starting Movement of Black Developing Unit (Step 145)>

The rotary 55 starts rotating so as to position the black developing unit 53 at the developing position.

<Step of Writing Information to Element 75*a* (Step 147)>

Information indicating that the number of sheets printed by the magenta developing unit 52 has increased by one sheet is written to the element 75*a* of the photoconductor unit 75 as the "Number of Magenta Printed Sheets" (see FIG. 8). This writing is carried out using the main-unit-side antenna 124, without it being in contact with the element 75*a*. It should be noted that when this writing is carried out, the magenta developing unit 52 has not reached the detach position (the attach/detach position) where it can be detached via the attach/detach opening 10*e*.

<Step of Ending Movement of Black Developing Unit (Step 151)>

The rotation of the rotary 55 for positioning the black developing unit 53 at the developing position is ended. Thus, the black developing unit 53 arrives at the developing position.

<Step of Starting Application of Black Developing Bias (Step 153)>

Application of a developing bias to the developing roller of the black developing unit 53 is started. Thus, the latent image formed on the photoconductor 20 is developed with black toner.

<Step of Ending Application of Black Developing Bias (Step 155)>

At a predetermined timing, application of the developing bias to the developing roller of the black developing unit 53 is ended. Thus, the developing operation employing the black developing unit 53 is ended.

<Step of Writing Information to Element 75*a* (Step 161)>

Information indicating that the number of sheets printed by the black developing unit 53 has increased by one sheet is written to the element 75*a* of the photoconductor unit 75 as the "Number of Black Printed Sheets" (see FIG. 8). This writing is carried out using the main-unit-side antenna 124, without it being in contact with the element 75*a*. It should be noted that when this writing is carried out, the black developing unit 53 has not reached the detach position (the attach/detach position) where it can be detached via the attach/detach opening 10*e*.

<Step of Ending Printing Operation (Step 165)>

When the rotary 55 arrives at the home position, the image formation process is ended, and the state of image-formation-process standby is entered.

It should be noted that the information written to the element 75*a* is not limited to the foregoing example, and as shown in FIG. 8, it can also be, for example, the number of printed sheets when usage starts, the number of printed sheets when usage ends, and the number of monochrome printed sheets.

It may also be information on the remaining amount of toner or the usage amount of toner of the developing units. In this case, for example, in place of the step for writing information to the elements of the developing units in FIG. 11, it is possible to provide a step for writing information to the element 75*a* of the photoconductor unit 75.

Other Embodiments

In the foregoing, developing units, for example, according to the present invention were described in an embodiment thereof. However, the foregoing embodiment of the invention is for the purpose of elucidating the present invention and is not to be interpreted as limiting the present invention. The invention can of course be altered and improved without departing from the gist thereof and includes equivalents.

Figure 13A:
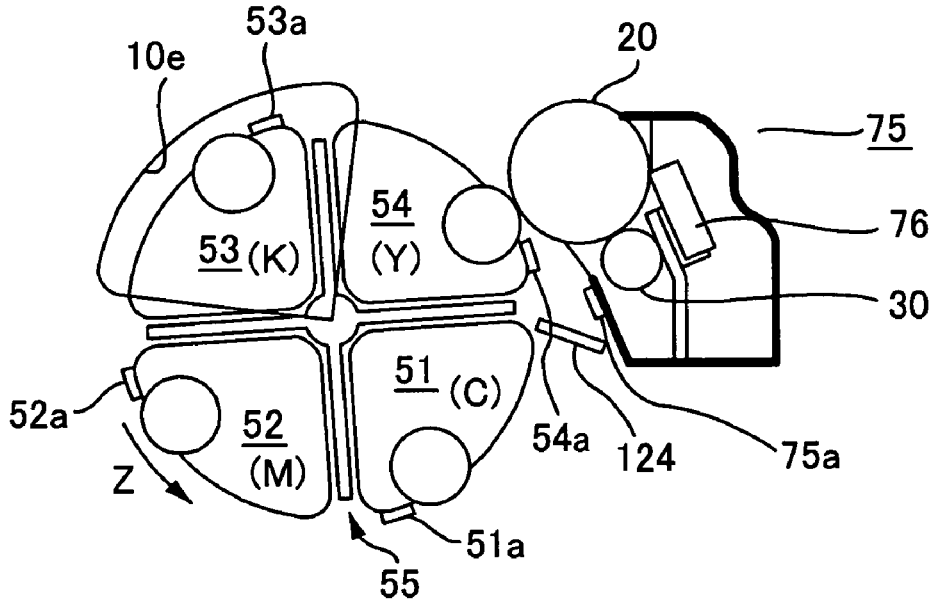
FIG. 13A is a diagram showing a first alternative example of the relationship between the elements and the main-unit-side antenna.

In the foregoing embodiment, the main-unit-side antenna is provided at a position located between the developing-unit element of the developing unit mounted to the developing unit attach/detach section and the photoconductor-unit element of the photoconductor unit mounted to the photoconductor unit attach/detach section, but this is not a limitation. For example, as shown in FIG. 13A, it is also possible to provide the main-unit-side antenna at a position where it is not sandwiched between the developing-unit element and the photoconductor-unit element.

However, the configuration of the foregoing embodiment is more preferable because it allows communication performance to be increased.

Also, in the foregoing embodiment, the main-unit-side antenna is in opposition to the photoconductor-unit antenna provided in the photoconductor-unit element of the photoconductor unit when the photoconductor unit is mounted to the photoconductor unit attach/detach section, but this is not a limitation.

However, taking into account the fact that it allows communication performance between the photoconductor-unit element and the main-unit-side antenna to be further increased, the configuration of the foregoing embodiment is more preferable.

Also, in the foregoing embodiment, the longitudinal direction of the main-unit-side antenna is along the longitudinal direction of the photoconductor-unit antenna provided in the photoconductor-unit element of the photoconductor unit when the photoconductor unit is mounted to the photoconductor unit attach/detach section, but this is not a limitation. For example, it is also possible for the longitudinal direction of the main-unit-side antenna to intersect the longitudinal direction of the photoconductor-unit antenna provided in the photoconductor-unit element of the photoconductor unit when the photoconductor unit is mounted to the photoconductor unit attach/detach section.

However, taking into account the fact that it allows communication performance between the photoconductor-unit element and the main-unit-side antenna to be further increased, the configuration of the foregoing embodiment is more preferable.

Also, in the foregoing embodiment, the length of the main-unit-side antenna in the longitudinal direction of the photoconductor-unit antenna provided in the photoconductor-unit element of the photoconductor unit when the photoconductor unit is mounted to the photoconductor unit attach/detach section is greater than the length in the longitudinal direction of the photoconductor-unit antenna, but this is not a limitation. For example, it is also possible for the length of the main-unit-side antenna in the longitudinal direction of the photoconductor-unit antenna provided in the photoconductor-unit element of the photoconductor unit when the photoconductor unit is mounted to the photoconductor unit attach/detach section to be shorter than the length in the longitudinal direction of the photoconductor-unit antenna.

However, taking into account the fact that it is possible to maintain a constant communication quality even if the element has deviated from its intended position, for example, the configuration of the foregoing embodiment is more preferable.

Also, in the foregoing embodiment, the main-unit-side antenna is in opposition to the developing-unit antenna provided in the developing-unit element of the developing unit when the developing unit is mounted to the developing unit attach/detach section and the moving member has moved to a predetermined position, but this is not a limitation.

However, taking into account the fact that it allows communication performance between the developing-unit element and the main-unit-side antenna to be further increased because the main-unit-side antenna is in opposition to the developing-unit antenna provided in the developing-unit element of the developing unit when the developing unit is mounted to the developing unit attach/detach section and the moving member has moved to a predetermined position, the configuration of the foregoing embodiment is more preferable.

Also, in the foregoing embodiment, the moving member moved in a rotative fashion, but this is not a limitation. For example, it may also be a type that moves in a parallel fashion.

Also, in the foregoing embodiment, the longitudinal direction of the main-unit-side antenna is along the longitudinal direction of the developing-unit antenna provided in the developing-unit element of the developing unit when the developing unit is mounted to the developing unit attach/detach section and the moving member has moved to a predetermined position, but this is not a limitation. For example, it is also possible for the longitudinal direction of the main-unit-side antenna to intersect the longitudinal direction of the developing-unit antenna provided in the developing-unit element of the developing unit when the developing unit is mounted to the developing unit attach/detach section and the moving member has moved to a predetermined position.

However, taking into account the fact that it allows communication performance between the developing-unit element and the main-unit-side antenna to be further increased, the configuration of the foregoing embodiment is more preferable.

Also, the length of the main-unit-side antenna in the longitudinal direction of the developing-unit antenna provided in the developing-unit element of the developing unit when the developing unit is mounted to the developing unit attach/detach section and the moving member has moved to a predetermined position was greater than the length in the longitudinal direction of the developing-unit antenna, but this is not a limitation. For example, it is also possible for the length of the main-unit-side antenna in the longitudinal direction of the developing-unit antenna provided in the developing-unit element of the developing unit when the developing unit is mounted to the developing unit attach/detach section and the moving member has moved to a predetermined position to be shorter than the length in the longitudinal direction of the developing-unit antenna.

However, taking into account the fact that it is possible to maintain a constant communication quality even if the element has deviated from its intended position, for example, the configuration of the foregoing embodiment is more preferable.

Also, the main unit antenna was capable of communicating with the photoconductor-unit element in a non-contacting state, but this is not a limitation. For example, the main-unit-side antenna may also communicate with the photoconductor-unit element in a state of contact with that element.

However, the configuration of the foregoing embodiment is more preferable because, for example, it is easier to achieve an image forming apparatus provided with an antenna that is capable of wirelessly communicating both with the developing-unit element and the photoconductor-unit element, compared to a case where the main-unit-side antenna is capable of performing communication with the photoconductor-unit element in a state of contact with that element.

Also, the main unit antenna was capable of communicating with the developing-unit element in a non-contacting state, but this is not a limitation. For example, the main-unit-side antenna may also communicate with the developing-unit element in a state of contact with that element.

However, the configuration of the foregoing embodiment is more preferable because, for example, it is easier to achieve an image forming apparatus provided with an antenna that is capable of wirelessly communicating both with the developing-unit element and the photoconductor-unit element, compared to a case where the main-unit-side antenna is capable of performing communication with the developing-unit element in a state of contact with that element.

Figure 13B:
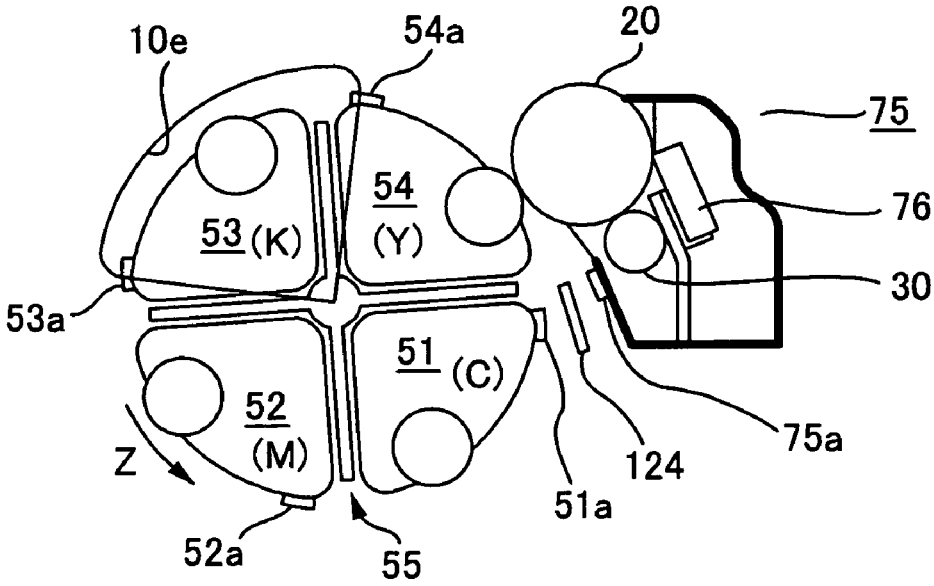
FIG. 13B is a diagram showing a second alternative example of the relationship between the elements and the main-unit-side antenna.

Also, in the foregoing description, as shown in FIG. 9A, when the yellow developing unit is positioned at the developing position (opposition position) the main-unit-side antenna is positioned at a position located between the element of the yellow developing unit mounted to the developing unit attach/detach section and the element of the photoconductor unit mounted to the photoconductor unit attach/detach section, but this is not a limitation. For example, as shown in FIG. 13B, when the yellow developing unit is positioned at the developing position (opposition position) it is also possible for the main-unit-side antenna to be positioned at a position located between the element of the cyan developing unit mounted to the developing unit attach/detach section and the element of the photoconductor unit mounted to the photoconductor unit attach/detach section.

It is also possible for the photoconductor unit to not include a charging unit, and instead for the charging unit to be provided in the main printer unit. Also, the photoconductor unit is not limited to a roller-type photoconductor roller, and it may also be a belt-type photoconductor.

Also, as the developing roller, as long as a developing roller can be obtained, it is possible to use any of magnetic material, non-magnetic material, conductive material, insulating material, metal, rubber, and resin, for example. For example, as the material it is possible to use a metal such as aluminum, nickel, stainless steel, and iron, a rubber such as natural rubber, silicone rubber, urethane rubber, butadiene rubber, chloroprene rubber, neoprene rubber, and NBR, or a resin such as styrene resin, vinyl chloride resin, polyurethane resin, polyethylene resin, methacrylic resin, and nylon resin, for example. It is of course also possible to use these materials with a coating on their upper layer section. In this case, as the coating material it is possible to use polyethylene, polystyrene, polyurethane, polyester, nylon, or acrylic, for example. Also, as regards its form, it is possible to adopt any of a non-elastic body, an elastic body, a single layer, multiple layers, a film, and a roller, for example. Also, the developer is not limited to toner, and it may also be a two-component developer in which a carrier has been mixed.

The same applies for the toner supply member as well, and as the material thereof it is possible to use polystyrene foam, polyethylene foam, polyester foam, ethylene propylene foam, nylon foam, and silicone foam, for example, in addition to polyurethane foam, which was mentioned above. It should be noted that either open-cell foam or closed-cell foam can be used as the foam cell of the toner supply means. It should also be noted that there is no limitation to foam material, and it is also possible to use a rubber material having elasticity. More specifically, it is possible to use silicone rubber, urethane rubber, natural rubber, isoprene rubber, styrene butadiene rubber, butadiene rubber, chloroprene rubber, butyl rubber, ethylene propylene rubber, epichlorohydrin rubber, nitrile butadiene rubber, or acrylic rubber, molded with a conductive agent such as carbon dispersed therein.

The elements of the developing units and the element of the photoconductor unit are not limited to the configuration described in the foregoing embodiment. As long as information can be written to them, it is possible for them to be elements in which the antenna is provided separately, for example.

In the foregoing embodiment, an intermediate transferring type full-color laser beam printer was described as an example of the image forming apparatus, but the present invention can also be adopted for various other types of image forming apparatuses, such as full-color laser beam printers that are not of the intermediate transferring type, monochrome laser beam printers, copying machines, and facsimiles.

===Configuration of the Computer System, etc.===

Next, a computer system serving as an example of an embodiment of the present invention is described with reference to the drawings.

Figure 14:
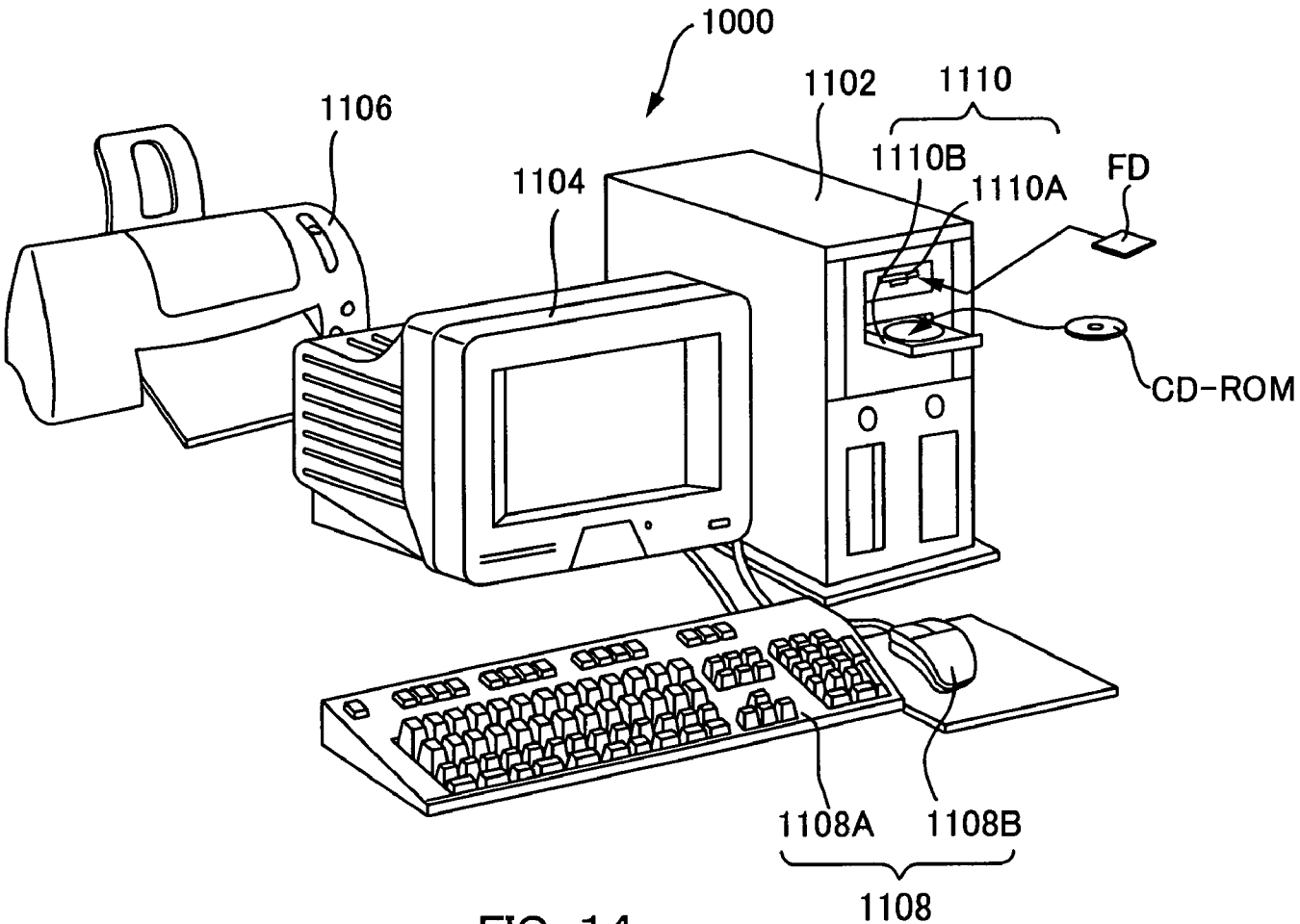
FIG. 14 is an explanatory diagram showing the external configuration of a computer system.

FIG. 14 is an explanatory diagram showing the external structure of the computer system. A computer system 1000 is provided with a main computer unit 1102, a display device 1104, a printer 1106, an input device 1108, and a reading device 1110. In this embodiment, the main computer unit 1102 is housed within a mini-tower type housing; however, this is not a limitation. A CRT (cathode ray tube), plasma display, or liquid crystal display device, for example, is generally used as the display device 1104, but this is not a limitation. As for the printer 1106, the printer described above is used. In this embodiment, the input device 1108 is a keyboard 1108A and a mouse 1108B, but it is not limited to these. In this embodiment, a flexible disk drive device 1110A and a CD-ROM drive device 1110B are used as the reading device 1110, but the reading device 1110 is not limited to these, and it may also be a MO (magnet optical) disk drive device or a DVD (digital versatile disk), for example.

Figure 15:
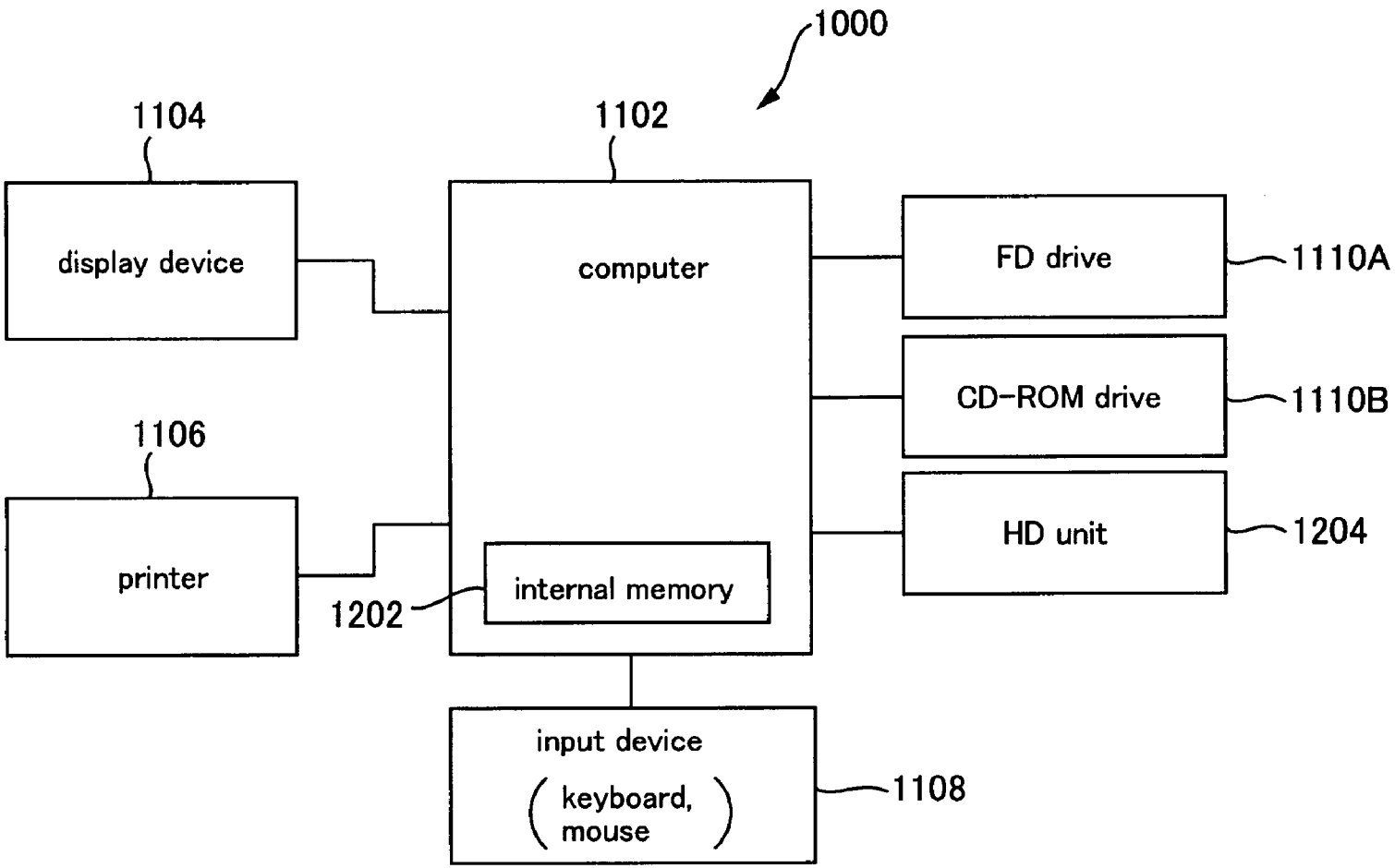
FIG. 15 is a block diagram showing the configuration of the computer system shown in FIG. 14.

FIG. 15 is a block diagram showing the configuration of the computer system shown in FIG. 14. An internal memory 1202 such as a RAM within the housing containing the main computer unit 1102 and, also, an external memory such as a hard disk drive unit 1204 are provided.

It should be noted that in the above description, an example was described in which the computer system is constituted by connecting the printer 1106 to the main computer unit 1102, the display device 1104, the input device 1108, and the reading device 1110; however, this is not a limitation. For example, the computer system can be made of the main computer unit 1102 and the printer 1106, or the computer system does not have to be provided with any one of the display device 1104, the input device 1108, and the reading device 1110.

Further, for example, the printer 1106 can have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attach/detach section to and from which recording media storing image data captured by a digital camera or the like are inserted and taken out.

As an overall system, the computer system that is thus achieved is superior to conventional systems.

Second Embodiment

===Overview of the Image Forming Apparatus (Laser Beam Printer)===

Figure 16:
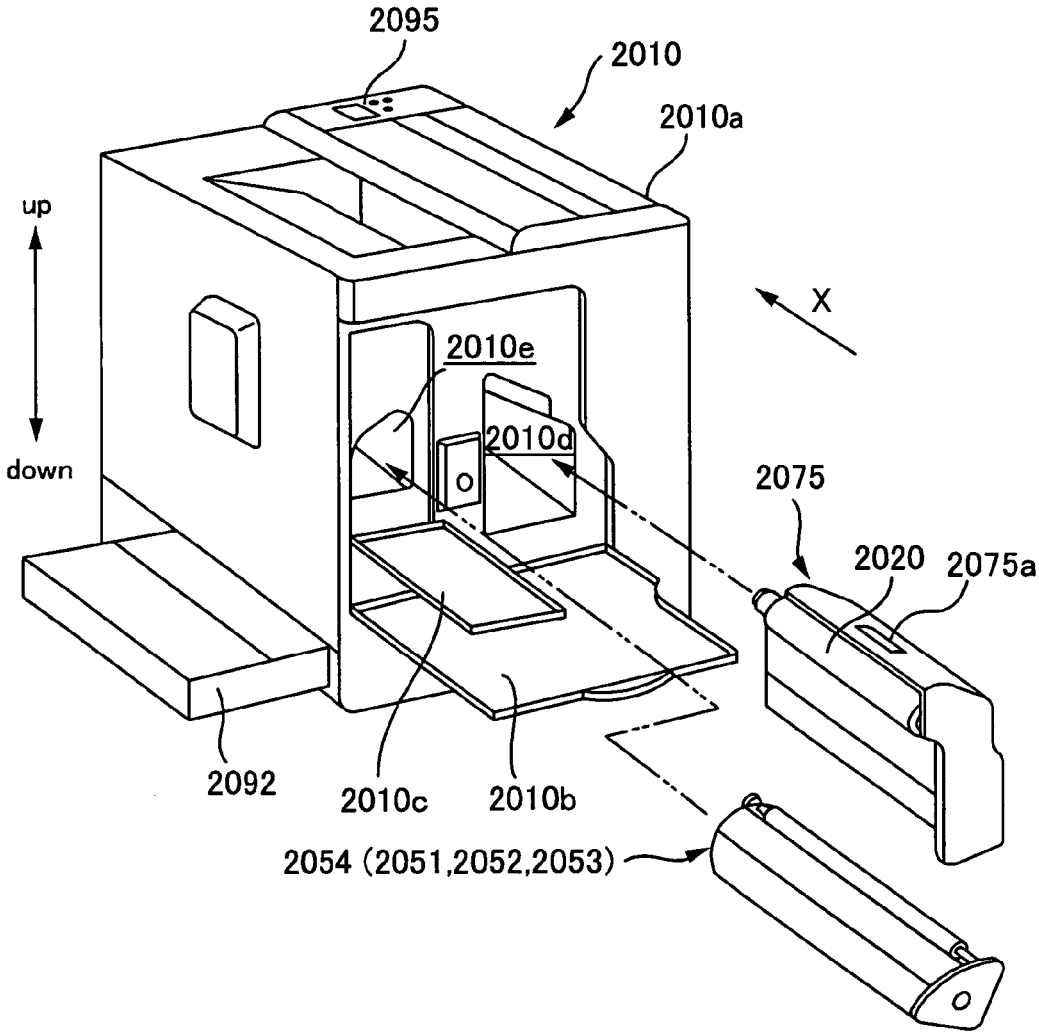
FIG. 16 is a diagram for describing how the developing unit 2054 (2051, 2052, 2053) and the photoconductor unit 2075 are attached to and detached from the main printer unit 2010*a*.
Figure 17:
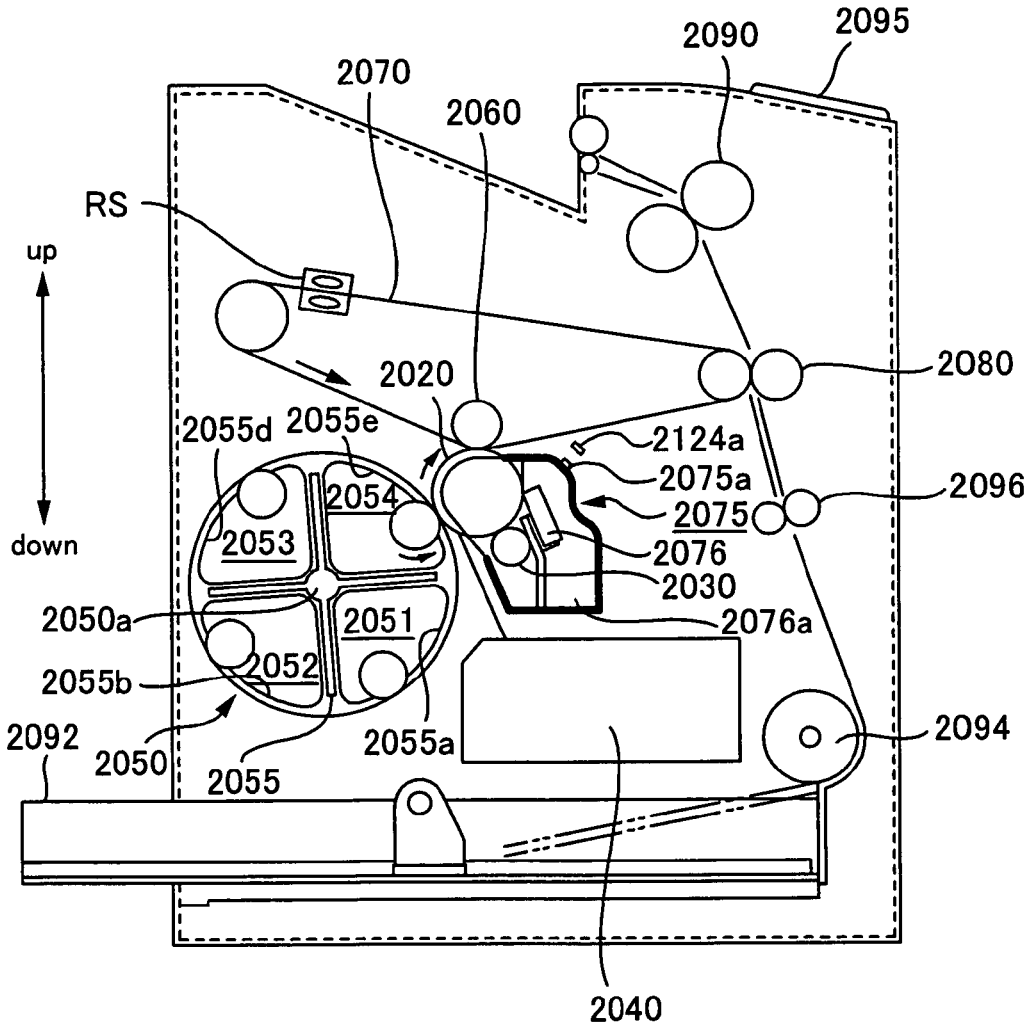
FIG. 17 is a diagram showing the main structural components constituting the printer 2010.

Next, using FIG. 16 and FIG. 17, an overview of a laser beam printer (hereinafter, also referred to as "printer") 2010 serving as an example of the image forming apparatus is described. FIG. 16 is a diagram for describing how a developing unit 2054 (2051, 2052, 2053) and a photoconductor unit 2075 are attached to and detached from a main printer unit 2010*a*. FIG. 17 is a diagram showing the main structural components making up the printer 2010. It should be noted that FIG. 17 is a diagram of across section taken perpendicular to the X direction in FIG. 16. Also, the vertical direction is shown by arrows in FIG. 16 and FIG. 17, and for example, a paper supply tray 2092 is arranged at a lower section of the printer 2010 and a fusing unit 2090 is arranged at an upper section of the printer 2010.

<Attach/Detach Configuration>

The developing unit 2054 (2051, 2052, 2053) and the photoconductor unit 2075 can be attached to and detached from the main printer unit 2010*a*. The printer 2010 is constituted by mounting the developing unit 2054 (2051, 2052, 2053) and the photoconductor unit 2075 to the main printer unit 2010*a*.

The main printer unit 2010*a* has a first opening cover 2010*b* that can be opened and closed, a second opening cover 2010*c* that can be opened and closed and that is provided more inward than the first opening cover 2010*b*, a photoconductor unit attach/detach opening 2010*d* through which the photoconductor unit 2075 is attached and detached, and a developing unit attach/detach opening 2010*e* through which the developing unit 2054 (2051, 2052, 2053) is attached and detached.

Here, by the user opening the first opening cover 2010*b*, the photoconductor unit 2075 can be attached to and detached from the main printer unit 2010*a* via the photoconductor unit attach/detach opening 2010*d*. Further, by the user opening the second opening cover 2010*c*, the developing unit 2054 (2051, 2052, 2053) can be attached to and detached from the main printer unit 2010*a* via the developing unit attach/detach opening 2010*e*.

<Overview of the Printer 2010>

An overview of the printer 2010 in which the developing unit 2054 (2051, 2052, 2053) and the photoconductor unit 2075 have been mounted to the main printer unit 2010*a* is described.

As shown in FIG. 17, the printer 2010 of this embodiment has a charging unit 2030, an exposing unit 2040, a YMCK developing device 2050, a first transferring unit 2060, an intermediate transferring member 2070, and a cleaning blade 2076, all of which being arranged in the direction of rotation of a photoconductor 2020, which is a latent image bearing member for bearing a latent image. It further includes a second transferring unit 2080, the fusing unit 2090, a display unit 2095 such as a liquid crystal panel for constituting means for notifying the user, for example, and a control unit 2100 (FIG. 18) for controlling these units, for example, so as to control the operation of the printer 2010.

The photoconductor 2020 has a cylindrical conductive base and a photoconductive layer formed on the outer peripheral surface of the base, and can rotate about a central axis, and in this embodiment, it rotates in the clockwise direction as shown by the arrow in FIG. 17.

The charging unit 2030 is a device for charging the photoconductor 2020, and the exposing unit 2040 is a device for forming a latent image on the charged photoconductor 2020 by irradiating a laser. The exposing unit 2040 has a semiconductor laser, a polygon mirror, and a F-θ lens, for example, and irradiates a modulated laser onto the charged photoconductor 2020 based on an image signal input from a host computer that is not shown, such as a personal computer or a word processor.

The YMCK developing device 2050 has a rotary 55 that serves as a rotating member, and four developing units mounted to the rotary 2055. The rotary 2055 is capable of rotating, and is provided with four attach/detach sections 2055*b*, 2055*c*, 2055*d*, and 2055*e* to and from which the four developing units 2051, 2052, 2053 and 2054, respectively, can be attached and detached via the developing unit attach/detach opening 2010*e*. The cyan developing unit 2051, which contains cyan (C) toner, can be attached to and detached from the attach/detach section 2055*b*, the magenta developing unit 2052, which contains magenta (M) toner, can be attached to and detached from the attach/detach section 2055*c*, the black developing unit 2053, which contains black (K) toner, can be attached to and detached from the attach/detach section 2055*d*, and the yellow developing unit 2054, which contains yellow (Y) toner, can be attached to and detached from the attach/detach section 2055*e*.

The rotary 2055, by rotating, moves the four developing units 2051, 2052, 2053 and 2054 mentioned above that are mounted to the attach/detach sections 2055*b*, 2055*c*, 2055*d*, and 2055*e*, respectively. That is, the rotary 2055 rotates the four mounted developing units 2051, 2052, 2053 and 2054 about a central shaft 2055*a* while maintaining their positions relative to one another. Then, the developing units 2051, 2052, 2053 and 2054 are selectively brought into opposition with the latent image formed on the photoconductor 2020 and the latent image on the photoconductor 2020 is developed using the toner contained in the developing units 2051, 2052, 2053 and 2054. It should be noted that the developing units are described in detail later.

The first transferring unit 2060 is a device for transferring a single color toner image formed on the photoconductor 2020 to the intermediate transferring member 2070. When the four toner colors are successively transferred superimposed over one another, a full color toner image is formed on the intermediate transferring member 2070.

The intermediate transferring member 2070 is an endless belt that is rotatively driven at substantially the same circumferential velocity as the photoconductor 2020. A read sensor for synchronization RS is provided near the intermediate transferring member 2070. The read sensor for synchronization RS is a sensor for detecting the reference position of the intermediate transferring member 2070, and obtains a synchronization signal Vsync in the sub-scanning direction, which is perpendicular to the main-scanning direction. The read sensor for synchronization RS has a light-emitting section for emitting light and a light-receiving section for receiving light. Light that is emitted from the light-emitting section passes through a hole formed at a predetermined position in the intermediate transferring member 2070, and when light is received by the light-receiving section, the read sensor for synchronization RS generates a pulse signal. One pulse signal is generated per each revolution of the intermediate transferring member 2070.

The second transferring unit 2080 is a device for transferring a single color toner image or a full color toner image formed on the intermediate transferring member 2070 to a recording medium such as paper, film, or cloth.

The fusing unit 2090 is a device for fusing the single color toner image or the full color toner image, which has been transferred to the recording medium, onto the recording medium such as paper, making it a permanent image.

The cleaning blade 2076 is made of rubber and abuts against the surface of the photoconductor 2020. The cleaning blade 2076 scrapes off and removes toner remaining on the photoconductor 2020 after the toner image has been transferred to the intermediate transferring member 2070 by the first transferring unit 2060.

The photoconductor unit 2075 is provided between the first transferring unit 2060 and the exposing unit 2040, and has the photoconductor 2020, an element 2075*a*, the charging unit 2030, the cleaning blade 2076, and a waste toner containing section 2076*a* for containing toner that has been scraped of f by the cleaning blade 2076. It should be noted that the element 2075*a* has a configuration that allows various types of written information to be recorded.

Figure 18:
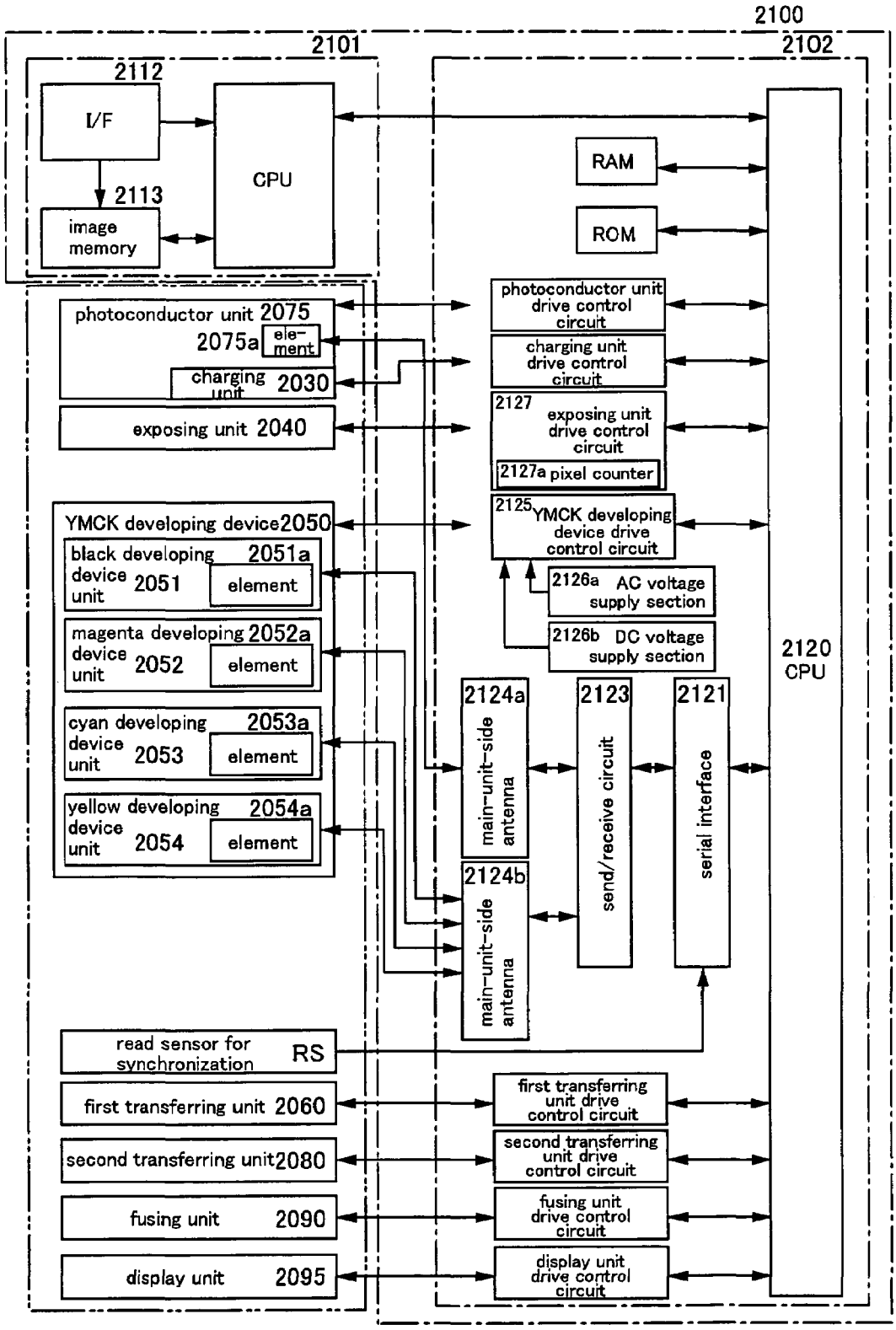
FIG. 18 is a block diagram showing the control unit 2100 provided in the printer 2010.

The control unit 2100 is made of a main controller 2101 and a unit controller 2102, as shown in FIG. 18. An image signal is input to the main controller 2101, and in accordance with a command based on this image signal, the unit controller 2102 controls the various units, for example, to form an image.

===Operation of the Printer 2010===

The operation of the printer 2010 configured as above is described below, referring to other structural components thereof as well.

First, an image signal from a host computer that is not shown is input to the main controller 2101 of the printer 2010 via an interface (I/F) 2112, and then the photoconductor 2020 and the intermediate transferring member 2070 are rotated due to control by the unit controller 2102 based on a command from the main controller 2101. Then, the reference position of the intermediate transferring member 2070 is detected by the read sensor for synchronization RS, and a pulse signal is output. This pulse signal is sent to the unit controller 2102 via a serial interface 2121. The unit controller 2102 controls the following operation, using the received pulse signal as a reference.

The photoconductor 2020 is successively charged by the charging unit 2030 at a charging position while rotating. The region of the photoconductor 2020 that is charged is brought to an exposure position through rotation of the photoconductor 2020, and a latent image corresponding to image information of the first color, for example, yellow Y, is formed in that region by the exposing unit 2040.

The latent image formed on the photoconductor 2020 is brought to a developing position due to rotation of the photoconductor 2020, and is developed in yellow toner by the yellow developing unit 2054. Thus, a yellow toner image is formed on the photoconductor 2020.

The yellow toner image that is formed on the photoconductor 2020 is brought to the first transferring position due to rotation of the photoconductor 2020 and is transferred to the intermediate transferring member 2070 by the first transferring unit 2060. At this time, a first transferring voltage of a polarity that is opposite to the toner charge polarity is applied to the first transferring unit 2060. It should be noted that throughout this operation the second transferring unit 2080 is kept separated from the intermediate transferring member 2070.

The above process is repeated for the second color, the third color, and the fourth color, transferring different color toner images corresponding to various image signals superimposed over one another onto the intermediate transferring member 2070. Thus, a full color toner image is formed on the intermediate transferring member 2070.

The full color toner image that is formed on the intermediate transferring member 2070 is brought to the second transferring position due to rotation of the intermediate transferring member 2070 and is transferred to a recording medium by the second transferring unit 2080. It should be noted that the recording medium is carried from the paper supply tray 2092 to the second transferring unit 2080 via a paper supply roller 2094 and a resisting roller 2096. Also, when performing the transferring operation, the second transferring unit 2080 is pressed against the intermediate transferring member 2070 and at the same time a second transferring voltage is applied thereto.

The fusing unit 2090 heats and applies pressure to the full color toner image that is transferred to the recording medium, fusing it to the recording medium.

On the other hand, after the photoconductor 2020 passes the first transferring position, the toner adhering to its surface is scraped off by the cleaning blade 2076 and the photoconductor 2020 is prepared for charging for forming the next latent image. The toner that is scraped off is collected into the waste toner containing section 2076*a*.

===Overview of the Control Unit===

The configuration of the control unit 2100 is described next with reference to FIG. 18. FIG. 18 is a block diagram showing the control unit 2100 provided in the printer 2010.

The main controller 2101 of the control unit 2100 is connected to a host computer via the interface 2112, and is provided with an image memory 2113 for storing image signals that are received from the host computer.

The unit controller 2102 of the control unit 2100 is electrically connected to the various units (the charging unit 2030, the exposing unit 2040, the first transferring unit 2060, the photoconductor unit 2075, the second transferring unit 2080, the fusing unit 2090, and the display unit 2095) and the YMCK developing device 2050, and by receiving signals from the sensors provided in these components, it controls these units and the YMCK developing device 2050 based on signals input from the main controller 2101 while detecting the state of these units and the YMCK developing device 2050. As the structural components for driving these units and the YMCK developing device 2050, FIG. 18 shows a photoconductor unit drive control circuit, a charging unit drive control circuit, an exposing unit drive control circuit 2127, a YMCK developing device drive control circuit 2125, a first transferring unit drive control circuit, a second transferring unit drive control circuit, a fusing unit drive control circuit, and a display unit drive control circuit.

The exposing unit drive control circuit 2127 connected to the exposing unit 2040 has a pixel counter 2127*a* that serves as consumption amount detection means for detecting the amount of developer that is consumed. The pixel counter 2127*a* counts the number of pixels that are input to the exposing unit 2040. It should be noted that it is also possible to provide the pixel counter 2127*a* in the exposing unit 2040 or in the main controller 2101. It should be noted that the number of pixels is the number of pixels in terms of the basic resolution of the printer 2010, that is, the number of pixels of the image that is actually printed. The amount of toner T that is consumed (the amount that is used) is proportional to the number of pixels, and thus by counting the number of pixels it is possible to detect the amount of toner T that is consumed.

To the YMCK developing device drive control circuit 2125, an AC voltage is supplied from an AC voltage supply section 2126*a* and a DC voltage is supplied from a DC voltage supply section 2126*b*. The YMCK developing device drive control circuit 2125 superimposes the AC voltage and the DC voltage, and applies the superimposed voltage to the developing roller at a suitable timing, forming an alternating electric field between the developing roller and the photoconductor.

Also, the CPU 2120 provided in the unit controller 2102 is connected to a nonvolatile storage element (hereinafter, also referred to as "main-unit-side memory") 2122 such as a serial EEPROM via the serial interface (I/F) 2121.

Also, the CPU 2120 is capable of wirelessly communicating with elements 2051*a*, 2052*a*, 2053*a*, and 2054*a*, which are respectively provided in/on the developing units 2051, 2052, 2053, and 2054, via the serial interface 2121, a send/receive circuit 2123, and a main-unit-side antenna 2124*b* (antenna for communication with developing-unit elements) serving as an example of the antenna for wirelessly communicating with the elements of the developing units mounted to the attach/detach sections. The CPU 2120 also is capable of wirelessly communicating with the element 2075*a* of the photoconductor unit 2075 via the serial interface 2121, the send/receive circuit 2123, and a main-unit-side antenna 2124*a* (antenna for communication with the photoconductor-unit element). At the time of wireless communication, the antenna 2124*b* for communication with developing-unit elements, which serves as a write means, writes information to the elements 2051*a*, 2052*a*, 2053*a*, and 2054*a* of the developing units 2051, 2052, 2053, and 2054, respectively. The antenna 2124*b* for communication with developing-unit elements, which serves as a write means, is also capable of reading information from the elements 2051*a*, 2052*a*, 2053*a*, and 2054*a* of the developing units 2051, 2052, 2053, and 2054, respectively. At the time of wireless communication, the antenna 2124*a* for communication with photoconductor-unit element, which serves as a write means, writes information to the element 2075*a* of the photoconductor unit 2075. The antenna 2124*a* for communication with photoconductor-unit element, which serves as a write means, can also read information from the element 2075*a* of the photoconductor unit 2075.

===Overview of the Developing Units===

Figure 19:
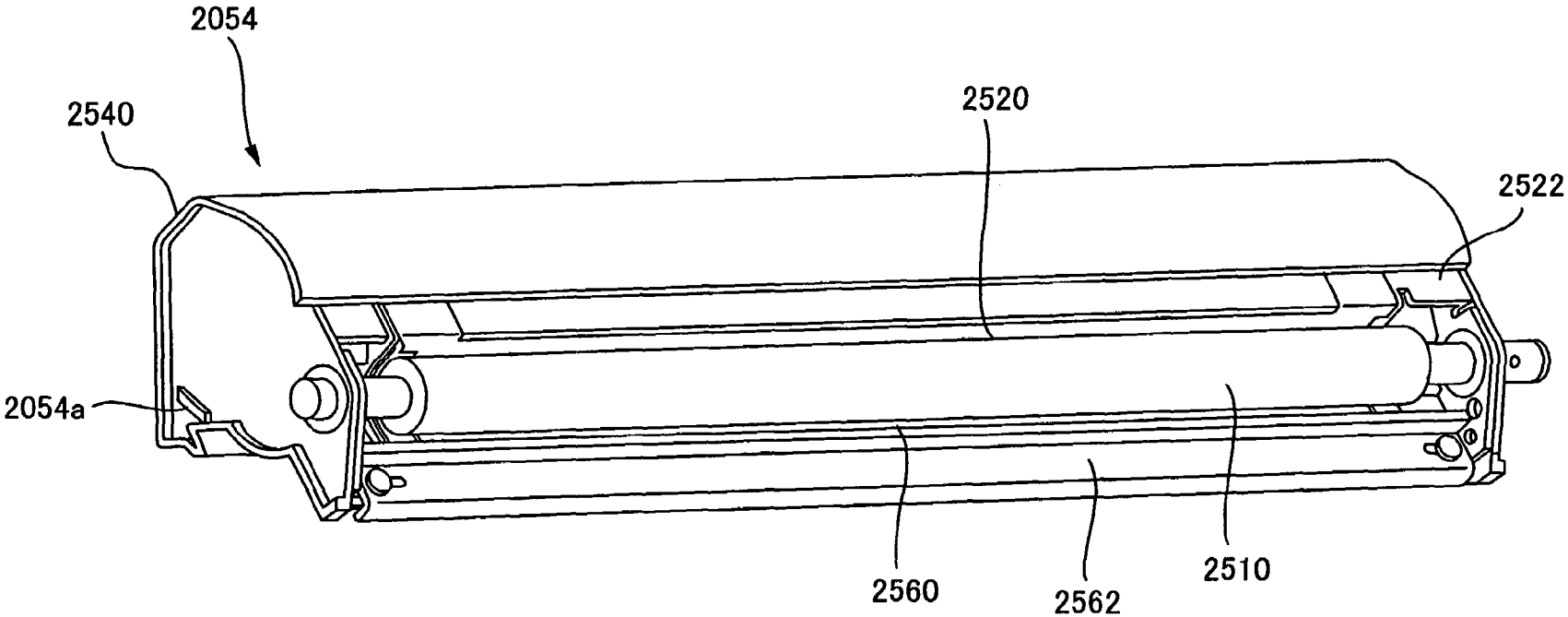
FIG. 19 is a perspective view of the yellow developing unit 2054 seen from the perspective of the developing roller 2510.
Figure 20:
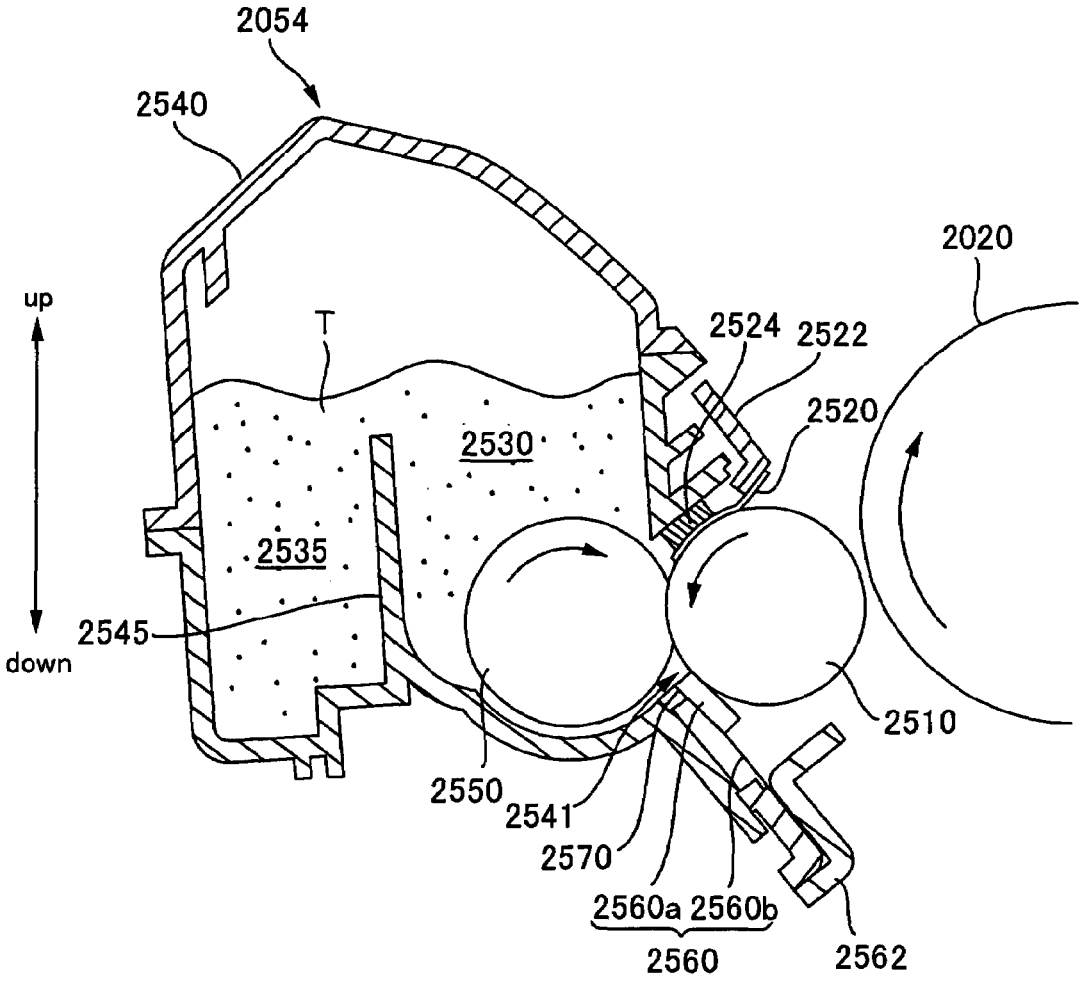
FIG. 20 is a cross-sectional view showing the main structural components of the yellow developing unit 2054.

An overview of the developing units is provided next using FIG. 19 and FIG. 20. FIG. 19 is a perspective view of the yellow developing unit 2054 seen from the developing roller 2510 side. FIG. 20 is a cross-sectional view showing the main structural components of the yellow developing unit 2054. It should be noted that in FIG. 20 as well, the vertical direction is shown by an arrow, and for example, the central axis of the developing roller 2510 is lower than the photoconductor 2020. Also, in FIG. 20, the yellow developing unit 2054 is shown positioned at a developing position that is in opposition to the photoconductor 2020.

The YMCK developing device 2050 is provided with the cyan developing unit 2051, which contains cyan (C) toner, the magenta developing unit 2052, which contains magenta (M) toner, the black developing unit 2053, which contains black (K) toner, and the yellow developing unit 2054, which contains yellow (Y) toner, and since the configuration of these developing units is the same, the yellow developing unit 2054 is described below.

The yellow developing unit 2054 is provided with a developer containing section for containing yellow toner T, which serves as the developer, that is, a first containing section 2530 and a second containing section 2535, the element 2054*a*, a housing 2540, the developing roller 2510, which serves as the developer bearing member, a toner supply roller 2550 for supplying toner T to the developing roller 2510, and a restriction blade 2560 for regulating the thickness of the layer of toner T that is borne by the developing roller 2510, for example.

The housing 2540 is manufactured by joining an upper housing and a lower housing to form a single unit, and the inside of the housing is divided into the first containing section 2530 and the second containing section 2535 by a restriction wall 2545 that extends upward from the lower section (the vertical direction of FIG. 20). The first containing section 2530 and the second containing section 2535 form a developer containing section (2530, 2535) for containing toner T serving as a developer. The upper sections of the first containing section 2530 and the second containing section 2535 are in communication, and the movement of the toner T is regulated by the restriction wall 2545. It should be noted that it is also possible to provide a stirring member for stirring the toner T contained in the first containing section 2530 and the second containing section 2535, but in the present embodiment, the developing units (the cyan developing unit 2051, the magenta developing unit 2052, the black developing unit 2053, and the yellow developing unit 2054) rotate in conjunction with rotation of the rotary 2055, so that the toner T in the developing units is stirred, and thus a stirring member is not provided in the first containing section 2530 or the second containing section 2535.

Further, as shown in FIG. 19, the element 2054*a*, to which information can be written, is provided on a lateral surface of the housing 2540. This lateral surface is a lateral surface of the yellow developing unit 2054 that intersects the axial direction of rotation of the rotary 2055 when the yellow developing unit 2054 is mounted to the attach/detach section 2055*e*. The yellow developing unit 2054 has two lateral surfaces that fit this description, but in the present embodiment, the element 2054*a* is provided on the lateral surface on the leading side when the developing unit is being attached.

An opening 2541 that is in communication with the outside of the housing 2540 is provided in the lower section of the first containing section 2530. The toner supply roller 2550 is provided in the first containing section 2530 with its circumferential surface facing the opening 2541, and is rotatably supported on the housing 2540. Also, the developing roller 2510 is provided with its circumferential surface facing the opening 2541 from outside the housing 2540, and the developing roller 2510 abuts against the toner supply roller 2550.

The developing roller 2510 bears toner T and carries the toner to a developing position in opposition to the photoconductor 2020. The developing roller 2510 is made of aluminum, stainless steel or iron, for example, and if necessary, it can be subjected to nickel plating or chrome plating, and the toner bearing region can be subjected to sandblasting or the like. The developing roller 2510 is provided in such a manner that its longitudinal direction is in the longitudinal direction of the yellow developing unit 2054. Also, the developing roller 2510 can rotate about a central axis, and as shown in FIG. 20, it rotates in the direction (in FIG. 20, the counterclockwise direction) opposite from the direction in which the photoconductor 2020 rotates (in FIG. 20, the clockwise direction). Its central axis is lower than the central axis of the photoconductor 2020. Also, as shown in FIG. 20, in a state where the yellow developing unit 2054 is in opposition to the photoconductor 2020, a gap exists between the developing roller 2510 and the photoconductor 2020. That is, the yellow developing unit 2054 develops the latent image formed on the photoconductor 2020 without being in contact with the photoconductor 2020. It should be noted that when developing the latent image formed on the photoconductor 2020, an alternating electric field is formed between the developing roller 2510 and the photoconductor 2020.

The toner supply roller 2550 supplies the toner T contained in the first containing section 2530 and the second containing section 2535 to the developing roller 2510. The toner supply roller 2550 is made of polyurethane foam, for example, and abuts against the developing roller 2510 in a state of elastic deformation. The toner supply roller 2550 is arranged at a lower section of the first containing section 2530, and the toner T contained in the first containing section 2530 and the second containing section is supplied to the developing roller 2510 by the toner supply roller 2550 at a lower section of the first containing section 2530. The toner supply roller 2550 can rotate about a central axis, and its central axis is lower than the central rotation axis of the developing roller 2510. Also, the toner supply roller 2550 rotates in a direction (in FIG. 20, the clockwise direction) that is opposite from the direction of rotation of the developing roller 2510 (in FIG. 20, the counterclockwise direction). It should be noted that the toner supply roller 2550 has the function of supplying the toner T that is contained in the first containing section 2530 and the second containing section 2535 to the developing roller 2510 as well as the function of stripping off, from the developing roller 2510, the toner T remaining on the developing roller 2510 after developing.

The restriction blade 2560 regulates the thickness of the toner T layer borne by the developing roller 2510 and adds charge to the toner T borne by the developing roller 2510. The restriction blade 2560 has a rubber section 2560*a* and a rubber-supporting section 2560*b*. The rubber section 2560*a* is made of silicone rubber or urethane rubber, for example, and the rubber-supporting section 2560*b* is a thin plate of phosphor bronze or stainless steel, for example, and has spring properties. The rubber section 2560*a* is supported by the rubber-supporting section 2560*b*, and one end of the rubber-supporting section 2560*b* is fixed to a blade-supporting metal plate 2562. The blade-supporting metal plate 2562 is fastened to a seal frame 2526, which is described later, and is attached to the housing 2540 together with the restriction blade 2560, forming a portion of a seal unit 2520, which is described later. In this state, the rubber section 2560*a* is pressed against the developing roller 2510 by the elastic force created by the bending of the rubber-supporting section 2560*b*.

Also, a blade-backing member 2570 made of Moltoprene or the like is provided on the side of the restriction blade 2560 that is opposite from the developing roller 2510 side. The blade-backing member 2570 prevents the toner T from entering in between the rubber-supporting section 2560*b* and the housing 2540, thereby stabilizing the elasticity obtained by the bending of the rubber-supporting section 2560*b*, and, by applying force to the rubber section 2560*a* toward the developing roller 2510 from directly behind the rubber section 2560*a*, the blade-backing member presses the rubber section 2560*a* against the developing roller 2510. Consequently, the blade-backing member 2570 increases the contact uniformity and the sealing properties of the rubber section 2560*a* with respect to the developing roller 2510.

The end of the restriction blade 2560 on the side opposite from the side supported by the blade-supporting metal plate 2562, that is, its tip, is not in contact with the developing roller 2510, and a portion thereof away from its tip by a predetermined distance is in contact with the developing roller 2510 with some breadth. That is, the restriction blade 2560 does not abut against the developing roller 2510 at its edge but rather at its mid section. Also, the restriction blade 2560 is arranged such that its tip is facing upstream in the direction in which the developing roller 2510 rotates, that is, it is in so-called counter-abutment. It should be noted that the abutting position where the restriction blade 2560 abuts against the developing roller 2510 is lower than the central axis of the developing roller 2510 and is lower than the central axis of the toner supply roller 2550.

The seal member 2520 prevents the toner T in the yellow developing unit 2054 from leaking outside the unit, and also collects toner T on the developing roller 2510 after the developing roller 2510 has passed the developing position into the developing unit without scraping it off. The seal member 2520 is a seal made of polyethylene film or the like. The seal member 2520 is supported by a seal-supporting metal plate 2522, and is attached to the frame 2540 via the seal-supporting metal plate 2522. A seal urging member 2524 made of Moltoprene or the like is provided on the side of the seal member 2520 that is opposite from the developing roller 2510 side, and due to the elasticity of the seal urging member 2524, the seal member 2520 is pressed against the developing roller 2510. It should be noted that the abutting position where the seal member 2520 abuts against the developing roller 2510 is above the central axis of the developing roller 2510.

In the yellow developing unit 2054 configured in this manner, the toner supply roller 2550 supplies the toner T that is contained in the first containing section 2530 and the second containing section 2535, which function as the developer containing section, to the developing roller 2510. As for the toner T supplied to the developing roller 2510, it is carried to the abutting position of the restriction blade 2560 in conjunction with rotation of the developing roller 2510, and when it passes the abutting position, the thickness of the toner T layer is regulated and charge is applied. The toner T on the developing roller 2510, whose layer thickness has been regulated, is brought to the developing position in opposition to the photoconductor 2020 due to further rotation of the developing roller 2510 and is supplied for developing the latent image formed on the photoconductor 2020 in an alternating electric field at the developing position. The toner T on the developing roller 2510 that has passed the developing position due to further rotation of the developing roller 2510 passes the seal member 2520 and is collected into the developing unit without being scraped off by the seal member 2520.

===Configuration of the Elements===

Figure 21A:
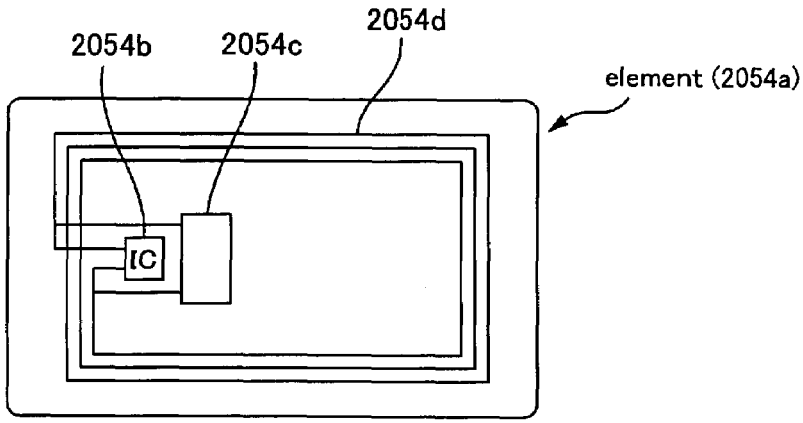
FIG. 21A is a plan transparent view showing the structure of an element.
Figure 21B:
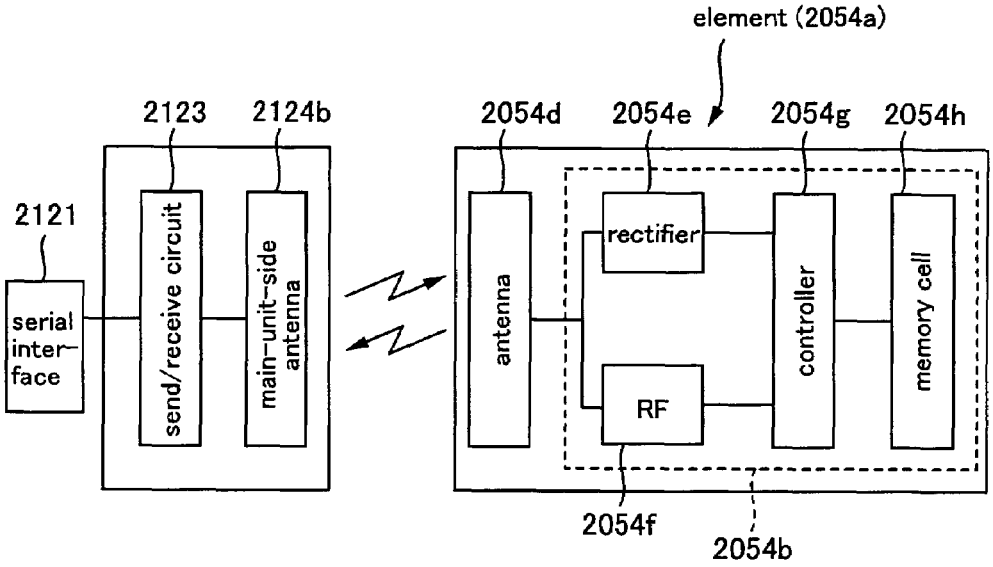
FIG. 21B is a block diagram for describing the internal configuration of an element and the send/receive section.

The configuration of the elements of the developing units and the element of the photoconductor unit, including the configuration for sending and receiving data, is described next with reference to FIG. 21A, FIG. 21B, FIG. 22, and FIG. 23. FIG. 21A is a transparent plan view showing the configuration of an element. FIG. 21B is a block diagram for describing the internal configuration of an element and the send/receive section. FIG. 22 is a diagram for describing the information stored in a memory cell 2054*h* of the element 2054*a*. FIG. 23 is a diagram for describing the information stored in the memory cell of the element 2054*a* of the photoconductor unit 2075.

Since the elements of the developing units other than the yellow developing unit 2054 have the same configuration, the element 2054*a* of the yellow developing unit 2054 is taken as an example and described below.

If the element 2054*a* and the main-unit-side antenna 2124*b* are in a predetermined positional relationship, for example, if they are within a distance of 10 mm of one another, information can be sent and received between the two in a non-contacting state. The element 2054*a* is overall very compact and thin, and one of its sides can be made adhesive and attached to an object as a label. It is called a memory tag, for example, and is sold commercially in various forms.

The element 2054*a* has a non-contact IC chip 2054*b*, a capacitor for resonation 2054*c* that is formed by etching a metal film, and a flat coil serving as an antenna 2054*d*. These are mounted onto a plastic film and covered by a transparent coversheet.

The main printer unit 2010*a* has the main-unit-side antenna 2124*b*, the send/receive circuit 2123, and the serial interface 2121, which is connected to the controller (CPU) 2120 of the main printer unit 2010*a*.

The non-contact IC chip 2054*b* has a rectifier 2054*e*, a signal analysis section RF (Radio Frequency) 2054*f*, a controller 2054*g*, and the memory cell 2054*h*. The memory cell 2054*h* is a nonvolatile memory that can be electrically read and written, such as an NAND flash ROM, and is capable of storing information that has been written and reading stored information from the outside.

The antenna 2054*d* of the element 2054*a* and the main-unit-side antenna 2124*b* wirelessly communicate with one another to read information stored on the memory cell 2054*h* and write information to the memory cell 2054*h*. Also, the high frequency signals that are generated by the send/receive circuit 2123 of the main printer unit 2010*a* are induced as a high frequency magnetic field via the main-unit-side antenna 2124*b*. This high frequency magnetic field is absorbed via the antenna 2054*d* of the element 2054*a* and rectified by the rectifier 2054*e*, thereby providing a direct current power source for driving the circuits in the IC chip 2054*b*.

The memory cell 2054*h* of the element 2054*a* stores various types of information, as shown in FIG. 22. The address 00H stores unique ID information for each element, such as the serial number of the element, the address 01H stores the date that the developing unit was manufactured, the address 02H stores information for specifying the destination of the developing unit, the address 03H stores information for specifying the manufacturing line on which the developing unit was manufactured, the address 04H stores information for specifying models with which the developing unit is compatible, the address 05H stores toner remaining amount information as information indicating the amount of toner that is contained in the developing unit, and the address 06H and subsequent regions store appropriate information.

The ID information that is stored on the memory cell 2054*h* of the element 2054*a* can be written at the time that the storage element is manufactured in the factory. The main unit of the printer 2010 main unit can read this ID information to identify the individual elements 2054*a*, 2051*a*, 2052*a*, and 2053*a*.

It should be noted that the element 2075*a* of the photoconductor unit 2075 has the same configuration. The memory cell of the element of the photoconductor unit 2075 stores various types of information, as shown in FIG. 23.

The address 00H stores unique ID information for each element, such as the serial number of the element, the address 01H stores the date that the photoconductor unit was manufactured, the address 02H stores information for specifying the destination of the photoconductor unit, the address 03H stores information for specifying the manufacturing line on which the photoconductor unit was manufactured, the address 04H stores information for specifying models with which the photoconductor unit is compatible, the address 05H stores information indicating the total number of printed sheets of the main printer unit 2010*a* when the photoconductor unit is mounted to the main printer unit 2010*a*, the address 06H stores information indicating the total number of printed sheets of the main printer unit 2010*a* when the photoconductor unit has reached its service life and is detached from the main printer unit 2010*a*, the address 07H stores the number of sheets for which color printing has been performed using that photoconductor unit, the address 08H stores the number sheets for which monochrome printing has been performed using that photoconductor unit, the address 09H stores the number of sheets developed by the yellow developing unit 2054, that is, the number of sheets printed using yellow toner, the address 0AH stores the number of sheets developed by the magenta developing unit 2052, that is, the number of sheets printed using magenta toner, the address 0BH stores the number of sheets developed by the cyan developing unit 2051, that is, the number of sheets printed using cyan toner, the address 0CH stores the number of sheets developed by the black developing unit 2053, that is, the number of sheets printed using black toner, and the address 0DH and subsequent regions store appropriate information.

===Relationship Between the Element and the Main-unit-side Antenna===

Figure 24A:
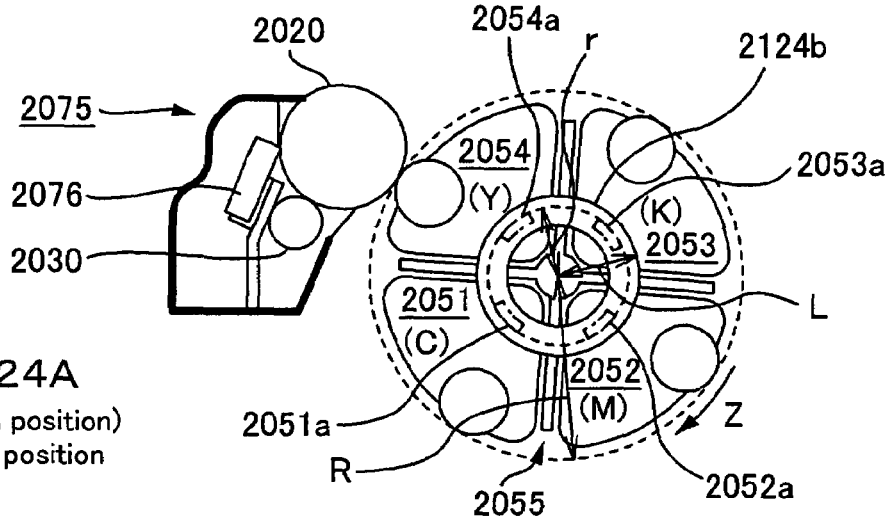
FIG. 24A is a diagram for describing the relationship between the elements and the main-unit-side antenna at the developing position.
Figure 24B:
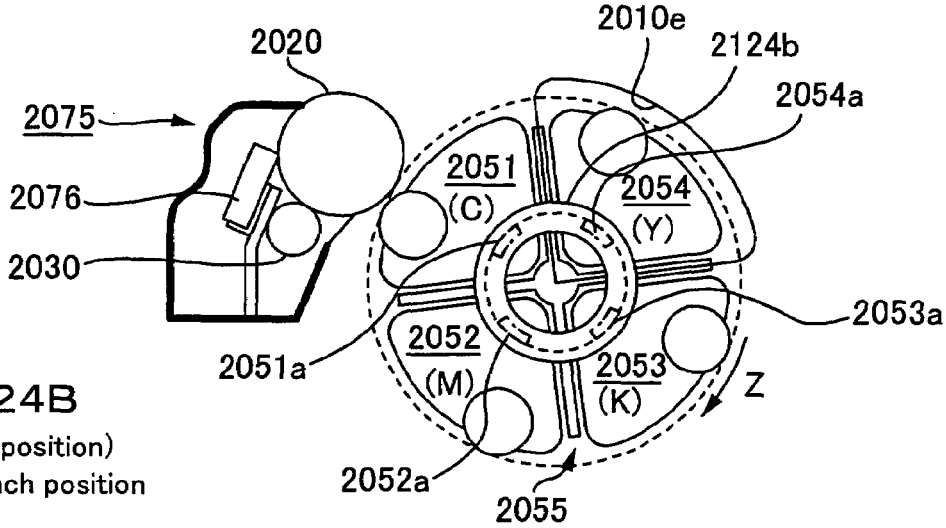
FIG. 24B is a diagram for describing the relationship between the elements and the main-unit-side antenna at the attach/detach position.
Figure 24C:
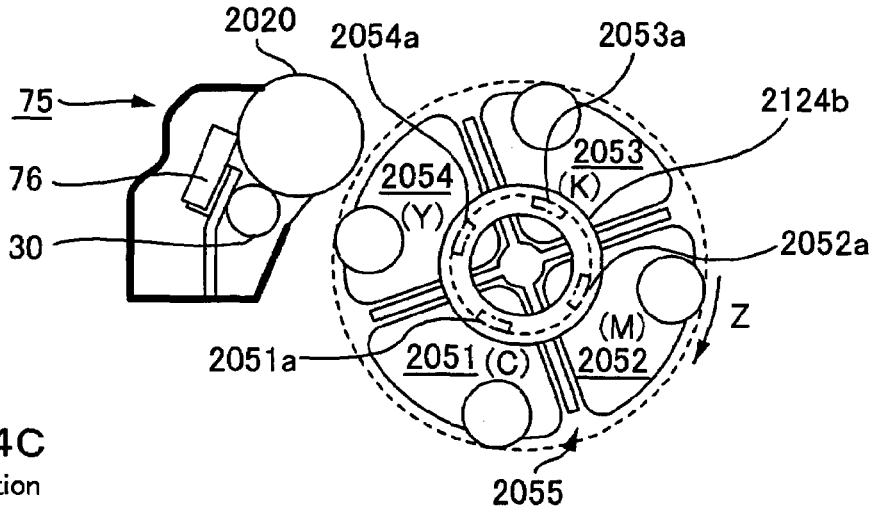
FIG. 24C is a diagram for describing the relationship between the elements and the main-unit-side antenna at the home position.

The relationship between the elements of the developing units and the main-unit-side antenna 2124*b* is described with reference to FIG. 24A to FIG. 24C. FIG. 24A is a diagram for describing the relationship between the element and the main-unit-side antenna at the developing position. FIG. 24B is a diagram for describing the relationship between the element and the main-unit-side antenna at the attach/detach position. FIG. 24C is a diagram for describing the relationship between the element and the main-unit-side antenna at the home position. It should be noted that FIGS. 24A to 24C are diagrams of the developing unit, the rotary 2055, and the photoconductor unit 2075, for example, seen from the paper plane depth side in FIG. 17 (i.e., the leading side when the developing unit is being attached).

In FIG. 24A, the yellow developing unit 2054 is positioned at the developing position (opposition position).

As shown in FIG. 24A, when R is the outermost diameter of the path traced by the yellow developing unit 2054 and r is the outermost diameter of the path traced by the element 2054*a* when the rotary 2055 is rotated with the yellow developing unit 2054 being mounted to the attach/detach section, then the relationship R>r is satisfied. Moreover, when L is the distance from the center of the rotary 2055 to a position on the outermost side of the main-unit-side antenna 2124*b* in the radial direction of rotation of the rotary 2055, then the relationship R>L is satisfied. Also, when the yellow developing unit 2054 is mounted to the attach/detach section, the main-unit-side antenna 2124*b* is positioned more outward than the element 2054*a* (in FIG. 24A, more forward than the element 2054*a*) in the axial direction of rotation of the rotary 2055 (in FIG. 24A, the direction that pierces the paper plane). Further, the element 2054*a* of the yellow developing unit 2054 opposes the main-unit-side antenna 2124*b* in a non-contacting state. Moreover, the element 2054*a* of the yellow developing unit 2054 is capable of communicating with the main-unit-side antenna 2124*b*. As is clear from FIG. 24A, the above-described relationship applies not only to the yellow developing unit 2054 but also to the cyan developing unit 2051, the magenta developing unit 2052, and the black developing unit 2053.

Next, when the rotary 2055 rotates by a predetermined angle in the Z direction from the state shown in FIG. 24A in which the yellow developing unit 2054 is positioned at the developing position, the state becomes that shown in FIG. 24B. In the state shown in FIG. 24B, the yellow developing unit 2054 is positioned at a position where it can be attached and detached. In this state, the yellow developing unit 2054 can be attached and detached via the attach/detach opening 2010*e*, that is, it can be mounted to the attach/detach section 2055*e* or it can be detached from the attach/detach section 2055*e*.

In the state shown in FIG. 24B as well, when the yellow developing unit 2054 is attached to the attach/detach section, the main-unit-side antenna 2124*b* is positioned more outward than the element 2054*a* (in FIG. 24B, more forward than the element 2054*a*) in the axial direction of rotation of the rotary 2055 (in FIG. 24B, the direction that pierces the paper plane). Further, the element 2054*a* of the yellow developing unit 2054 opposes the main-unit-side antenna 2124*b* in a non-contacting state. Moreover, the element 2054*a* of the yellow developing unit 2054 is capable of communicating with the main-unit-side antenna 2124*b*. As is clear from FIG. 24B, the above-described relationship applies not only to the yellow developing unit 2054 but also to the cyan developing unit 2051, the magenta developing unit 2052, and the black developing unit 2053.

FIG. 24C shows a state in which the rotary 2055 is positioned at the home position after the printer 2010 has been turned ON and the initialization operation has been performed.

In the state shown in FIG. 24C as well, when the yellow developing unit 2054 is attached to the attach/detach section, the main-unit-side antenna 2124*b* is positioned more outward than the element 2054*a* (in FIG. 24C, more forward than the element 2054*a*) in the axial direction of rotation of the rotary 2055 (in FIG. 24C, the direction that pierces the paper plane). Further, the element 2054*a* of the yellow developing unit 2054 opposes the main-unit-side antenna 2124*b* in a non-contacting state. Moreover, the element 2054*a* of the yellow developing unit 2054 is capable of communicating with the main-unit-side antenna 2124*b*. As is clear from FIG. 24C, the above-described relationship applies not only to the yellow developing unit 2054 but also to the cyan developing unit 2051, the magenta developing unit 2052, and the black developing unit 2053.

It should be noted that the above description was made with regard to the three states shown in FIG. 24A to FIG. 24C, but in the present embodiment, the elements of all of the developing units mounted to attach/detach sections oppose to the main-unit-side antenna 2124*b* at all rotation angles of the rotary 2055, as is clear from FIG. 24. Further, the elements of all the developing units mounted to attach/detach sections are capable of communicating with the main-unit-side antenna 2124*b* at all rotation angles of the rotary 2055.

Further, the main-unit-side antenna 2124*b* can wirelessly communicate with the elements not only when the rotary 2055 is stopped but also when the rotary 2055 is rotating. That is, the main-unit-side antenna 2124*b* can wirelessly communicate with the elements while they are moving.

Further, the elements of the developing units are capable of communicating with the main-unit-side antenna 2124*b* in a non-contacting state.

Thus, since the relationship R>r is satisfied when R is the outermost diameter of the path traced by the developing unit and r is the outermost diameter of the path traced by the element when the rotary 2055 is rotated with the developing unit being mounted to the attach/detach section, it is possible to reduce the size of the antenna for wirelessly communicating with the elements of the developing units.

That is, as described above in the section on problems to be solved by the present invention, it is preferable that communication between the elements of the developing units and the main printer unit 2010*a* is possible at a plurality of rotation angles of the rotary 2055. However, when a main-unit-side antenna 2124*b* capable of this is provided on the main printer unit 2010 side, there is the problem that the main-unit-side antenna 2124*b* must be large in size.

Accordingly, as discussed above, by arranging the elements such that the relationship R>r is satisfied, wherein R is the outermost diameter of the path traced by the developing unit and r is the outermost diameter of the path traced by the element when the rotary 2055 is rotated with the developing unit being mounted to the attach/detach section, then, for example, compared to a case where the elements are arranged so as to satisfy the relationship of R≦r, it is possible to arrange the elements more toward the center of the rotary 2055 with the developing units being mounted to the attach/detach sections, and thus the problem discussed above can be solved.

Giving further consideration to the relationship between R and r, it should be noted that the element is arranged increasingly toward the center of the rotary 2055 as the relationship proceeds from R>r to ¾R>r, ½R>r, and ¼R>r, allowing the size of the main-unit-side antenna to be reduced. Consequently, when R and r satisfy the relationship αR>r (α≦1), the smaller the α is, the greater the effect becomes.

===Writing Information to Elements of the Developing Units===

Figure 25:
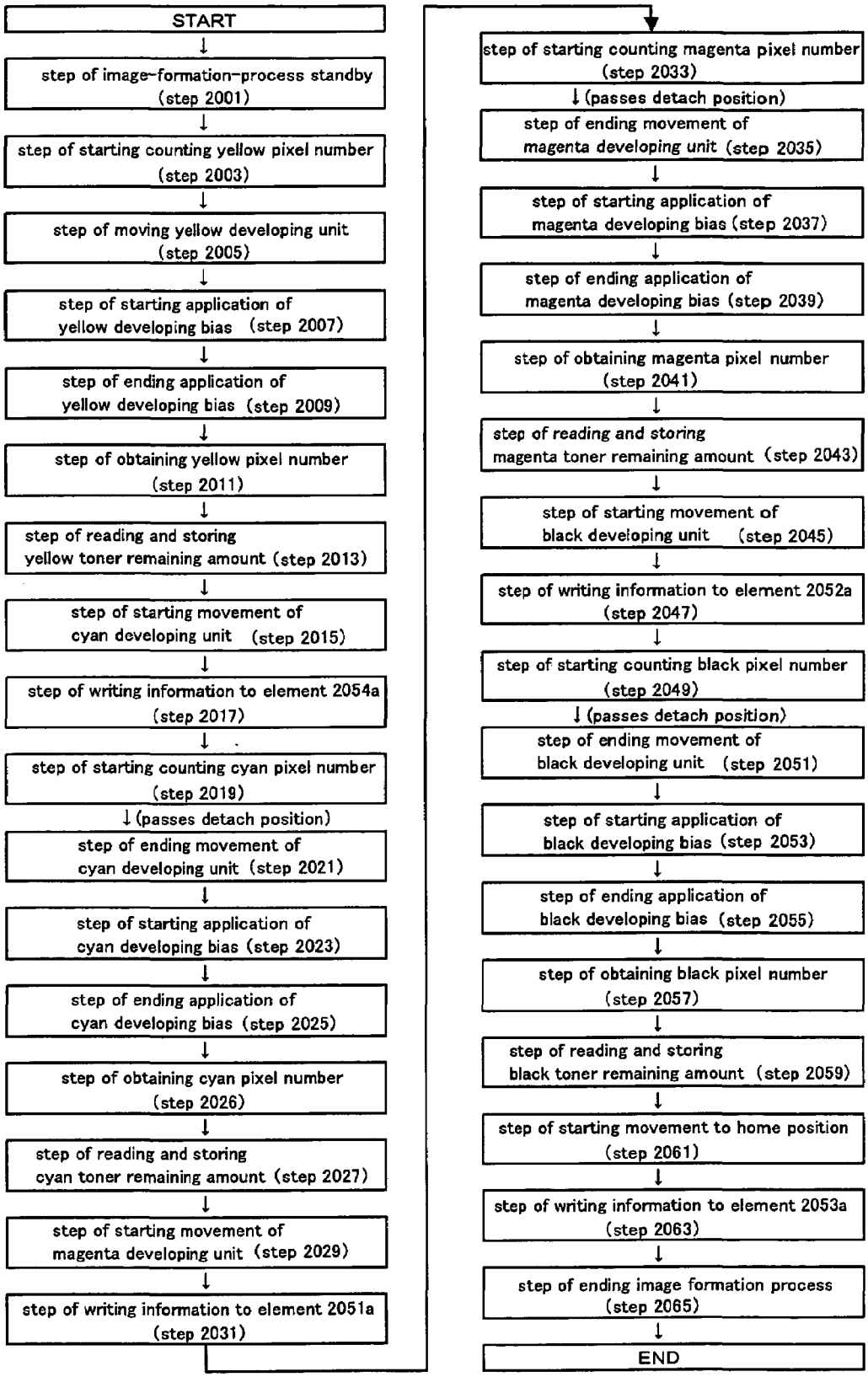
FIG. 25 is a flowchart for describing how information is written to the elements of the developing units.

An example of writing information to the elements of the developing units is described next with reference to FIG. 25. FIG. 25 is a flowchart for describing how information is written to the elements of the developing units.

<Step of Image-Formation-Process Standby (Step 2001)>

When the printer 2010 is turned ON, a predetermined initialization process is performed and the printer 2010 enters an image-formation-process standby state. When an image signal, which serves as an image-formation-process order, is input from the host computer to the main controller 2101 of the printer 2010 via the interface (I/F) 2112, the photoconductor 2020 and the intermediate transferring member 2070 are rotated. Then, the read sensor for synchronization RS detects the reference position of the intermediate transferring member 2070 and outputs a pulse signal. The unit controller 2102 executes the following control, using the received pulse signal as a reference.

<Step of Starting Counting Yellow Pixel Number (Step 2003)>

A latent image that corresponds to the yellow image information is formed on the charged photoconductor by the exposing unit 2040. At this time, the pixel counter 2127*a* starts counting the number of pixels input to the exposing unit 2040.

<Step of Moving Yellow Developing Unit (Step 2005)>

The rotary 2055 is rotated, thereby moving the yellow developing unit 2054 to the developing position.

<Step of Starting Application of Yellow Developing Bias (Step 2007)>

Application of a developing bias to the developing roller of the yellow developing unit 2054 is started. Thus, the latent image formed on the photoconductor 2020 is developed with yellow toner. The developing bias that is applied is a voltage in which AC voltage and DC voltage are superimposed, as mentioned above. It should be noted that it is possible to apply the developing bias to the developing roller before the yellow developing unit 2054 arrives at the developing position, or it is instead possible to apply the developing bias to the developing roller after the yellow developing unit 2054 arrives at the developing position.

<Step of Ending Application of Yellow Developing Bias (Step 2009)>

At a predetermined timing, application of the developing bias to the developing roller of the yellow developing unit 2054 is ended. Thus, the developing operation employing the yellow developing unit 2054 is ended.

<Step of obtaining Yellow Pixel Number (Step 2011)>

The number of pixels that have been counted is obtained from the pixel counter 2127*a*. The number of counted pixels is proportional to the amount of toner that is consumed, and thus the amount of yellow toner that is consumed YT can be found.

<Step of Reading and Storing Yellow Toner Remaining Amount (Step 2013)>

The amount of remaining yellow toner YY that is stored in the RAM is read out from the RAM and a value YYnew obtained by subtracting the consumed amount YT from the remaining amount YY is stored in the RAM as the new remaining amount.

<Step of Starting Movement of Cyan Developing Unit (Step 2015)>

The rotary 2055 starts rotating so as to position the cyan developing unit 2051 at the developing position.

<Step of Writing Information to Element 2054*a* (Step 2017)>

The value YYnew obtained by subtracting the consumed amount YT from the remaining amount YY is written to the element 2054*a* of the yellow developing unit 2054. This writing is carried out using the main-unit-side antenna 2124*b*, without it being in contact with the element 2054*a* as the element 2054*a* moves. It should be noted that when this writing is carried out, the yellow developing unit 2054 has not reached the detach position (the attach/detach position) where it can be detached via the attach/detach opening 2010*e*.

<Step of Starting Counting Cyan Pixel Number (Step 2019)>

A latent image that corresponds to the cyan image information is formed on the charged photoconductor by the exposing unit 2040. At this time, the pixel counter 2127*a* starts counting the number of pixels input to the exposing unit 2040.

<Step of Ending Movement of Cyan Developing Unit (Step 2021)>

The rotation of the rotary 2055 for positioning the cyan developing unit 2051 at the developing position is ended. Thus, the cyan developing unit 2051 arrives at the developing position.

<Step of Starting Application of Cyan Developing Bias (Step 2023)>

Application of a developing bias to the developing roller of the cyan developing unit 2051 is started. Thus, the latent image formed on the photoconductor 2020 is developed with cyan toner.

<Step of Ending Application of Cyan Developing Bias (Step 2025)>

At a predetermined timing, application of the developing bias to the developing roller of the cyan developing unit 2051 is ended. Thus, the developing operation employing the cyan developing unit 2051 is ended.

<Step of Obtaining Cyan Pixel Number (Step 2026)>

The number of pixels that have been counted is obtained from the pixel counter 2127*a*. The number of counted pixels is proportional to the amount of toner that is consumed, and thus the amount of cyan toner that is consumed CT can be found.

<Step of Reading and Storing Cyan Toner Remaining Amount (Step 2027)>

The amount of remaining cyan toner CC that is stored in the RAM is read out from the RAM and a value CCnew obtained by subtracting the consumed amount CT from the remaining amount CC is stored in the RAM as the new remaining amount.

<Step of Starting Movement of Magenta Developing Unit (Step 2029)>

The rotary 2055 starts rotating so as to position the magenta developing unit 2052 at the developing position.

<Step of Writing Information to Element 2051*a* (Step 2031)>

The value CCnew obtained by subtracting the consumed amount CT from the remaining amount CC is written to the element 2051*a* of the cyan developing unit 2051. This writing is carried out using the main-unit-side antenna 2124*b*, without it being in contact with the element 2051*a* as the element 2051*a* moves. It should be noted that when this writing is carried out, the cyan developing unit 2051 has not reached the detach position (the attach/detach position) where it can be detached via the attach/detach opening 2010*e*.

<Step of Starting Counting Magenta Pixel Number (Step 2033)>

A latent image that corresponds to the magenta image information is formed on the charged photoconductor by the exposing unit 2040. At this time, the pixel counter 2127*a* starts counting the number of pixels input to the exposing unit 2040.

<Step of Ending Movement of Magenta Developing Unit (Step 2035)>

The rotation of the rotary 2055 for positioning the magenta developing unit 2052 at the developing position is ended. Thus, the magenta developing unit 2052 arrives at the developing position.

<Step of Starting Application of Magenta Developing Bias (Step 2037)>

Application of a developing bias to the developing roller of the magenta developing unit 2052 is started. Thus, the latent image formed on the photoconductor 2020 is developed with magenta toner.

<Step of Ending Application of Magenta Developing Bias (Step 2039)>

At a predetermined timing, application of the developing bias to the developing roller of the magenta developing unit 2052 is ended. Thus, the developing operation employing the magenta developing unit 2052 is ended.

<Step of Obtaining Magenta Pixel Number (Step 2041)>

The number of pixels that have been counted is obtained from the pixel counter 2127*a*. The number of counted pixels is proportional to the amount of toner that is consumed, and thus the amount of magenta toner that is consumed MT can be found.

<Step of Reading and Storing Magenta Toner Remaining Amount (Step 2043)>

The amount of remaining magenta toner MM that is stored in the RAM is read out from the RAM and a value MMnew obtained by subtracting the consumed amount MT from the remaining amount MM is stored in the RAM as the new remaining amount.

<Step of Starting Movement of Black Developing Unit (Step 2045)>

The rotary 2055 starts rotating so as to position the black developing unit 2053 at the developing position.

<Step of Writing Information to Element 2052*a* (Step 2047)>

The value MMnew obtained by subtracting the consumed amount MT from the remaining amount MM is written to the element 2052*a* of the magenta developing unit 2052. This writing is carried out using the main-unit-side antenna 2124*b*, without it being in contact with the element 2052*a* as the element 2052*a* moves. It should be noted that when this writing is carried out, the magenta developing unit 2052 has not reached the detach position (the attach/detach position) where it can be detached via the attach/detach opening 2010*e*.

<Step of Starting Counting Black Pixel Number (Step 2049)>

A latent image that corresponds to the black image information is formed on the charged photoconductor by the exposing unit 2040. At this time, the pixel counter 2127*a* starts counting the number of pixels input to the exposing unit 2040.

<Step of Ending Movement of Black Developing Unit (Step 2051)>

The rotation of the rotary 2055 for positioning the black developing unit 2053 at the developing position is ended. Thus, the black developing unit 2053 arrives at the developing position.

<Step of Starting Application of Black Developing Bias (Step 2053)>

Application of a developing bias to the developing roller of the black developing unit 2053 is started. Thus, the latent image formed on the photoconductor 2020 is developed with black toner.

<Step of Ending Application of Black Developing Bias (Step 2055)>

At a predetermined timing, application of the developing bias to the developing roller of the black developing unit 2053 is ended. Thus, the developing operation employing the black developing unit 2053 is ended.

<Step of Obtaining Black Pixel Number (Step 2057)>

The number of pixels that have been counted is obtained from the pixel counter 2127*a*. The number of counted pixels is proportional to the amount of toner that is consumed, and thus the amount of black toner that is consumed BT can be found.

<Step of Reading and Storing Black Toner Remaining Amount (Step 2059)>

The amount of remaining black toner BB that is stored in the RAM is read out from the RAM and a value BBnew obtained by subtracting the consumed amount BT from the remaining amount BB is stored in the RAM as the new remaining amount.

<Step of Starting Movement to Home Position (Step 2061)>

Rotation of the rotary 2055 is started so as to position the rotary 2055 at the home position.

<Step of Writing Information to Element 2053*a* (Step 2063)>

The value BBnew obtained by subtracting the consumed amount BT from the remaining amount BB is written to the element 2053*a* of the black developing unit 2053. This writing is carried out using the main-unit-side antenna 2124*b*, without it being in contact with the element 2053*a* as the element 2053*a* moves. It should be noted that when this writing is carried out, the black developing unit 2053 has not reached the detach position (the attach/detach position) where it can be detached via the attach/detach opening 2010*e*.

<Step of Ending Printing Operation (Step 2065)>

When the rotary 2055 arrives at the home position, the image formation process is ended and the state of image-formation-process standby is entered.

As discussed above, in the present embodiment, the main-unit-side antenna is used to write information to the element of a developing unit mounted to an attach/detach section when the AC voltage supply section is not supplying AC voltage during the period from the start to the end of the image formation process. Also, during the period from when the developing unit arrives at the opposition position in opposition to the photoconductor until when the developing unit arrives at the detach position where it can be detached from the attach/detach section through the attach/detach opening due to rotation of the rotary, the main-unit-side antenna is used to write information to the element of the developing unit mounted to the attach/detach section.

Other Embodiments

In the foregoing, developing units, for example, according to the present invention were described in an embodiment thereof. However, the foregoing embodiment of the invention is for the purpose of elucidating the present invention and is not to be interpreted as limiting the present invention. The invention can of course be altered and improved without departing from the gist thereof and includes equivalents.

In the foregoing embodiment, when L is the distance from the center of the rotary 2055 to a position on the outermost side of the main-unit-side antenna 2124*b* in the radial direction of rotation of the rotary 2055, then the relationship R>L is satisfied, but this is not a limitation. For example, it is also possible to satisfy the relationship R≦L.

However, taking into account the fact that a small main-unit-side antenna 2124*b* can be used for wirelessly communicating with the elements, the configuration of the foregoing embodiment is more preferable.

Giving further consideration to the relationship between R and L, it should be noted that the size of the main-unit-side antenna becomes smaller as the relationship proceeds from R>L to ¾R>L, ½ R>L, and ¼R>L. Consequently, when R and L satisfy the relationship αR>L (α≦1), then the smaller the α is, the greater the effect becomes.

Also, in the foregoing embodiment, an element is provided on a lateral surface of the developing unit that intersects the axial direction of rotation of the rotary 2055 when the developing unit is mounted to an attach/detach section, but this is not a limitation. For example, that element can be provided inside the developing unit.

However, taking into account the fact that it allows the element to be provided at an easily attachable position of the developing unit, the configuration of the foregoing embodiment is more preferable.

Also, in the foregoing embodiment, the lateral surface was the lateral surface on the leading side when the developing unit is being attached, but this is not a limitation. For example, the lateral surface may be the lateral surface on the frontward side when the developing unit is being attached.

However, taking into account the fact that it reduces the possibility of damage to the element by the user touching the element when changing the developing unit, the configuration of the foregoing embodiment is more preferable.

Also, in the foregoing embodiment, when the developing units are mounted to the attach/detach sections, the main-unit-side antenna 2124*b* is positioned more outward than the elements in the axial direction of rotation of the rotary 2055; however, this is not a limitation. For example, it may be positioned more inward than the elements in the axial direction of rotation of the rotary 2055.

However, taking into account the fact that it allows the main-unit-side antenna 2124*b* to be provided at a position on the printer 2010. where it can be easily attached, the configuration of the foregoing embodiment is more preferable.

Figure 26A:
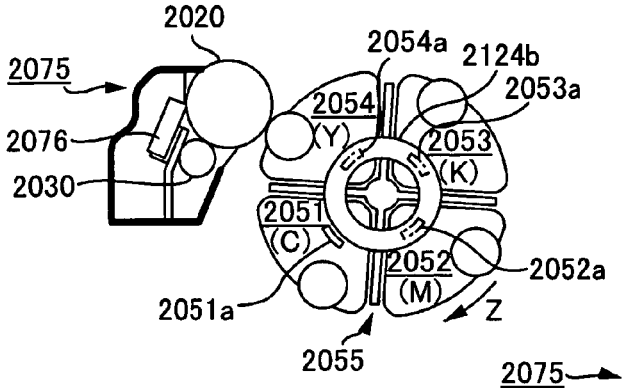
FIG. 26A is a diagram showing a first alternative example of the relationship between the elements and the main-unit-side antenna.

Also, in the foregoing embodiment, the elements of all the developing units mounted to the attach/detach sections oppose the main-unit-side antenna 2124*b* at all rotation angles of the rotary 2055, but this is not a limitation. For example, as shown in FIG. 26A, it is also possible for the elements of some of the developing units mounted to the attach/detach sections to be in opposition to the main-unit-side antenna 2124*b* at all rotation angles of the rotary 2055.

Figure 26D:
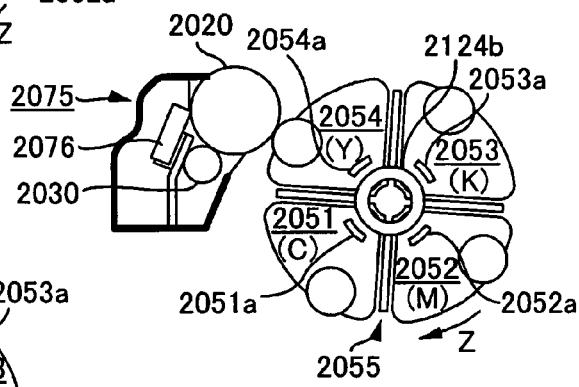
FIG. 26D is a diagram showing a fourth alternative example of the relationship between the elements and the main-unit-side antenna.
Figure 26B:
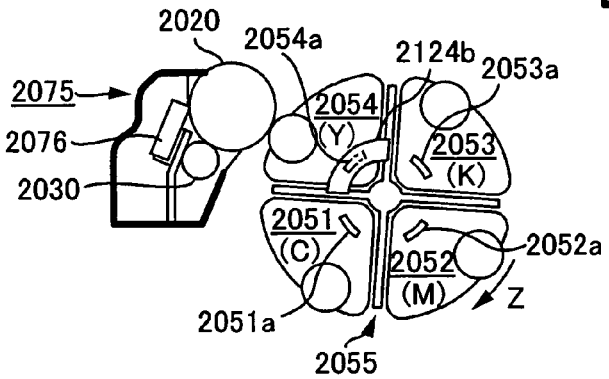
FIG. 26B is a diagram showing a second alternative example of the relationship between the elements and the main-unit-side antenna.
Figure 26E:
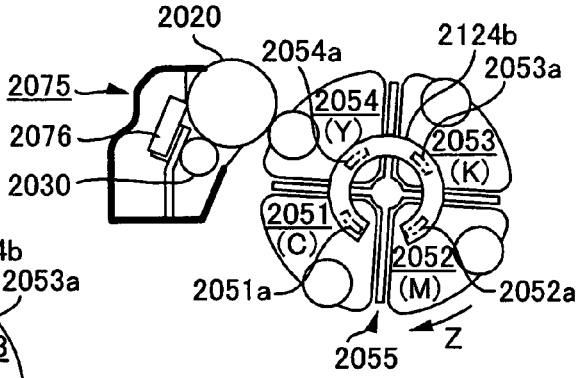
FIG. 26E is a diagram showing a fifth alternative example of the relationship between the elements and the main-unit-side antenna.
Figure 26C:
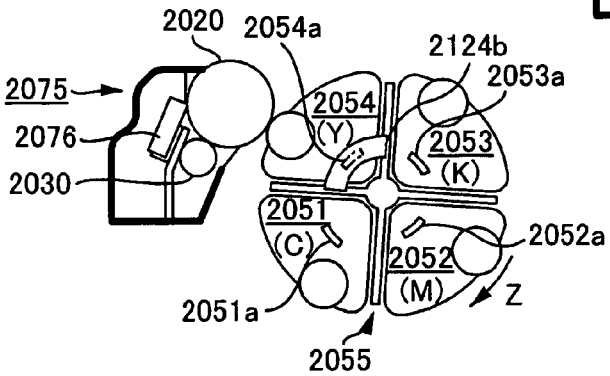
FIG. 26C is a diagram showing a third alternative example of the relationship between the elements and the main-unit-side antenna.

As shown in FIG. 26B and FIG. 26C, it is also possible for the element of some or all of the developing units mounted to the attach/detach sections to be in opposition to the main-unit-side antenna 2124*b* at a predetermined rotation angle of the rotary 2055.

However, taking into consideration the fact that it allows communication performance between the elements and the antenna to be improved at all rotation angles of the rotary 2055, the configuration of the foregoing embodiment is more preferable.

As shown in FIG. 26D, it is also possible for the elements of the developing units attached to the attach/detach sections to not oppose the main-unit-side antenna 2124*b*; however, taking into consideration the fact that it allows an increase in the communication performance between the elements and the antenna, the configuration of the foregoing embodiment is more preferable.

Also, in the foregoing embodiment, the elements of all of the developing units mounted to the attach/detach sections were in opposition to the main-unit-side antenna 2124*b* at all rotation angles of the rotary 2055, but as shown in FIG. 26E, when there are a plurality of developing units mounted to the attach/detach sections, it is also possible that all of the elements of these plurality of developing units are simultaneously in opposition to the main-unit-side antenna 2124*b* at a predetermined rotation angle of the rotary 2055.

In such a case, communication performance can be increased when, for example, communication is simultaneously performed between the plurality of elements and the main-unit-side antenna 2124*b* at a predetermined rotation angle of the rotary 2055.

Also, in the foregoing embodiment, the elements of all of the developing units mounted to the attach/detach sections were capable of communicating with the main-unit-side antenna 2124*b* at all rotation angles of the rotary 2055, but this is not a limitation. For example, it is also possible for the elements of all of the developing units mounted to the attach/detach sections to be capable of communicating with the main-unit-side antenna 2124*b* at a predetermined rotation angle of the rotary 2055, it is also possible for the elements of some of the developing units mounted to the attach/detach sections to be capable of communicating with the main-unit-side antenna 2124*b* at all rotation angles of the rotary 2055, or it is also possible for the elements of some of the developing units mounted to the attach/detach sections to be capable of communicating with the main-unit-side antenna 2124*b* at some of the rotation angles of the rotary 2055.

However, taking into account the fact that it allows restrictions regarding the timing at which communication is carried out between the element and the main-unit-side antenna 2124*b* to be reduced, the configuration of the foregoing embodiment is preferable.

Further, when a plurality of developing units are mounted to the attach/detach sections, then it is also possible for all elements of the plurality of developing units to be capable of simultaneously communicating with the main-unit-side antenna 2124*b* at a predetermined rotation angle of the rotary 2055.

In this case as well, a plurality of elements can simultaneously communicate with the main-unit-side antenna 2124*b* at a predetermined rotation angle of the rotary 2055, and thus restrictions regarding the timing at which communication is carried out between the elements and the main-unit-side antenna 2124*b* can be reduced.

Also, in the foregoing embodiment, the elements of rotating developing units were capable of communicating with the main-unit-side antenna 2124*b*, but this is not a limitation.

However, considering that it allows the timing during which the developing units are rotating to be utilized so as to carry out communication efficiently, the configuration of the foregoing embodiment is more preferable.

Also, in the foregoing embodiment, the elements were capable of communicating with the main-unit-side antenna 2124*b* in a non-contacting state, but this is not a limitation.

For example, it is also possible for the elements to communicate with the main-unit-side antenna 2124*b* in a state of contact therewith.

Also, in the foregoing embodiment, the main-unit-side antenna was used to write information to the elements of the developing units mounted to the attach/detach sections when the AC voltage supply section is not supplying AC voltage during the period from start to finish of the image formation process, but this is not a limitation. For example, it is also possible to use the main-unit-side antenna to write information to the elements of the developing units mounted to the attach/detach sections when the AC voltage supply section is supplying AC voltage during the period from start to finish of the image formation process.

However, since the main-unit-side antenna is used to write information to the elements of the developing units mounted to the attach/detach sections when the AC voltage supply section is not supplying AC voltage during the period from start to finish of the image formation process, the configuration of the foregoing embodiment is more preferable because information can be written accurately without being affected by noise caused by the supply of AC voltage to the charging member, for example.

Also, in the foregoing embodiment, the main-unit-side antenna was used to write information to the elements of the developing units mounted to the attach/detach sections during the period from when, due to rotation of the rotary, a developing unit arrives at the opposition position in opposition to the photoconductor until when it arrives at the detach position where it can be detached from the attach/detach section via the attach/detach opening, but this is not a limitation.

However, when an attach/detach opening through which the developing unit can be attached to and detached from an attach/detach section is provided, there is a possibility that a developing unit mounted to an attach/detach section will be carelessly detached via the attach/detach opening. In particular, the amount of developer in a developing unit decreases when developing is performed with that developing unit positioned at the opposition position, and thus when that developing unit is detached before information on the amount of developer that has decreased is written to its element, there is a possibility that the amount of developer contained in that developing unit, for example, cannot be ascertained. Consequently, the configuration of the foregoing embodiment is more preferable because it allows this problem to be circumvented.

Also, as the developing roller, as long as a developing roller can be obtained, it is possible to use any of magnetic material, non-magnetic material, conductive material, insulating material, metal, rubber, and resin, for example. For example, as the material it is possible to use a metal such as aluminum, nickel, stainless steel, and iron, a rubber such as natural rubber, silicone rubber, urethane rubber, butadiene rubber, chloroprene rubber, neoprene rubber, and NBR, or a resin such as styrene resin, vinyl chloride resin, polyurethane resin, polyethylene resin, methacrylic resin, and nylon resin, for example. It is of course also possible to use these materials with a coating on their upper layer section. In this case, as the coating material it is possible to use polyethylene, polystyrene, polyurethane, polyester, nylon, or acrylic, for example. Also, as regards its form, it is possible to adopt any of a non-elastic body, an elastic body, a single layer, multiple layers, a film, and a roller, for example. Also, the developer is not limited to toner, and it may also be a two-component developer in which a carrier has been mixed.

The same applies for the toner supply member as well, and as the material thereof it is possible to use polystyrene foam, polyethylene foam, polyester foam, ethylene propylene foam, nylon foam, and silicone foam, for example, in addition to polyurethane foam, which was mentioned above. It should be noted that either open-cell foam or closed-cell foam can be used as the foam cell of the toner supply means. It should also be noted that there is no limitation to foam material, and it is also possible to use a rubber material having elasticity. More specifically, it is possible to use silicone rubber, urethane rubber, natural rubber, isoprene rubber, styrene butadiene rubber, butadiene rubber, chloroprene rubber, butyl rubber, ethylene propylene rubber, epichlorohydrin rubber, nitrile butadiene rubber, or acrylic rubber, molded with a conductive agent such as carbon dispersed therein.

The elements of the developing units and the element of the photoconductor unit are not limited to the configuration described in the foregoing embodiment. As long as information can be written to them, it is possible for them to be elements in which the antenna is provided separately, for example.

In the foregoing embodiment, an intermediate transferring type full-color laser beam printer was described as an example of the image forming apparatus, but the present invention can also be adopted for various other types of image forming apparatuses, such as full-color laser beam printers that are not of the intermediate transferring type, monochrome laser beam printers, copying machines, and facsimiles.

===Configuration of the Computer System, etc.===

Next, a computer system serving as an example of an embodiment of the present invention is described with reference to the drawings.

Figure 27:
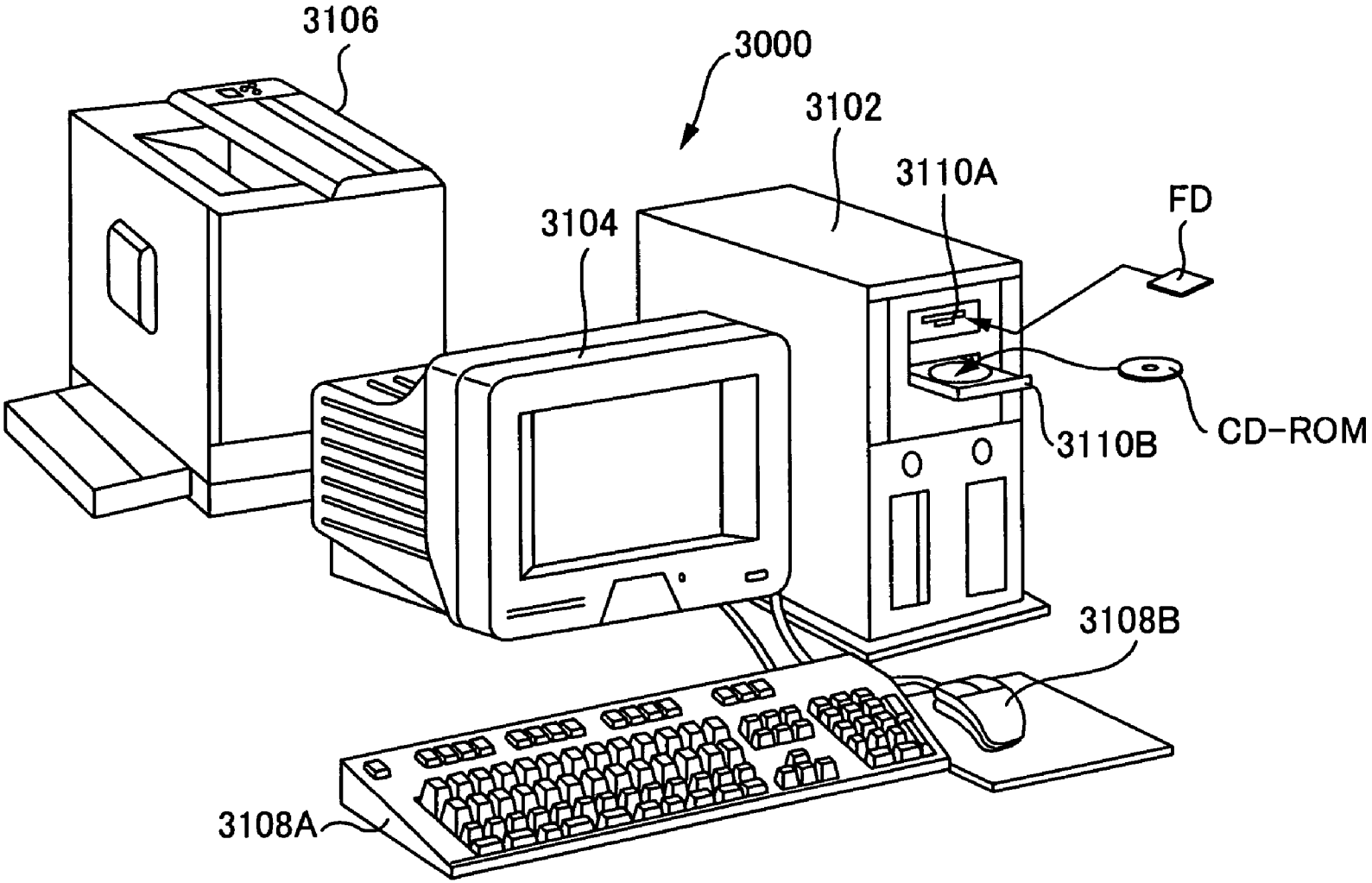
FIG. 27 is an explanatory diagram showing the external configuration of a computer system.

FIG. 27 is an explanatory diagram showing the external structure of the computer system. A computer system 3000 is provided with a main computer unit 3102, a display device 3104, a printer 3106, an input device 3108, and a reading device 3110. In this embodiment, the main computer unit 3102 is housed within a mini-tower type housing; however, this is not a limitation. A CRT (cathode ray tube),plasma display, or liquid crystal display device, for example, is generally used as the display device 3104, but this is not a limitation. As for the printer 3106, the printer described above is used. In this embodiment, the input device 3108 is a keyboard 3108A and a mouse 3108B, but it is not limited to these. In this embodiment, a flexible disk drive device 3110*a* and a CD-ROM drive device 3110B are used as the reading device 3110, but the reading device 3110 is not limited to these, and it may also be a MO (magnet optical) disk drive device or a DVD (digital versatile disk), for example.

Figure 28:
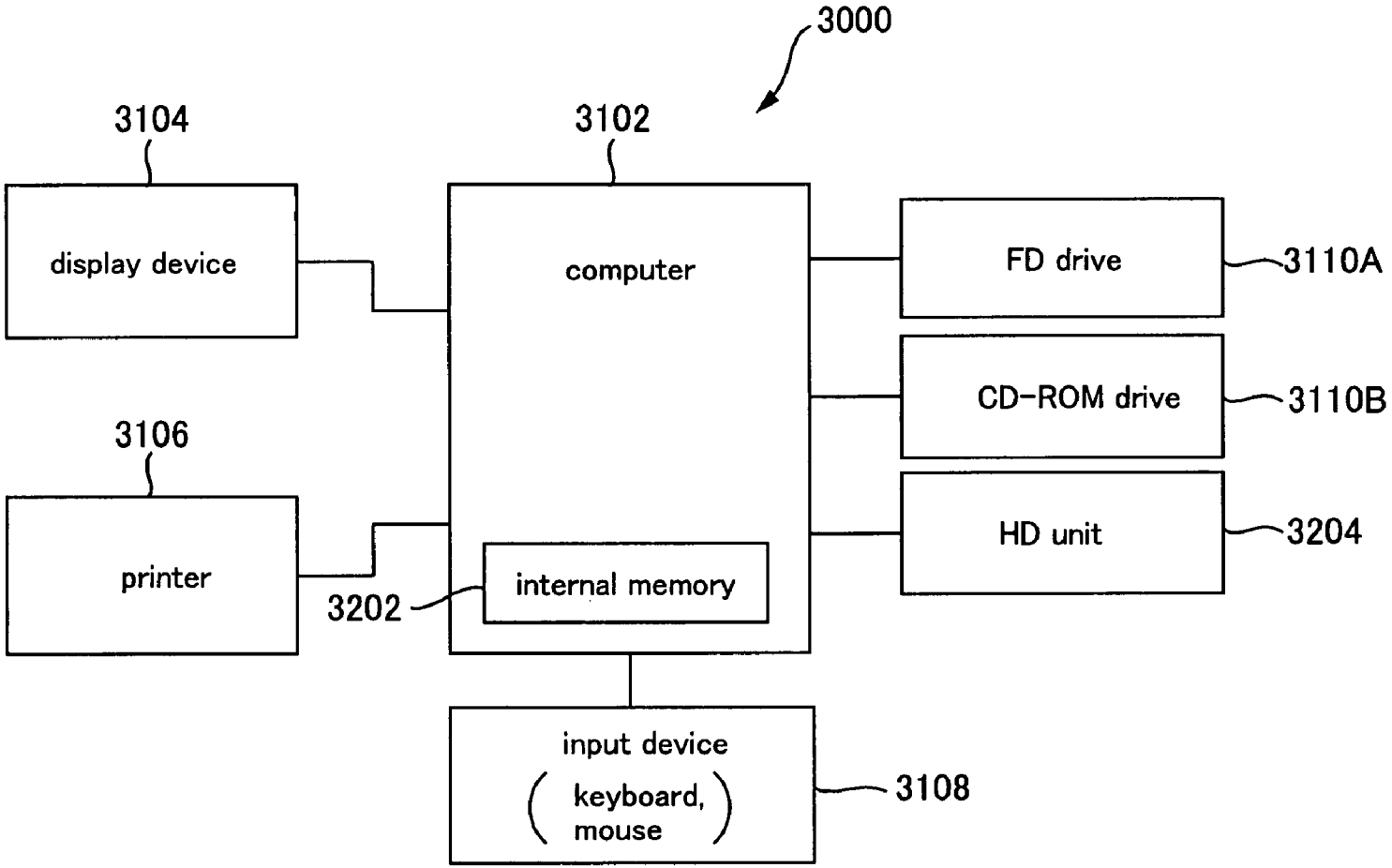
FIG. 28 is a block diagram showing the configuration of the computer system shown in FIG. 27.

FIG. 28 is a block diagram showing the configuration of the computer system shown in FIG. 27. An internal memory 3202 such as a RAM within the housing containing the main computer unit 3102 and, also, an external memory such as a hard disk drive unit 3204 are provided.

It should be noted that in the above description, an example was described in which the computer system is constituted by connecting the printer 3106 to the main computer unit 3102, the display device 3104, the input device 3108, and the reading device 3110; however, this is not a limitation. For example, the computer system can be made of the main computer unit 3102 and the printer 3106, or the computer system does not have to be provided with any one of the display device 3104, the input device 3108, and the reading device 3110.

Further, for example, the printer 3106 can have some of the functions or mechanisms of the main computer unit 3102, the display device 3104, the input device 3108, and the reading device 3110. As an example, the printer 3106 may be configured so as to have an image processing section for carrying out image processing, a display section for carrying out various types of displays, and a recording media attach/detach section to and from which recording media storing image data captured by a digital camera or the like are inserted and taken out.

As an overall system, the computer system that is thus achieved is superior to conventional systems.

INDUSTRIAL APPLICABILITY

According to the present invention, an image forming apparatus and a computer system that have an efficient communication system can be achieved.

Also, according to the present invention, it is possible to achieve an image forming apparatus, a developing unit, and a computer system that allow the size of the antenna for wirelessly communicating with the element of the developing unit to be made small.

The invention claimed is:

1. An image forming apparatus comprising:

a rotating member provided with a plurality of attach/detach sections, to and from each of which a developing unit having an element that is capable of performing communication can be attached and detached, where the element has an IC chip and a developing-unit-side antenna; and an antenna for wirelessly communicating, at a plurality of rotation angles of said rotating member, with the elements of the developing units attached respectively to said attach/detach sections;

wherein, when R is an outermost diameter of a path traced by said developing units and r is an outermost diameter of a path traced by said elements when said rotating member is rotated with said developing units attached to said attach/detach sections, then a relationship R>r is satisfied, wherein each of said elements is provided on a lateral surface of said developing unit, said lateral surface intersecting with an axial direction of rotation of said rotating member when said developing unit is attached to said attach/detach section, wherein, when said developing unit is attached to said attach/detach section, said antenna is positioned more outward than said element in the axial direction of rotation of said rotating member, wherein, when R is an outermost diameter of a path traced by said developing units and r is an outermost diameter of a path traced by said elements when said rotating member is rotated with said developing units attached to said attach/detach sections, then a relationship R/2>r is satisfied, and wherein, when L is a distance from a center of said rotating member to a position of the outermost side of said antenna in a radial direction of rotation of said rotating member, then a relationship R/2>L is satisfied.

2. A developing unit comprising:

an element that is capable of performing communication, where the element has an IC chip and a developing-unit-side antenna, wherein said developing unit is attachable to and detachable from one of a plurality of attach/detach sections of a main image forming apparatus unit, said main image forming apparatus unit including: a rotating member provided with said plurality of attach/detach sections, to and from each of which the developing unit can be attached and detached; and an antenna for wirelessly communicating, at a plurality of rotation angles of said rotating member, with the element of the developing unit attached to the attach/detach section, wherein, when R is an outermost diameter of a path traced by said developing unit and r is an outermost diameter of a path traced by said element when said rotating member is rotated with said developing unit attached to said attach/detach section, then a relationship R>r is satisfied, wherein each of said elements is provided on a lateral surface of said developing unit, said lateral surface intersecting with an axial direction of rotation of said rotating member when said developing unit is attached to said attach/detach section, wherein, when said developing unit is attached to said attach/detach section, said antenna is positioned more outward than said element in the axial direction of rotation of said rotating member, wherein, when R is an outermost diameter of a path traced by said developing unit and r is an outermost diameter of a path traced by said element when said rotating member is rotated with said developing unit attached to said attach/detach section, then a relationship R/2>r is satisfied, and wherein, when L is a distance from a center of said rotating member to a position of the outermost side of said antenna in a radial direction of rotation of said rotating member, then a relationship R/2>L is satisfied.

3. A computer system comprising:

a main computer unit, and an image forming apparatus that is connectable to said main computer unit and that includes:

a rotating member provided with a plurality of attach/detach sections, to and from each of which a developing unit having an element that is capable of performing communication can be attached and detached, where the element has an IC chip and a developing-unit-side antenna; and an antenna for wirelessly communicating, at a plurality of rotation angles of said rotating member, with the elements of the developing units attached respectively to said attach/detach sections;

wherein, when R is an outermost diameter of a path traced by said developing units and r is an outermost diameter of a path traced by said elements when said rotating member is rotated with said developing units attached to said attach/detach sections, then a relationship R>r is satisfied, wherein each of said elements is provided on a lateral surface of said developing unit, said lateral surface intersecting with an axial direction of rotation of said rotating member when said developing unit is attached to said attach/detach section, wherein, when said developing unit is attached to said attach/detach section, said antenna is positioned more outward than said element in the axial direction of rotation of said rotating member, wherein, when R is an outermost diameter of a path traced by said developing unit and r is an outermost diameter of a path traced by said element when said rotating member is rotated with said developing unit attached to said attach/detach section, then a relationship R/2>r is satisfied, and wherein, when L is a distance from a center of said rotating member to a position of the outermost side of said antenna in a radial direction of rotation of said rotating member, then a relationship R/2>L is satisfied.

* * * * *